US009451808B2

(12) United States Patent
Dojan et al.

(10) Patent No.: US 9,451,808 B2
(45) **Date of Patent: *Sep. 27, 2016**

(54) ARTICLES OF FOOTWEAR WITH TENSILE STRAND ELEMENTS

(71) Applicant: NIKE, Inc., Beaverton, OR (US)

(72) Inventors: Frederick J. Dojan, Vancouver, WA (US); Shane S. Kohatsu, Portland, OR (US); James Hwang, Taichung (TW); Daniel A. Johnson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 174 days.

This patent is subject to a terminal disclaimer.

(21) Appl. No.: 14/445,215

(22) Filed: Jul. 29, 2014

(65) Prior Publication Data

US 2015/0013192 A1 Jan. 15, 2015

Related U.S. Application Data

(63) Continuation of application No. 13/404,448, filed on Feb. 24, 2012, now Pat. No. 8,819,963.

(51) Int. Cl.
*A43B 23/00* (2006.01)
*A43C 11/00* (2006.01)
(Continued)

(52) U.S. Cl.
CPC ..... *A43C 11/00* (2013.01); *A43B 23/0245* (2013.01); *A43B 23/0265* (2013.01); *A43C 1/04* (2013.01); *A43C 5/00* (2013.01); *A43C 15/02* (2013.01)

(58) Field of Classification Search
CPC .. A43B 23/00; A43B 23/02; A43B 23/0245; A43C 1/00; A43C 5/00
USPC ..... 36/45, 50.1, 89
See application file for complete search history.

(56) References Cited

U.S. PATENT DOCUMENTS 2,034,091 A 3/1936 Dunbar
2,048,294 A 7/1936 Roberts
(Continued)

FOREIGN PATENT DOCUMENTS

CN 101125044 A 2/2008
DE 20215559 U1 1/2003
(Continued)

OTHER PUBLICATIONS

Extended European Search Report dated Jan. 19, 2016 in European Patent Application No. 15000354.9.
(Continued)

*Primary Examiner* — Marie Bays
(74) *Attorney, Agent, or Firm* — Plumsea Law Group, LLC

(57) ABSTRACT

An upper for an article of footwear may have material layers and a plurality of strand segments. The material layers are located adjacent to each other and in an overlapping configuration, and the material layers are located in a lace region and a lower region of the upper. The strand segments extend from the lace region to the lower region. The strand segments may be located and secured between the material layers in the lace region and the lower region. The strand segments may form both an exterior surface of the upper and an opposite interior surface of the upper in an area between the lace region and the lower region. The material layers may define an opening between the lace region and the lower region, and the strand segments extend across the opening.

17 Claims, 57 Drawing Sheets

(51) Int. Cl.

| | |
|---|---|
| ***A43C 5/00*** | (2006.01) |
| ***A43B 23/02*** | (2006.01) |
| ***A43C 15/02*** | (2006.01) |
| ***A43C 1/04*** | (2006.01) |

(56) References Cited

U.S. PATENT DOCUMENTS

| | | | |
|---|---|---|---|
| 2,205,356 | A | 6/1940 | Gruensfelder |
| 2,311,996 | A | 2/1943 | Parker |
| 3,439,434 | A | 4/1969 | Tangorra |
| 3,672,078 | A | 6/1972 | Fukuoka |
| 3,823,493 | A | 7/1974 | Brehm et al. |
| 4,627,369 | A | 12/1986 | Conrad et al. |
| 4,634,616 | A | 1/1987 | Musante et al. |
| 4,642,819 | A | 2/1987 | Ales et al. |
| 4,756,098 | A | 7/1988 | Boggia |
| 4,858,339 | A | 8/1989 | Hayafuchi et al. |
| 4,873,725 | A | 10/1989 | Mitchell |
| 5,149,388 | A | 9/1992 | Stahl |
| 5,156,022 | A | 10/1992 | Altman et al. |
| 5,271,130 | A | 12/1993 | Batra |
| 5,285,658 | A | 2/1994 | Altman et al. |
| 5,345,638 | A | 9/1994 | Nishida |
| 5,359,790 | A | 11/1994 | Iverson et al. |
| 5,367,795 | A | 11/1994 | Iverson et al. |
| 5,380,480 | A | 1/1995 | Okine et al. |
| 5,399,410 | A | 3/1995 | Urase et al. |
| 5,645,935 | A | 7/1997 | Kemper et al. |
| 5,832,540 | A | 11/1998 | Knight |
| D405,587 | S | 2/1999 | Merikoski |
| 5,930,918 | A | 8/1999 | Healy et al. |
| 5,990,378 | A | 11/1999 | Ellis |
| 6,003,247 | A | 12/1999 | Steffe |
| 6,004,891 | A | 12/1999 | Tuppin et al. |
| 6,009,637 | A | 1/2000 | Pavone |
| 6,029,376 | A | 2/2000 | Cass |
| 6,038,702 | A | 3/2000 | Knerr |
| 6,128,835 | A | 10/2000 | Ritter et al. |
| 6,151,804 | A | 11/2000 | Hieblinger |
| 6,164,228 | A | 12/2000 | Lin et al. |
| 6,170,175 | B1 | 1/2001 | Funk |
| 6,213,634 | B1 | 4/2001 | Harrington et al. |
| 6,505,424 | B2 | 1/2003 | Oorei et al. |
| 6,615,427 | B1 | 9/2003 | Hailey |
| 6,665,958 | B2 | 12/2003 | Goodwin |
| 6,701,644 | B2 | 3/2004 | Oorei et al. |
| 6,718,895 | B1 | 4/2004 | Fortuna |
| 6,860,214 | B1 | 3/2005 | Wang |
| 6,910,288 | B2 | 6/2005 | Dua |
| 7,086,179 | B2 | 8/2006 | Dojan et al. |
| 7,086,180 | B2 | 8/2006 | Dojan et al. |
| 7,100,310 | B2 | 9/2006 | Foxen et al. |
| 7,293,371 | B2 | 11/2007 | Aveni |
| 7,337,560 | B2 | 3/2008 | Marvin et al. |
| 7,546,698 | B2 | 6/2009 | Meschter |
| 7,574,818 | B2 | 8/2009 | Meschter |
| 7,665,230 | B2 | 2/2010 | Dojan et al. |
| 7,676,956 | B2 | 3/2010 | Dojan et al. |
| 7,770,307 | B2 | 8/2010 | Meschter |
| 7,814,852 | B2 | 10/2010 | Meschter et al. |
| 7,849,518 | B2 | 12/2010 | Moore et al. |
| 7,870,681 | B2 | 1/2011 | Meschter |
| 7,870,682 | B2 | 1/2011 | Meschter et al. |
| 8,122,616 | B2 | 2/2012 | Meschter et al. |
| 8,132,340 | B2 | 3/2012 | Meschter |
| 8,312,645 | B2 | 11/2012 | Dojan et al. |
| 8,464,441 | B2 | 6/2013 | Meschter et al. |
| 8,631,589 | B2 | 1/2014 | Dojan |
| 8,819,963 | B2 * | 9/2014 | Dojan ..... A43B 23/0265 36/45 |
| 2001/0051484 | A1 | 12/2001 | Ishida et al. |
| 2002/0148142 | A1 | 10/2002 | Oorei et al. |
| 2003/0178738 | A1 | 9/2003 | Staub et al. |
| 2004/0074589 | A1 | 4/2004 | Gessler et al. |
| 2004/0118018 | A1 | 6/2004 | Dua |
| 2004/0142631 | A1 | 7/2004 | Luk |
| 2004/0181972 | A1 | 9/2004 | Csorba |
| 2004/0261295 | A1 | 12/2004 | Meschter |
| 2005/0028403 | A1 | 2/2005 | Swigart et al. |
| 2005/0115284 | A1 | 6/2005 | Dua |
| 2005/0132609 | A1 | 6/2005 | Dojan et al. |
| 2005/0268497 | A1 | 12/2005 | Alfaro et al. |
| 2006/0048413 | A1 | 3/2006 | Sokolowski et al. |
| 2006/0137221 | A1 | 6/2006 | Dojan et al. |
| 2007/0199210 | A1 | 8/2007 | Vattes et al. |
| 2007/0271821 | A1 | 11/2007 | Meschter |
| 2007/0271822 | A1 | 11/2007 | Meschter |
| 2007/0271823 | A1 | 11/2007 | Meschter |
| 2008/0022554 | A1 | 1/2008 | Meschter et al. |
| 2008/0110048 | A1 | 5/2008 | Dua et al. |
| 2008/0110049 | A1 | 5/2008 | Sokolowski et al. |
| 2009/0071041 | A1 | 3/2009 | Hooper |
| 2009/0133287 | A1 | 5/2009 | Meschter |
| 2010/0018075 | A1 | 1/2010 | Meschter et al. |
| 2010/0037483 | A1 | 2/2010 | Meschter et al. |
| 2010/0043253 | A1 | 2/2010 | Dojan et al. |
| 2010/0154256 | A1 | 6/2010 | Dua |
| 2010/0175276 | A1 | 7/2010 | Dojan et al. |
| 2010/0251491 | A1 | 10/2010 | Dojan et al. |
| 2010/0251564 | A1 | 10/2010 | Meschter |
| 2010/0263236 | A1 | 10/2010 | Carboy et al. |
| 2011/0041359 | A1 | 2/2011 | Dojan et al. |
| 2011/0192058 | A1 | 8/2011 | Beers et al. |
| 2011/0192059 | A1 | 8/2011 | Spanks et al. |
| 2012/0023778 | A1 | 2/2012 | Dojan et al. |
| 2012/0233882 | A1 | 9/2012 | Huffa et al. |
| 2013/0219750 | A1 | 8/2013 | Dojan et al. |

FOREIGN PATENT DOCUMENTS

| | | | |
|---|---|---|---|
| EP | 0082824 | A2 | 6/1983 |
| EP | 0818289 | A2 | 1/1998 |
| FR | 1462349 | A | 2/1967 |
| FR | 2046671 | A5 | 3/1971 |
| FR | 2457651 | A1 | 12/1980 |
| WO | 9843506 | A1 | 10/1998 |
| WO | 03013301 | A1 | 2/2003 |
| WO | 2004089609 | A1 | 10/2004 |
| WO | 2007139567 | A1 | 12/2007 |
| WO | 2007140055 | A2 | 12/2007 |

OTHER PUBLICATIONS

International Search Report and Written Opinion for Application No. PCT/US2013/026971, mailed Jul. 22, 2013.

International Search Report and Written Opinion for Application No. PCT/US2013/026972, mailed Jul. 22, 2013.

Chinese Office Action dated Feb. 19, 2016 in Chinese Patent Application No. 201380021701.7.

Detailed Observations for Chinese Utility Model Patent Application No. 2013800217017, mailed Jul. 5, 2016, 8 pages. (with English Translation).

Notice of Grant for European Application No. EP15000354.9, mailed on Jul. 20, 2016, 109 pages.

* cited by examiner

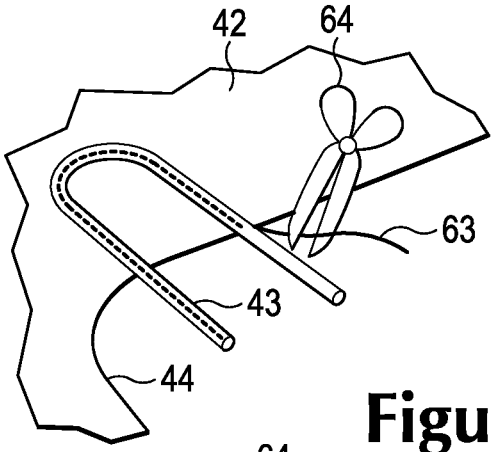
Figure 14F
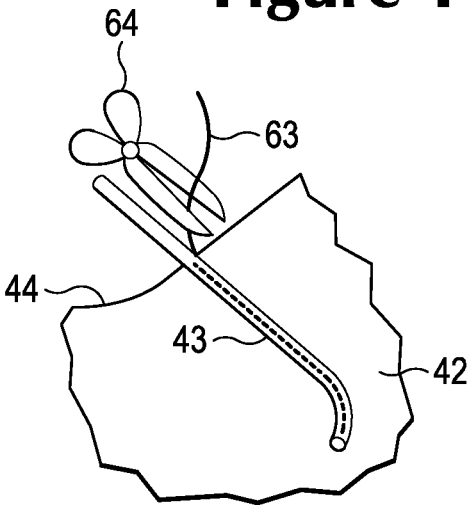

ARTICLES OF FOOTWEAR WITH TENSILE STRAND ELEMENTS

CROSS-REFERENCE TO RELATED APPLICATION

This application is a continuation of co-pending U.S. patent application Ser. No. 13/404,448 filed on Feb. 24, 2012, entitled "Articles Of Footwear With Tensile Strand Elements", published as U.S. Patent Application Publication No. 2013/0219750 on Aug. 29, 2013 and issued as U.S. Pat. No. 8,819,963 on Sep. 2, 2014, the disclosure of which application is hereby incorporated by reference in its entirety.

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. In some configurations, the midsole may be primarily formed from a fluid-filled chamber. The outsole forms a ground-contacting element of the footwear and is usually fashioned from a durable and wear-resistant rubber material that includes texturing to impart traction. The sole structure may also include a sockliner positioned within the void of the upper and proximal a lower surface of the foot to enhance footwear comfort.

SUMMARY

An article of footwear may have an upper and a sole structure secured together. The upper includes at least two material layers and a plurality of strand segments. The material layers are located adjacent to each other and in an overlapping configuration, and the material layers are located in (a) a lace region that includes a plurality of lace-receiving elements and (b) a lower region proximal to an area where the sole structure is secured to the upper. The strand segments extend from the lace region to the lower region. In some configurations, the strand segments are located and secured between the material layers in the lace region and the lower region. In some configurations, the strand segments form both an exterior surface of the upper and an opposite interior surface of the upper in an area between the lace region and the lower region. In some configurations, the material layers define an opening between the lace region and the lower region, and the strand segments extend across the opening. Various example methods for manufacturing a tensile strand element of the upper are also disclosed.

In another configuration, an upper for an article of footwear includes a plurality of material elements and strand segments. The material elements are joined together to define a lace region and a lower region. The material elements include a base material layer located in at least the lace region The base material layer has a first surface and an opposite second surface, and the base material layer defines an aperture of a lace-receiving element that extends from the first surface to the second surface in the lace region. The lower region is spaced from the lace region and located proximal to an area where the sole structure is secured to the upper. The strand segments extend from the lace region to the lower region and include a first strand segment and a second strand segment. The first strand segment is located adjacent to the first surface of the base material layer and extends at least partially around the aperture. The second strand segment is located adjacent to the second surface of the base material layer and extends at least partially around the aperture.

A method of manufacturing an article of footwear includes locating a strand adjacent to a surface of a base material layer, with the strand extending from a first area of the base material layer to a second area of the base material layer. The strand is secured to the base material layer. The strand and the base material layer are incorporated into a footwear upper, with the first area being located in a lace region of the upper and the second area being located in a lower region of the upper. The lower region is spaced from the lace region and located proximal to an area for securing a sole structure to the upper.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

BRIEF DESCRIPTION OF THE DRAWINGS

The foregoing Summary and the following Detailed Description will be better understood when read in conjunction with the accompanying figures.

FIGS. 14A-14J are schematic perspective views depicting a first example process for manufacturing a tensile strand element.

DETAILED DESCRIPTION

The following discussion and accompanying figures disclose various articles of footwear having uppers that include tensile strand elements. The articles of footwear are disclosed, for purposes of example, as having configurations of running shoes, sprinting shoes, and basketball shoes. Concepts associated with the articles of footwear, including the uppers, may also be applied to a variety of other athletic footwear types, including baseball shoes, cross-training shoes, cycling shoes, football shoes, tennis shoes, golf shoes, soccer shoes, walking shoes, hiking boots, ski and snowboard boots, and ice and roller skates, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

Figure 1:
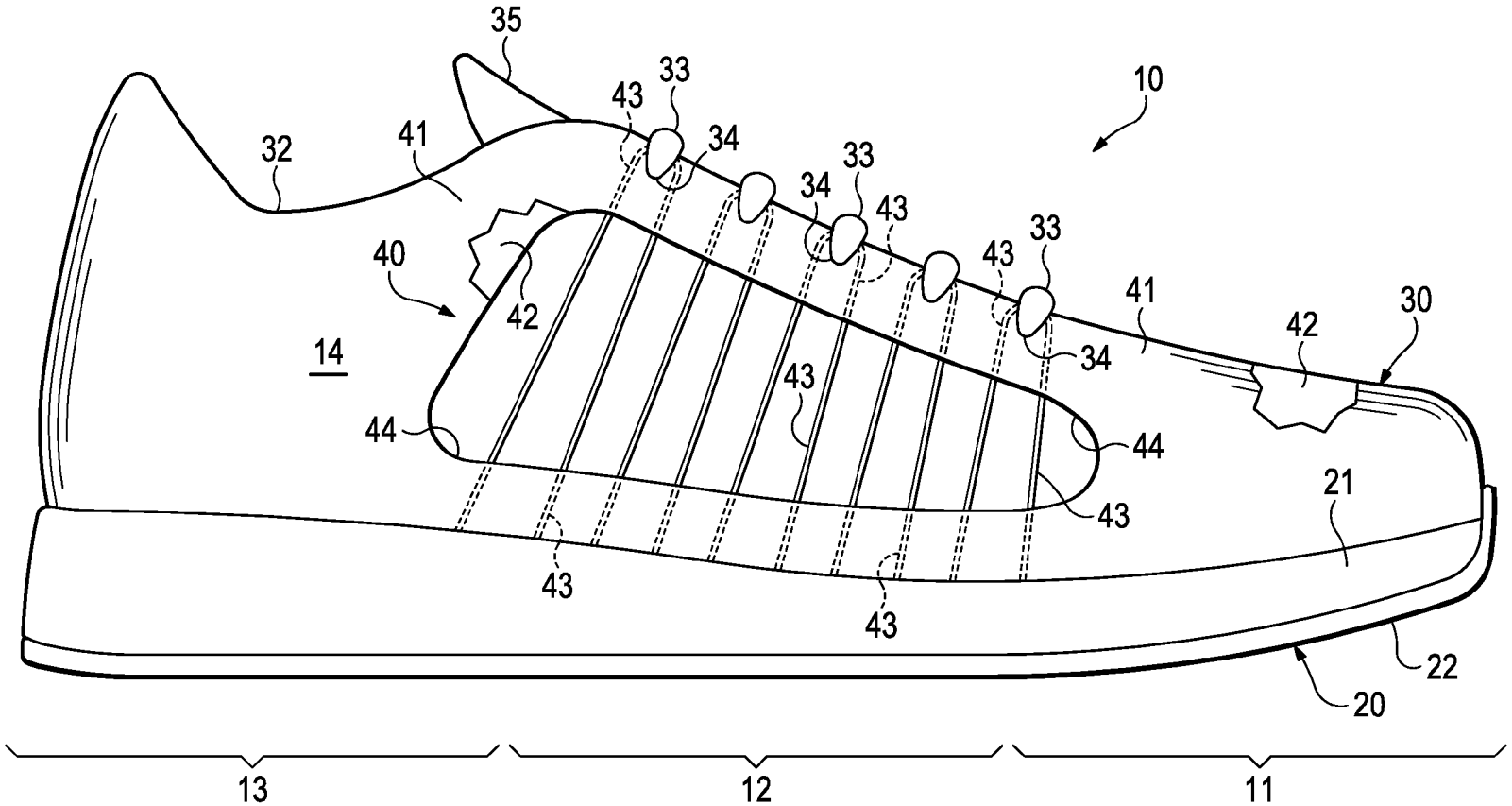
FIG. 1 is lateral side elevational view of an article of footwear.
Figure 2:
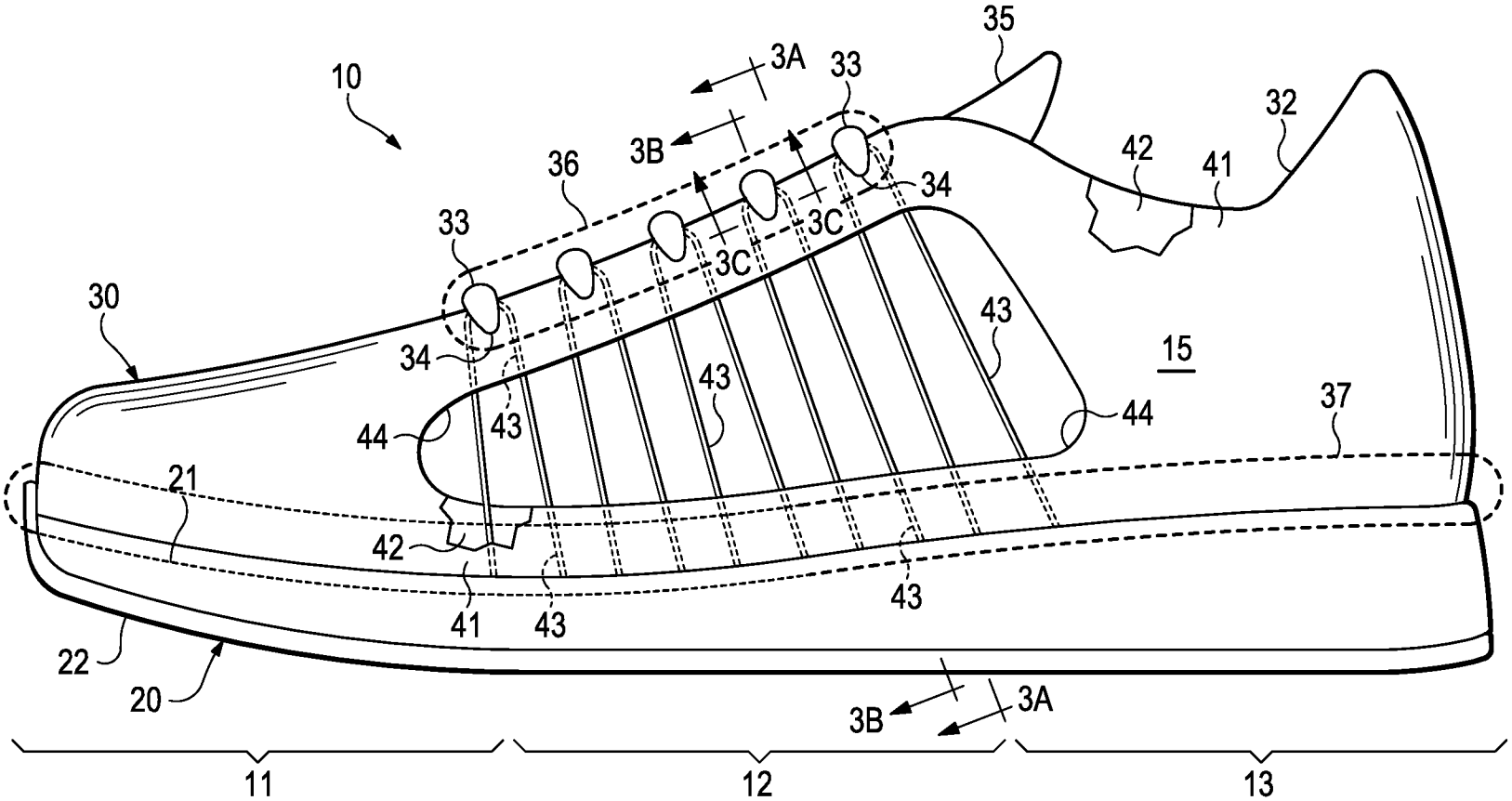
FIG. 2 is a medial side elevational view of the article of footwear.

An article of footwear 10 is depicted in FIGS. 1 and 2 as including a sole structure 20 and an upper 30. Sole structure 20 is secured to a lower area of upper 30 and extends between upper 30 and the ground. Upper 30 provides a comfortable and secure covering for a foot of a wearer. As such, the foot may be located within upper 30, which effectively secures the foot within footwear 10, and sole structure 20 extends under the foot to attenuate forces, enhance stability, or influence the motions of the foot, for example. Additional details of footwear 10 are depicted in the cross-sectional views of FIGS. 3A-3C.

For purposes of reference in the following discussion, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Figure 3A:
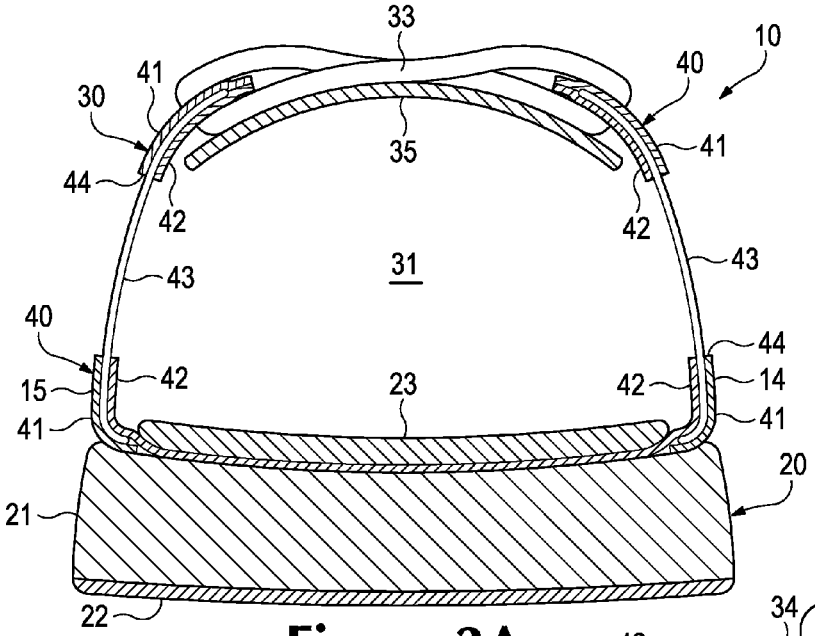
FIGS. 3A-3C are cross-sectional views of the article of footwear, as defined by section lines 3A-3C in FIG. 2.
Figure 3C:
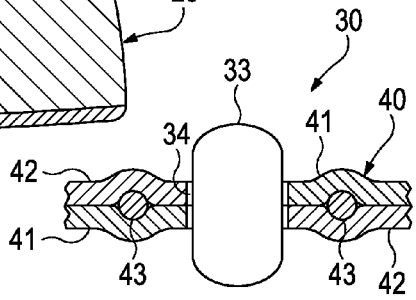
Figure 3B:
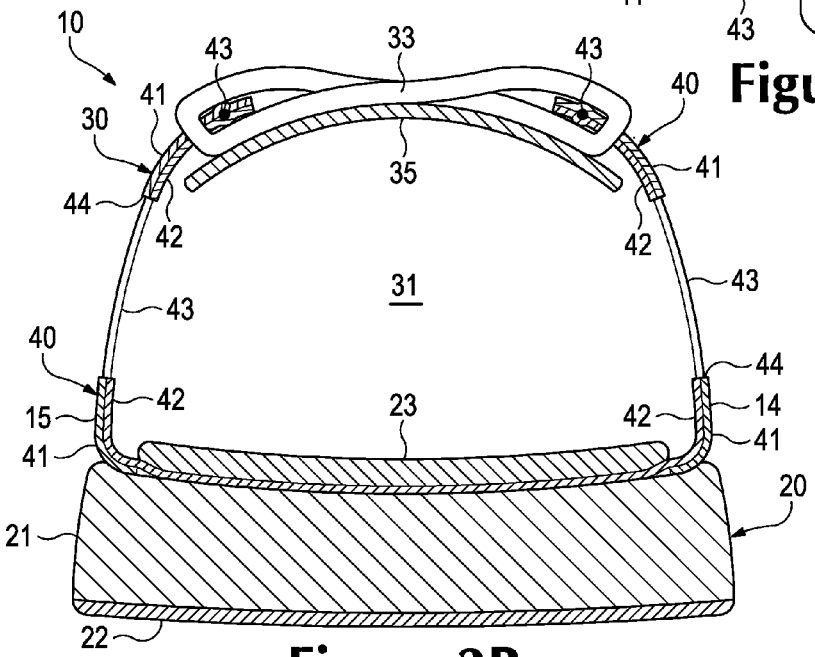

Sole structure 20 includes a midsole 21, an outsole 22, and a sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30, as depicted in FIGS. 3A and 3B, and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30 may be formed from a variety of elements that are stitched, bonded, or otherwise joined together to form a structure for receiving and securing the foot relative to sole structure 20. As such, upper 30 extends along the lateral side of the foot, along the medial side of the foot, over the foot, around a heel of the foot, and under the foot. Moreover, upper 30 defines a void 31, which is a generally hollow area of footwear 10, that has a general shape of the foot and is intended to receive the foot. Access to void 31 is provided by an ankle opening 32 located in at least heel region 13. A lace 33 extends through various lace apertures 34 and permits the wearer to modify dimensions of upper 30 to accommodate the proportions of the foot. More particularly, lace 33 permits the wearer to tighten upper 30 around the foot, and lace 33 permits the wearer to loosen upper 30 to facilitate entry and removal of the foot from void 31 (i.e., through ankle opening 32). As an alternative to lace apertures 34, upper 30 may include other lace-receiving elements, such as loops, eyelets, hooks, and D-rings. In addition, upper 30 includes a tongue 35 that extends between void 31 and lace 33 to enhance the comfort and adjustability of footwear 10. In some configurations, upper 30 may also incorporate other elements, such as reinforcing members, aesthetic features, a heel counter that limits heel movement in heel region 13, a wear-resistant toe guard located in forefoot region 11, or indicia (e.g., a trademark) identifying the manufacturer. Accordingly, upper 30 is formed from a variety of elements that form a structure for receiving and securing the foot.

For purposes of reference in the following discussion, upper 30 also includes a lace region 36 and a lower region 37, as shown for example in FIG. 2. Lace region 36 is proximal to and includes an area where lace apertures 34 or other lace-receiving elements are located. In general, lace region 36 may correspond with a throat area of footwear 10, which includes one or more of lace 33, lace apertures 34, and tongue 35. Lower region 37 is proximal to and includes an area where sole structure 20 is secured to upper 30. Regions 36 and 37 are not intended to demarcate precise areas of footwear 30. Rather, regions 36 and 37 are intended to represent general areas to aid in the following discussion.

Tensile Strand Element

Figure 4:
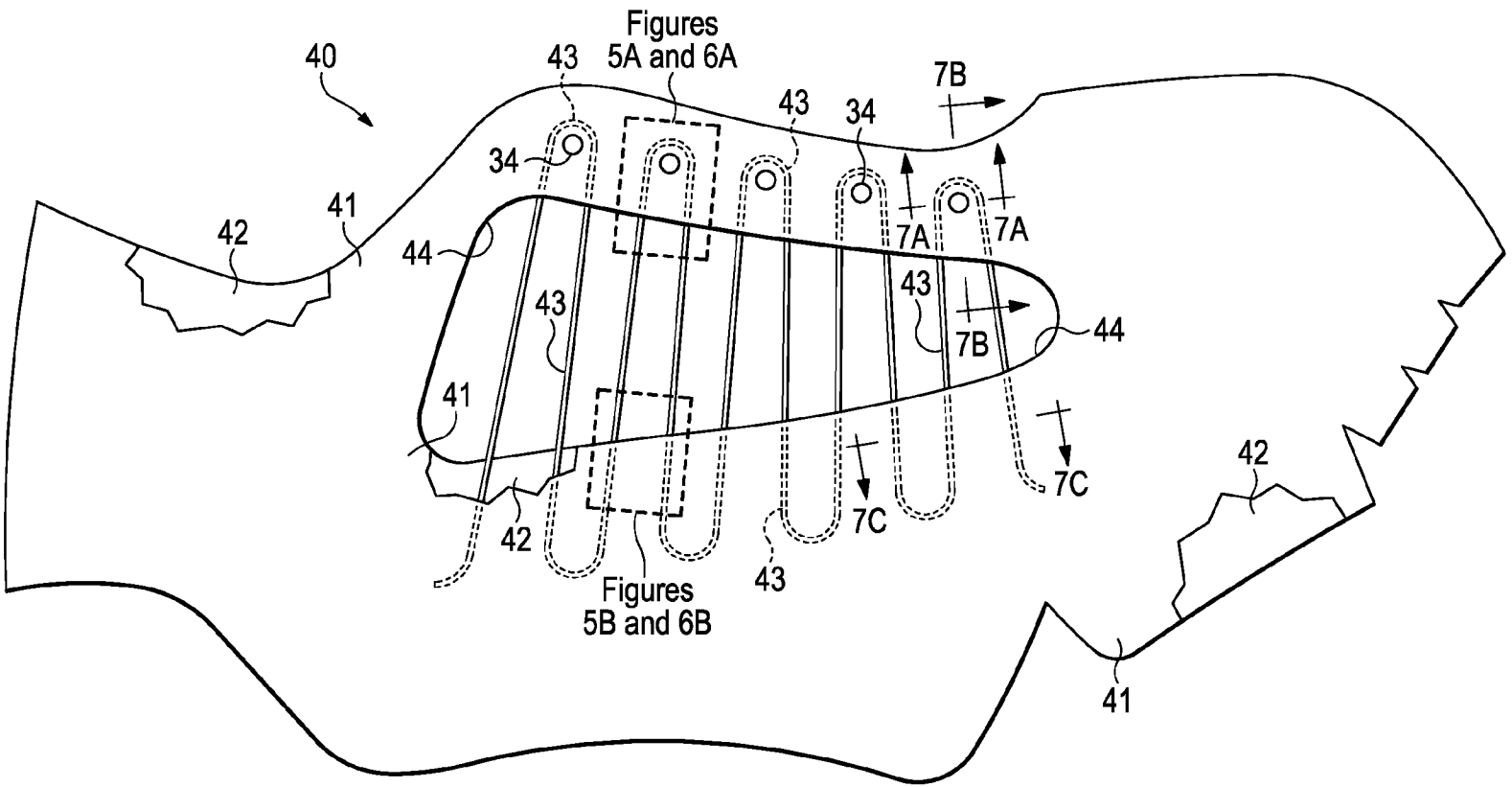
FIG. 4 is a plan view of a tensile strand element from the article of footwear.

Although a variety of material elements or other components may be incorporated into upper 30, areas of one or both of lateral side 14 and medial side 15 incorporate a tensile strand element 40 that includes an exterior material layer 41, an interior material layer 42, and a strand 43. An example of one tensile strand element 40 is depicted in FIG. 4 and has a configuration suitable for extending through each of regions 11-13 on lateral side 14. A similar or identical tensile strand element may also extend through medial side 15. In further configurations, a single tensile strand element 40 may extend through each of sides 14 and 15, or tensile strand element 40 may only extend through a relatively small area of lateral side 14. Accordingly, the shape and size of tensile strand 40, as well as the area of upper 30 in which tensile strand element 40 is located, may vary considerably. Additional details of tensile strand element 40 are depicted in FIGS. 5A-7C.

Material layers 41 and 42 are located adjacent to each other and are generally coextensive with or otherwise overlap each other. Although material layers 41 and 42 are often stitched, bonded, adhered, or otherwise secured to each other, material layers 41 and 42 may also be unsecured. With reference to FIGS. 3A and 3B, for example, exterior material layer 41 is located outward from interior material layer 42. In this position, exterior material layer 41 forms a portion of an exterior surface of upper 30, and interior material layer 42 forms a portion of an interior surface of upper 30, thereby defining a portion of void 31. In other configurations, additional material layers or elements may be secured to one or both of material layers 41 and 42. For example, a durable and wear-resistant material layer may be secured to exterior material layer 41 to form the exterior surface of upper 30. Trademarks, aesthetic elements, or other indicia may also be secured to exterior material layer 41. As another example, which is discussed in greater detail below, a polymer foam layer may be secured to interior material layer 42 to enhance the comfort of footwear 10, and a textile layer may be secured to the polymer foam layer to form a portion of the interior surface of upper 30, enhance comfort, and wick moisture (e.g., from perspiration) away from the foot.

Strand 43 repeatedly extends between lace region 36 and lower region 37. More particularly, segments of strand 43 (i.e., strand segments) extend from lace region 36 to lower region 37 and are located and secured between material layers 41 and 42 in each of regions 36 and 37. Although portions of strand 43 are located between material layers 41 and 42, other portions of strand 43 extend across an opening 44 that is formed through each of material layers 41 and 42 and positioned between regions 36 and 37. The segments of strand 43 are unsecured, therefore, in the area between regions 36 and 37, and the segments of strand 43 form both the exterior surface of upper 30 and the opposite interior surface of upper 30 in the area between regions 36 and 37. In this regard, the foot or a sock worn over the foot may contact portions of strand 43 extending across opening 44.

During activities that involve walking, running, or other ambulatory movements (e.g., cutting, braking), a foot within void 31 may tend to stretch upper 30. That is, many of the material elements forming upper 30 (e.g., material layers 41 and 42) may stretch when placed in tension by movements of the foot. Although strand 43 or individual segments of strand 43 may also stretch, strand 43 generally stretches to a lesser degree than the other material elements forming upper 30. The various segments of strand 43 may be located, therefore, to form structural components in upper 30 that (a) resist stretching in specific directions or locations, (b) limit excess movement of the foot relative to sole structure 20 and upper 30, (c) ensure that the foot remains properly positioned relative to sole structure 20 and upper 30, and (d) reinforce locations where forces are concentrated.

Figure 5A:
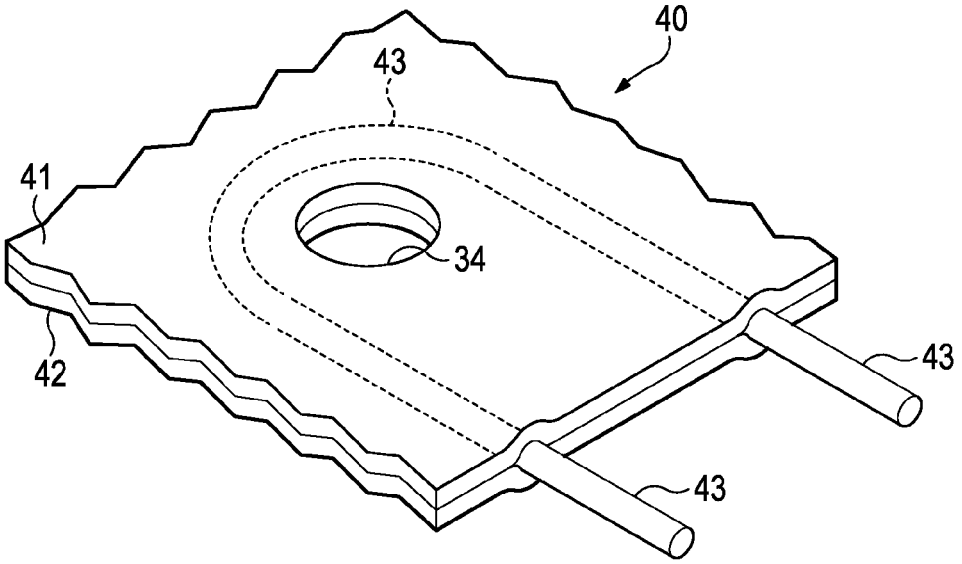
FIGS. 5A and 5B are perspective views of portions of the tensile strand element, as defined in FIG. 4.
Figure 5B:
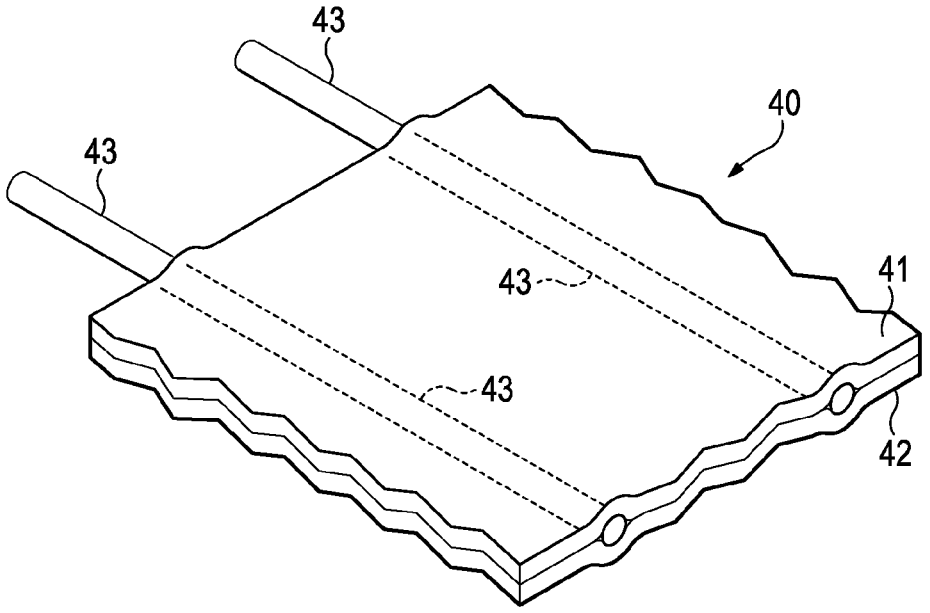
Figure 6A:
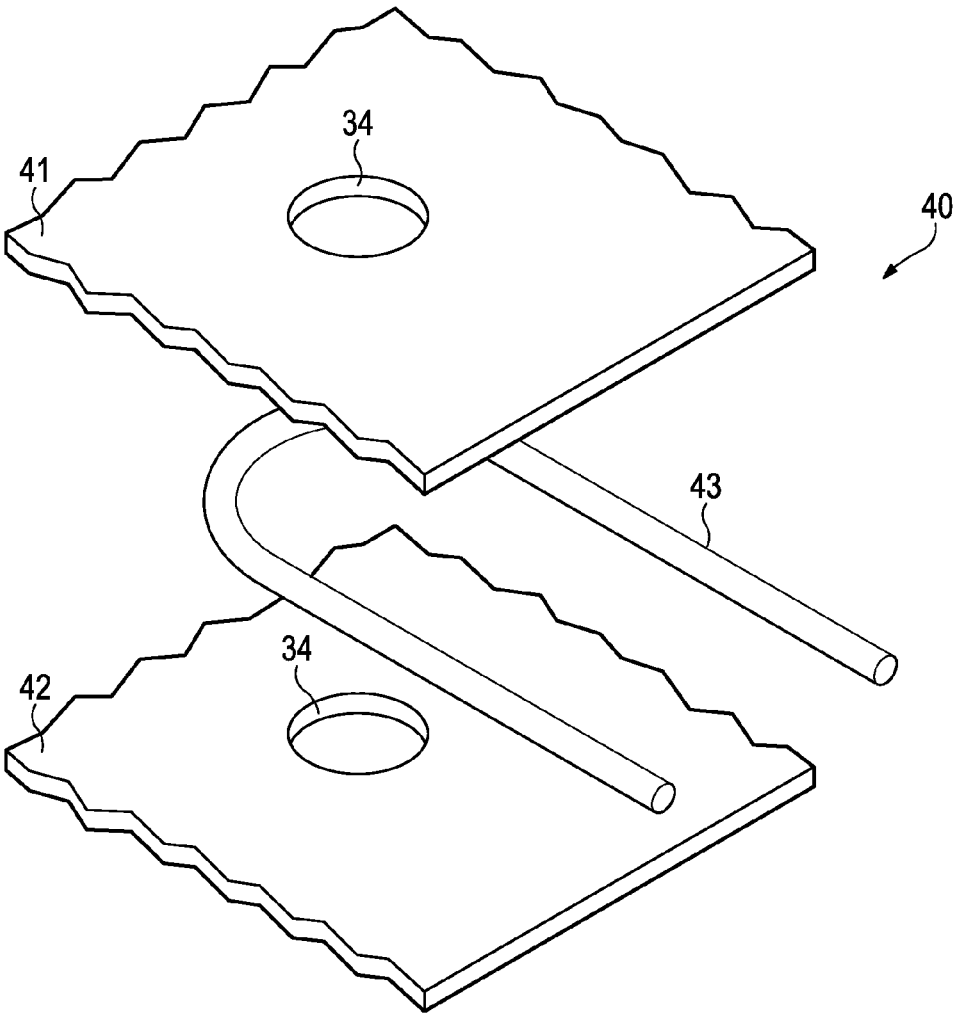
FIGS. 6A and 6B are exploded perspective views of the portions of the tensile strand element, as defined in FIG. 4
Figure 6B:
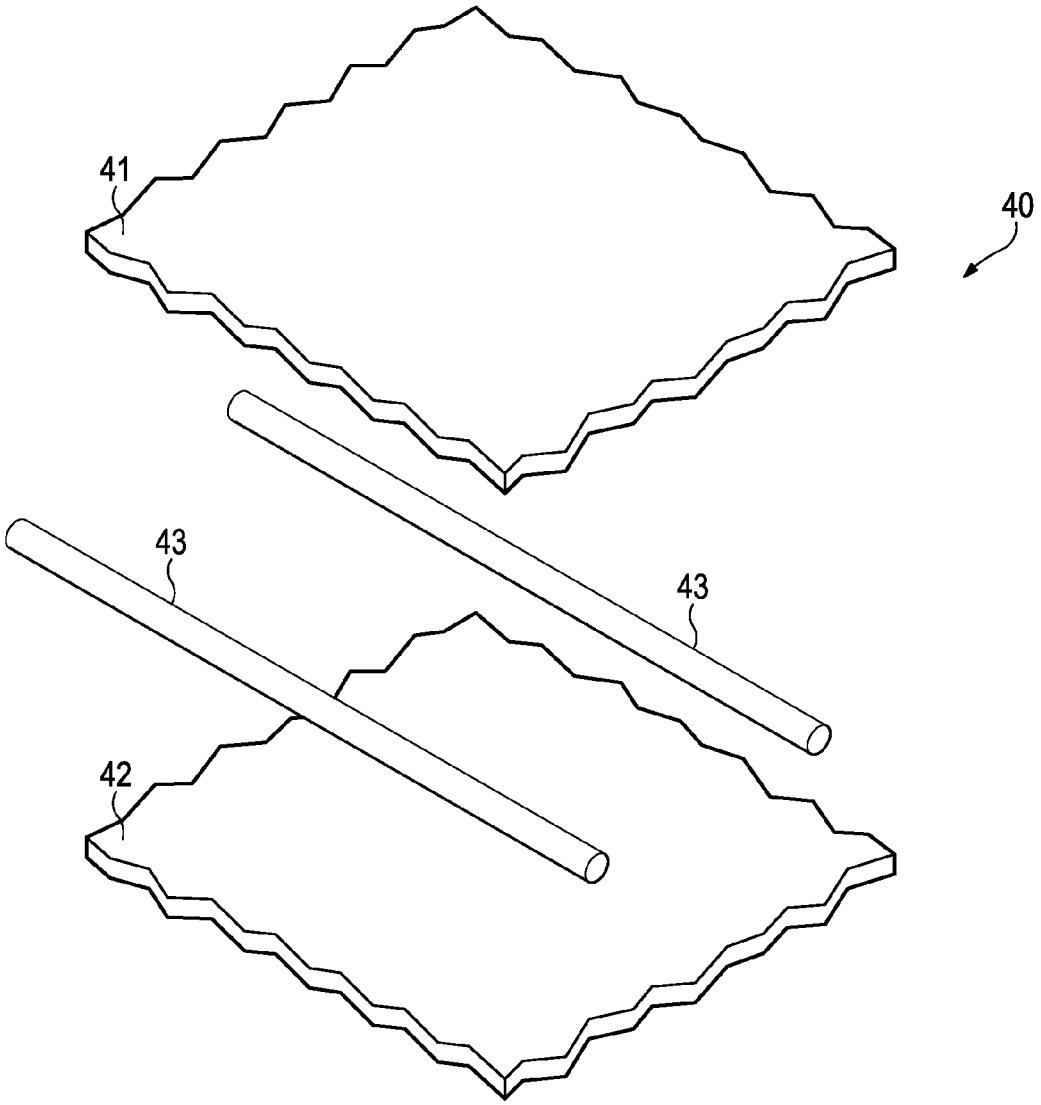
Figure 7A:
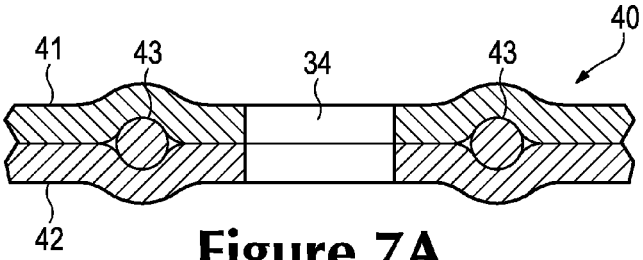
FIGS. 7A-7C are cross-sectional views of the tensile strand element, as defined by section lines 7A-7C in FIG. 4.
Figure 7B:
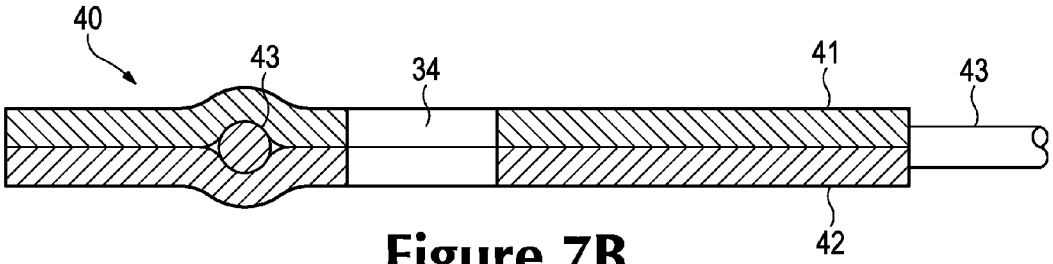
Figure 7C:
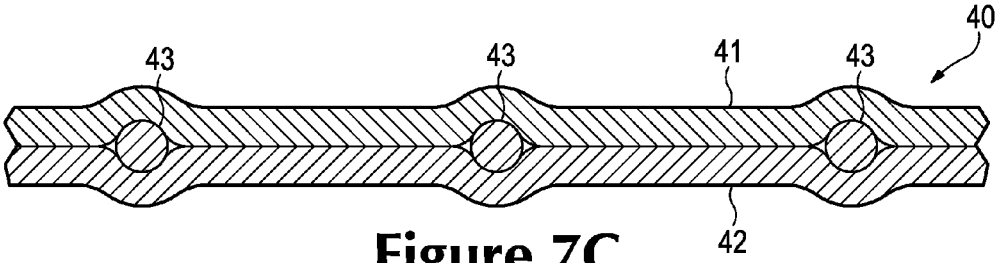

In addition to extending between regions 36 and 37, the segments of strand 43 also extend at least partially around each of lace apertures 34. As such, a segment of strand 43 extends (a) upward from lower region 37 to lace region 36, (b) around one of lace apertures 33, and (c) downward from lace region 36 to lower region 37 in a repeating pattern. In this manner, strand 43 effectively extends around each of lace apertures 34. Moreover, segments of strand 43 form loops around portions of lace 33, as generally depicted in FIGS. 1 and 2, as well as the cross-sections of FIGS. 3A-3C. Moreover, the configuration of material layers 41 and 42 and strand 43 in the area of one of lace apertures 34 is depicted in FIGS. 5A and 6A. When lace 33 is tightened, tension in lace 33 effectively places strand 43 in tension, which has the advantage of tightening upper 30 around the foot and further (a) limiting excess movement of the foot relative to sole structure 20 and upper 30 and (b) ensuring that the foot remains properly positioned relative to sole structure 20 and upper 30.

Opening 44 is positioned between lace region 36 and lower region 37 and is an area of tensile strand element 40 where material layers 41 and 42 are absent. As such, opening 44 may be an aperture formed through each of material layers 41 and 42, thereby extending from the exterior surface of upper 30 to void 31. In addition, opening 44 is located in an inner area of tensile strand element 40 and is spaced inward from edges of material layers 41 and 42. In other configurations, which are discussed below, opening 44 may extend to the edges of material layers 41 and 42. Although an area of opening 44 may vary considerably, the area is often at least nine square centimeters. In some configurations of footwear 10 intended for wear by an adult, opening 44 may have a larger area of at least sixteen or twenty-five square centimeters. These examples of areas of opening 44 have advantages of (a) removing mass from footwear 10, (b) facilitating breathability in footwear 10, and (c) imparting a unique aesthetic to footwear 10. Given these areas for opening 44, the distance across opening 44 may be at least four centimeters. As such, segments of strand 43 located in opening 44 may be unsecured for the distance of at least four centimeters that extends across opening 44.

Each of material layers 41 and 42 may be formed from any generally two-dimensional material. As utilized with respect to the present invention, the term "two-dimensional material" or variants thereof is intended to encompass generally flat materials exhibiting a length and a width that are substantially greater than a thickness. Accordingly, suitable materials for material layers 41 and 42 include various textiles, polymer sheets, or combinations of textiles and polymer sheets, for example. Material layers 41 and 42 may also be leather, synthetic leather, or polymer foam layers. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven or knitted fabric. The textiles may incorporate fibers that are arranged to impart one-directional stretch or multi-directional stretch, and the textiles may include coatings that form a breathable and water-resistant barrier, for example. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for material layers 41 and 42. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness. In some configurations, mesh materials or perforated materials may be utilized for either or both of material layers 43 and 44 to impart greater breathability or air permeability.

As examples, interior material layer 42 may be formed from a textile material and exterior material layer 41 may be formed from a polymer sheet that is bonded to the textile material, or each of material layers 41 and 42 may be formed from polymer sheets that are bonded to each other. In circumstances where interior material layer 42 is formed from a textile material, exterior material layer 41 may incorporate thermoplastic polymer materials that bond with the textile material of interior material layer 42. That is, by heating exterior material layer 42, the thermoplastic polymer material of exterior material layer 42 may bond with the textile material of interior material layer 41, as well as strand 43. As an alternative, a thermoplastic polymer material may infiltrate or be bonded with the textile material of interior material layer 42 in order to bond with exterior material layer 41 and strand 43. That is, interior material layer 42 may be a combination of a textile material and a thermoplastic polymer material. An advantage of this configuration is that the thermoplastic polymer material may rigidify or otherwise stabilize the textile material of interior material layer 42 during the manufacturing process of tensile strand element 40, including portions of the manufacturing process involving laying and securing strand 43 upon interior material layer 42. Another advantage of this configuration is that another material layer may be bonded to interior material layer 42 opposite exterior material layer 41 using the thermoplastic polymer material in some configurations. This general concept is disclosed in U.S. patent application Ser. No. 12/180,235, which was filed in the U.S. Patent and Trademark Office on 25 Jul. 2008 and entitled Composite Element With A Polymer Connecting Layer, such prior application being entirely incorporated herein by reference.

Strand 43 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for strand 43 includes various filaments, fibers, yarns, threads, cables, cords, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as strand 43, fibers have a relatively short length and generally go through spinning or twisting processes to produce a strand of suitable length. An individual filament utilized in strand 43 may be formed form a single material (i.e., a monocomponent filament) or from multiple materials (i.e., a bicomponent filament). Similarly, different filaments may be formed from different materials. As an example, yarns utilized as strand 43 may include filaments that are each formed from a common material, may include filaments that are each formed from two or more different materials, or may include filaments that are each formed from two or more different materials. Similar concepts also apply to threads, cables, or ropes. The thickness of strand 43 may also vary significantly to range from less than 0.03 millimeters to more than 5 millimeters, for example. Although one-dimensional materials will often have a cross-section where width and thickness are substantially equal (e.g., a round or square cross-section), some one-dimensional materials may have a width that is greater than a thickness (e.g., a rectangular, oval, or otherwise elongate cross-section). Despite the greater width, a material may be considered one-dimensional if a length of the material is substantially greater than a width and a thickness of the material.

Figure 8:
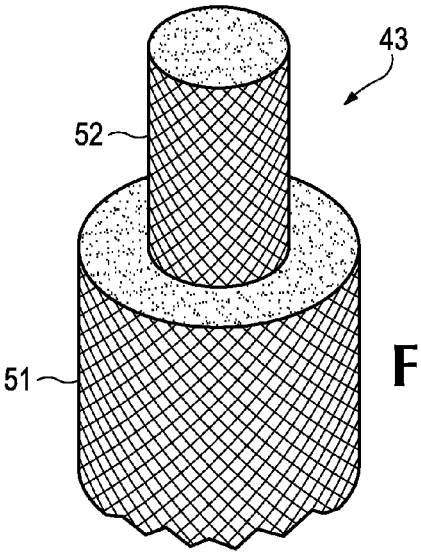
FIG. 8 is a schematic perspective view of a portion of a strand from the tensile strand element.

As an example, strand 43 may be formed from a bonded nylon 6.6 with a breaking or tensile strength of 3.1 kilograms and a weight of 45 tex, or strands 43 may be formed from a bonded nylon 6.6 with a breaking or tensile strength of 6.2 kilograms and a tex of 45. As a further example, strand 43 may have an outer sheath 51 that extends around an inner core 52, as depicted in FIG. 8. Sheath 51 and core 52 extend along a length of strand 43, thereby extending from lace region 36 to lower region 37. Also, each of sheath 51 and core 52 may be formed from a plurality of intertwined (e.g., braided, woven) threads. In another configuration, sheath 51 may be formed from intertwined threads, and core 52 may be bundled threads with or without twist. Advantages of forming strand 43 to include sheath 51 and core 52 are that (a) sheath 51 imparts protection to core 52 and (b) each may have advantageous properties that are combined.

Strand 43 may be a continuous and unbroken filament, fiber, yarn, thread, cable, cord, or rope that extends through both lateral side 14 and medial side 15. As an alternative, two separate sections of strand 43 may extend through lateral side 14 and medial side 15. That is, one section may form strand 43 on lateral side 14 and another section may form strand 43 on medial side 15. In any of these configurations, a section of strand 43 extends repeatedly between regions 36 and 37. In some configurations, however, separate segments of strand 43 may extend between regions 36 and 37. For example, one section of strand 43 may extend from lower region 37 to lace region 36, around lace aperture 34, and back to lower region 37, and a separate section of strand 43 may traverse a similar path to extend around a different lace aperture 34. Accordingly, strand 43 may be a continuous or unbroken element, or strand 43 may be a plurality of separate sections. In some configurations, the separate sections of strand 43 may be formed from different materials to vary the properties of strand 43 in different areas of upper 30.

Based upon the above discussion, footwear 10 is generally formed from upper 20 and sole structure 30, which are secured together. Upper 20 may be formed from a plurality of material elements, such as material layers 41 and 42, and includes both lace region 36 and lower region 37. Whereas lace region 36 includes a plurality of lace-receiving elements, such as lace apertures 34, lower region 37 is proximal to an area where sole structure 20 is secured to upper 30. A plurality of segments of strand 43 extend from lace region 36 to lower region 37. The segments of strand 43 are secured to upper 30 in lace region 36 and lower region 37, and the segments of strand 43 are unsecured for a distance of at least four centimeters in an area between lace region 36 and lower region 37. In some configurations, segments of strand 43 form both the exterior surface of upper 30 and the opposite interior surface of upper 30 in the area between lace region 36 and lower region 37. Additionally, in some configurations, the material layers forming upper 30 define opening 44 between lace region 36 and lower region 37, with the segments of strand 43 extending across opening 44.

Further Configurations

The various features discussed above provide example configurations for footwear 10 and tensile strand element 40. In further configurations, however, numerous features of footwear 10 and tensile strand element 40 may vary to impart a variety of properties or aesthetics to footwear 10. Although various examples of further configurations are discussed below, a variety of other configurations may also fall within the scope of the present discussion. Moreover, although the configurations are discussed and depicted separately, aspects of some configurations may be utilized in combination with aspects of other configurations.

Figure 9A:
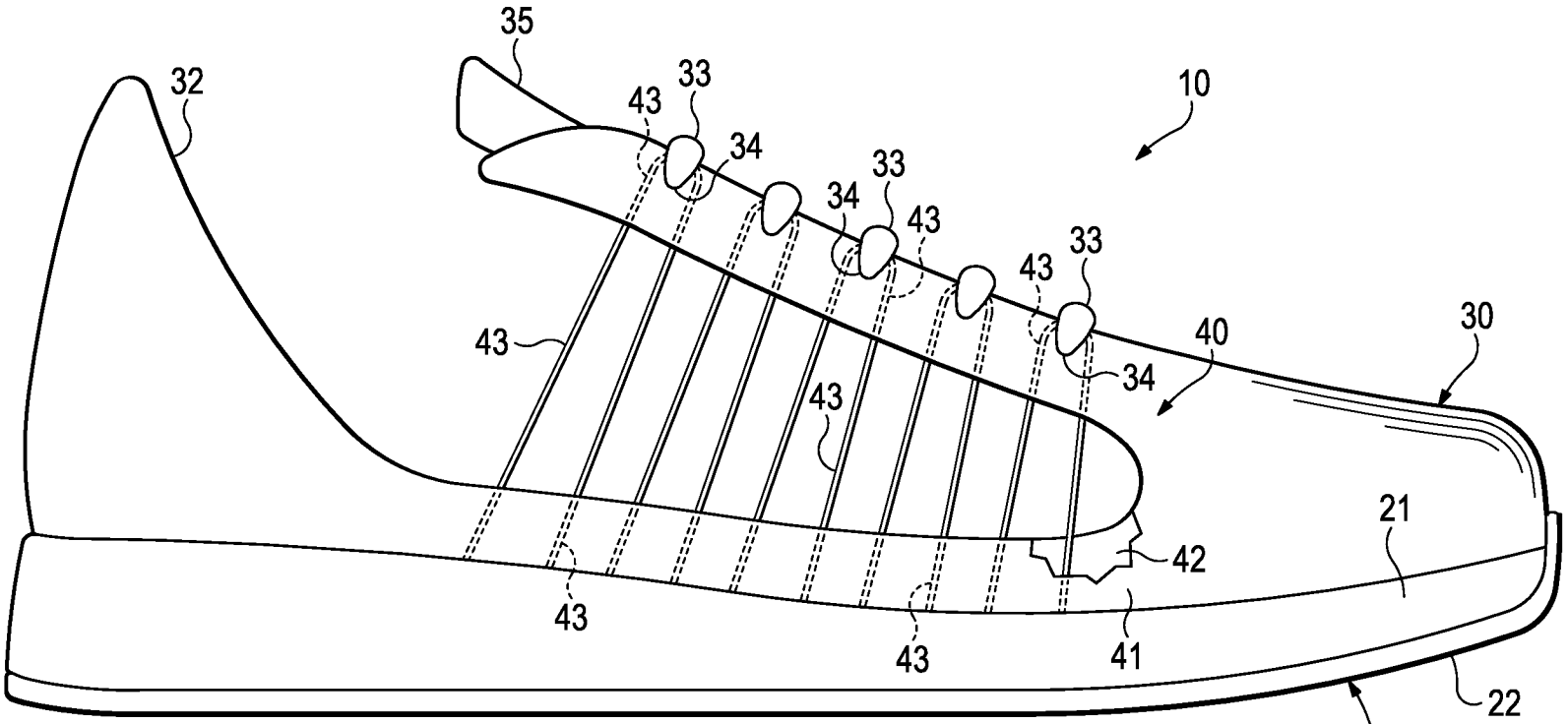
FIGS. 9A-9E are lateral side elevational views depicting further configurations of articles of footwear.
Figure 9B:
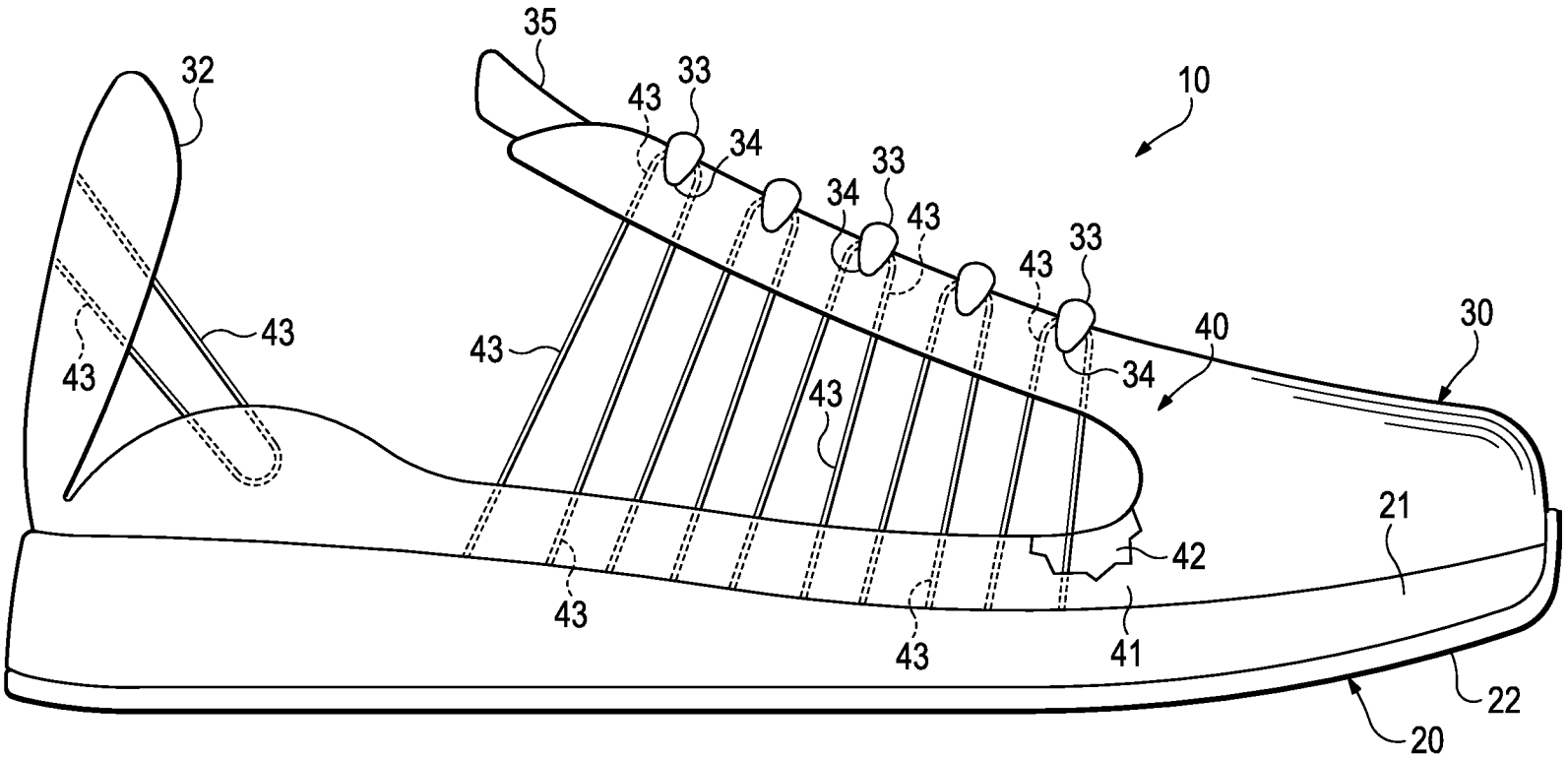

A further configuration of footwear 10 is depicted in FIG. 9A, wherein opening 44 extends from ankle opening 32 in heel region 13 to an area between lace region 36 and lower region 37 in midfoot region 12. Forward areas of opening 44 may also extend into forefoot region 11. Whereas opening 44 is discussed above as being located in an inner area of tensile strand element 40 and is spaced inward from edges of material layers 41 and 42, this configuration of opening 44 extends to the edges of material layers 41 and 42. Advantages of this configuration include (a) removing additional mass from footwear 10, (b) facilitating greater breathability in footwear 10, and (c) imparting a different aesthetic to footwear 10. A similar configuration is depicted in FIG. 9B, wherein another strand 43 extends from a upper area to a lower area of heel region 13 and effectively supports the portion of upper 20 that contacts the heel of the wearer.

Figure 9C:
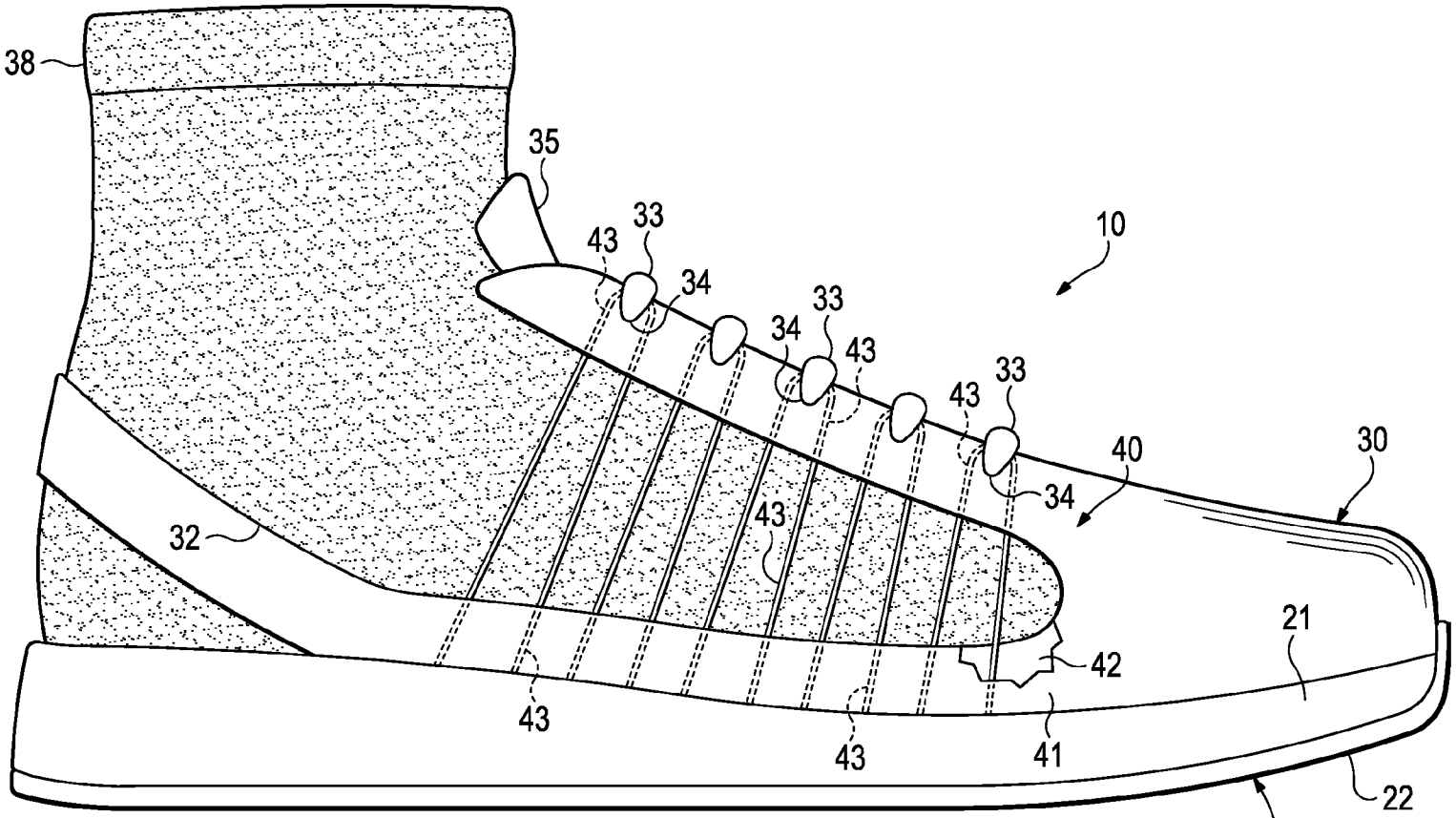

Another configuration of footwear 10 is depicted in FIG. 9C as including a bootie element 38. As discussed above, the various segments of strand 43 form both the exterior surface and the interior surface of upper 20 in the area between lace region 36 and lower region 37, specifically in opening 44. As such, strand 43 may contact the foot or a sock worn over the foot. Bootie element 38, however, is locatable within void 31 and provides a covering for the foot and effectively extends between strand 43 and the foot. The various segments of strand 43 may, therefore, lay against bootie element 38. Although bootie element 38 may be a knitted element with the configuration of a sock, bootie element 38 may incorporate various elements that (a) impart structure or stability to footwear 10, (b) enhance comfort, (c) assist sole structure 20 in attenuating ground reaction forces, or (d) improve water resistance, for example.

Figure 9D:
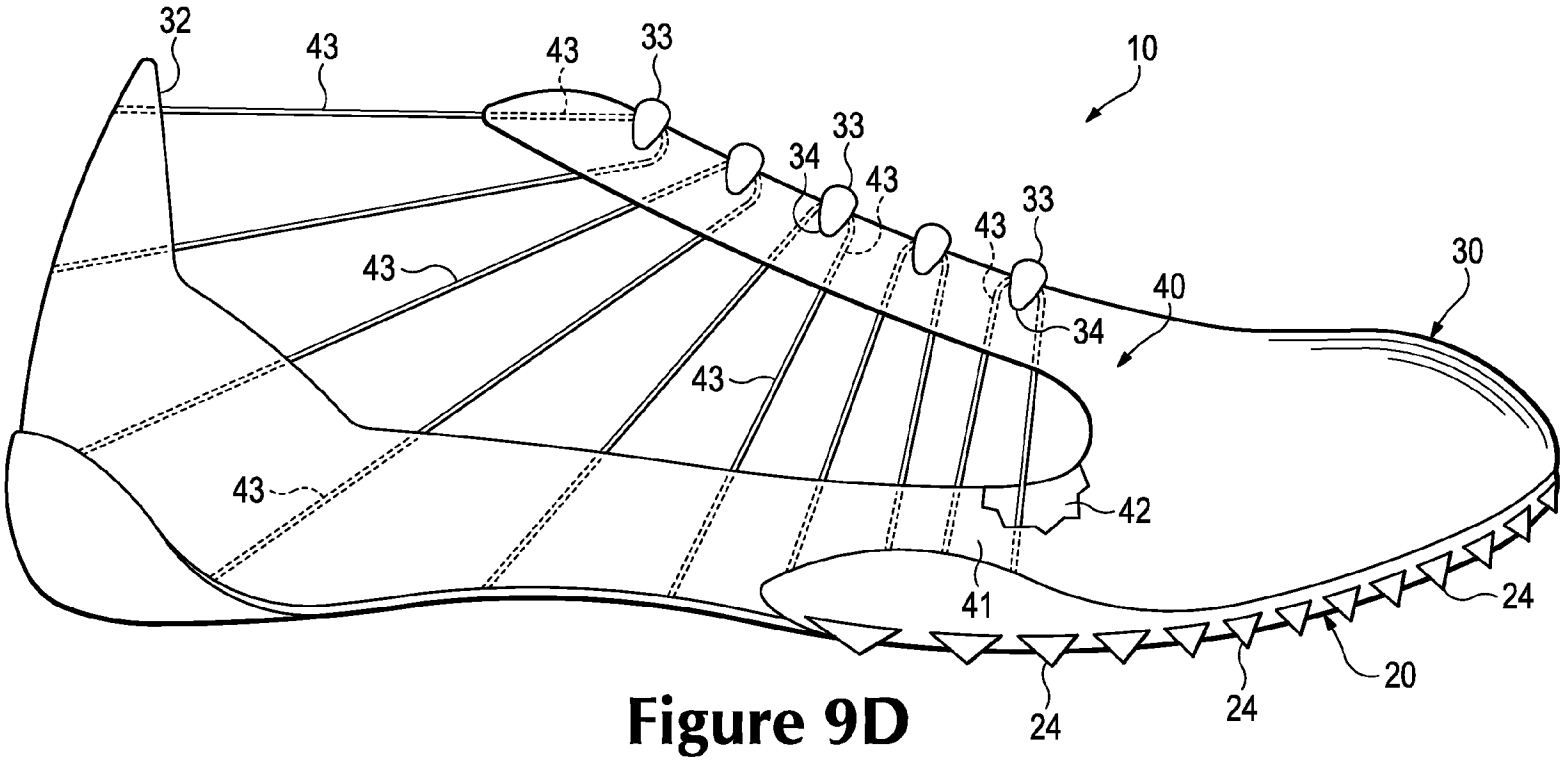

Referring to FIG. 9D, footwear 10 is depicted as having a configuration of a sprinting shoe, which is generally used during sprint-related track and field events. Although sprint shoes may exhibit various configurations, sole structure 20 includes a plurality of spikes 24 that impart traction. With respect to upper 30, opening 44 extends from ankle opening 32 in heel region 13 to an area between lace region 36 and lower region 37 in midfoot region 12. While segments of strand 43 located in forward areas of midfoot region 12 extend in a generally vertical direction, other segments of strand 43 angle rearwardly. As such, the various segments of strand 43 may extend in various directions. Moreover, segments of strand 43 extend in a generally horizontal direction in heel region 13 and join with an upper area of upper 30 in heel region 13. When lace 33 is tensioned and tied, portions of upper 30 in heel region 13 may be tightened to further enhance the fit of footwear 10 and ensure that footwear 10 remains properly positioned on the foot during the sprint-related track and field events.

Figure 9E:
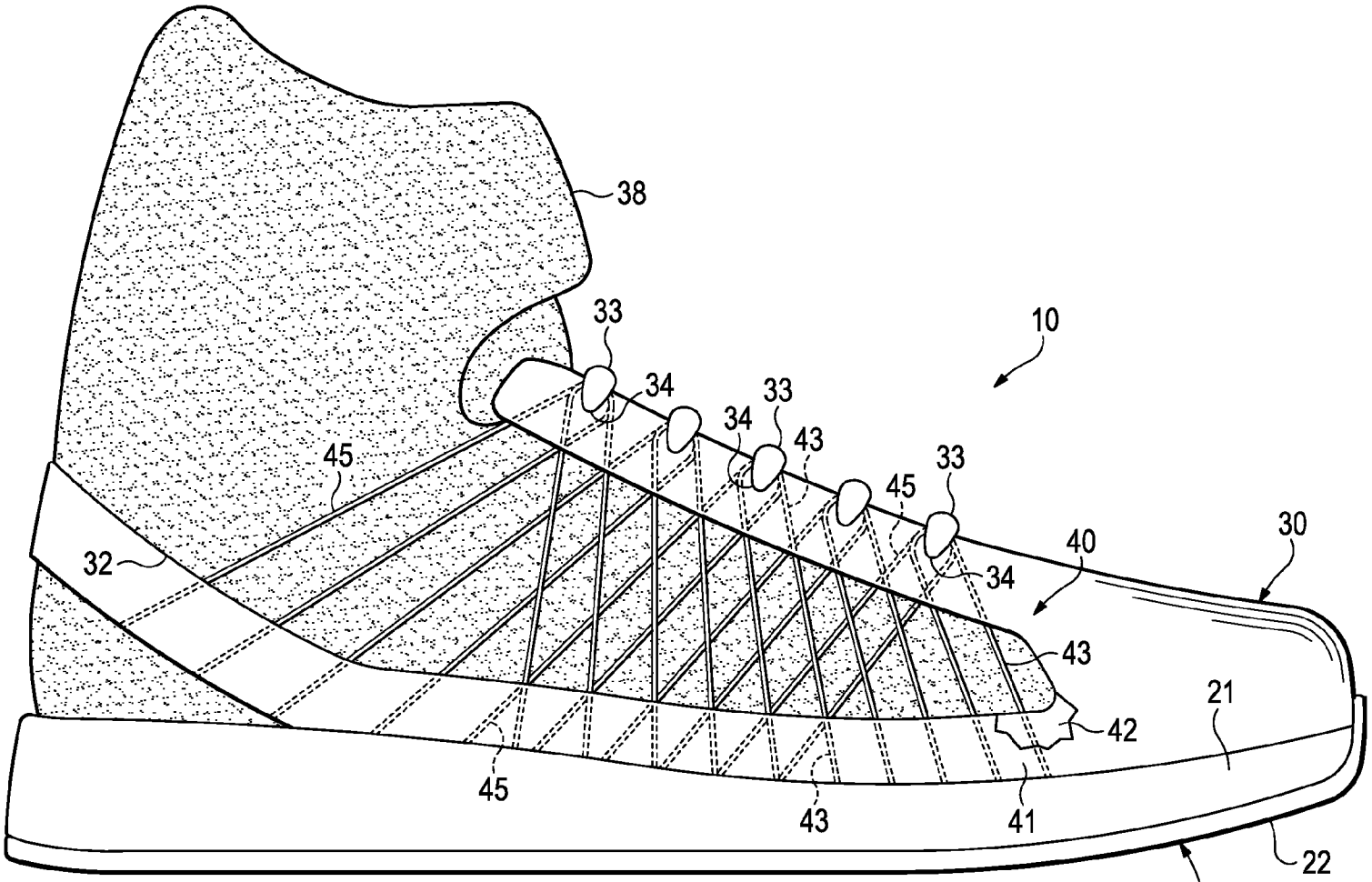

Another configuration of footwear 10 is depicted in FIG. 9E as having a configuration of a basketball shoe. In each of the configurations discussed above, only strand 43 extended around each of lace apertures 34. In this configuration, however, segments of strand 43 and segments of a strand 45 extend around each of lace apertures 34 and across opening 44. Whereas segments of strand 43 are oriented in a generally vertical direction between regions 36 and 37, segments of strand 45 are oriented in a rearwardly-angled direction between regions 36 and 37. This general configuration is disclosed in U.S. Patent Application Publication Number 2012/0023778, which was filed in the U.S. Patent and Trademark Office on 30 Jul. 2010 under U.S. application Ser. No. 12/847,836 and entitled Footwear Incorporating Angled Tensile Strand Elements, such prior application being entirely incorporated herein by reference. Given this orientation, many segments of strand 43 are located in midfoot region 12, but some segments of strand 45 are partially located in midfoot region 12 and extend into heel region 13.

In the configuration of FIG. 9E, segments of strand 43 have a generally vertical orientation between regions 36 and 37. When performing a cutting motion (i.e., side-to-side movement of the wearer), strand 43 resists sideways movement of the foot to ensure that the foot remains properly positioned relative to footwear 10. That is, strand 43 resists stretch in upper 30 that may otherwise allow the foot to roll off of sole structure 20. Segments of strand 45 are oriented in a rearwardly-angled direction in the area between regions 36 and 37. When performing a braking motion (i.e., slowing the forward momentum of the wearer), strand 45 resists stretch in upper 30 that may allow the foot to slide forward or separate from sole structure 20. Strand 45 also resists stretch in upper 30 due to flexing of footwear 10 in the area between forefoot region 11 and midfoot region 12 to ensure that the heel area of the foot remains properly positioned in upper 30 and relative to sole structure 20. Accordingly, strands 43 and 45 cooperatively (a) resist stretch in upper 30 due to cutting motions to ensure that the foot remains properly positioned relative to footwear 10 and (b) resist stretch in upper 30 due to braking motions, as well as jumping and running motions that flex or otherwise bend footwear 10.

Continuing with the discussion of FIG. 9E, segments of strand 43 are oriented in a generally vertical direction, whereas segments of strand 45 are oriented in a rearwardly-angled direction. Although segments of strand 43 may have a vertical orientation, the angle of the segments of strand 43 may also have a substantially vertical orientation between zero and twenty degrees from vertical. As utilized herein, the term "substantially vertical orientation" and similar variants thereof is defined as an orientation wherein segments of strand 43. Although the orientation of the segments of strand 45 may vary, the angle of the segments of strand 45 may be from between twenty to more than seventy degrees from vertical. Additional details relating to the configuration of tensile strand element 40 in FIG. 9E will be discussed below.

Figure 10A:
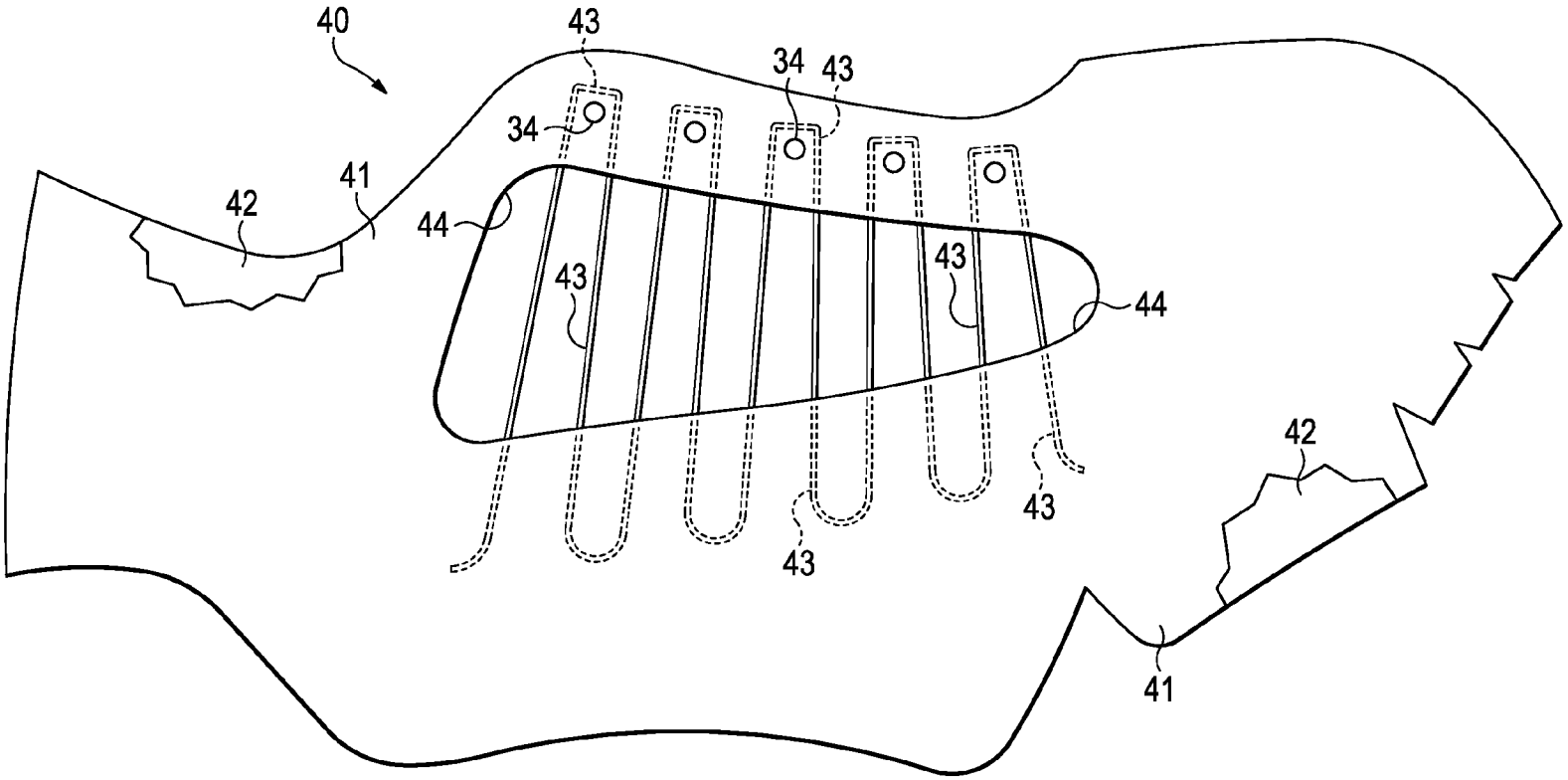
FIGS. 10A-10D are plan views depicting further configurations of tensile strand elements.
Figure 10B:
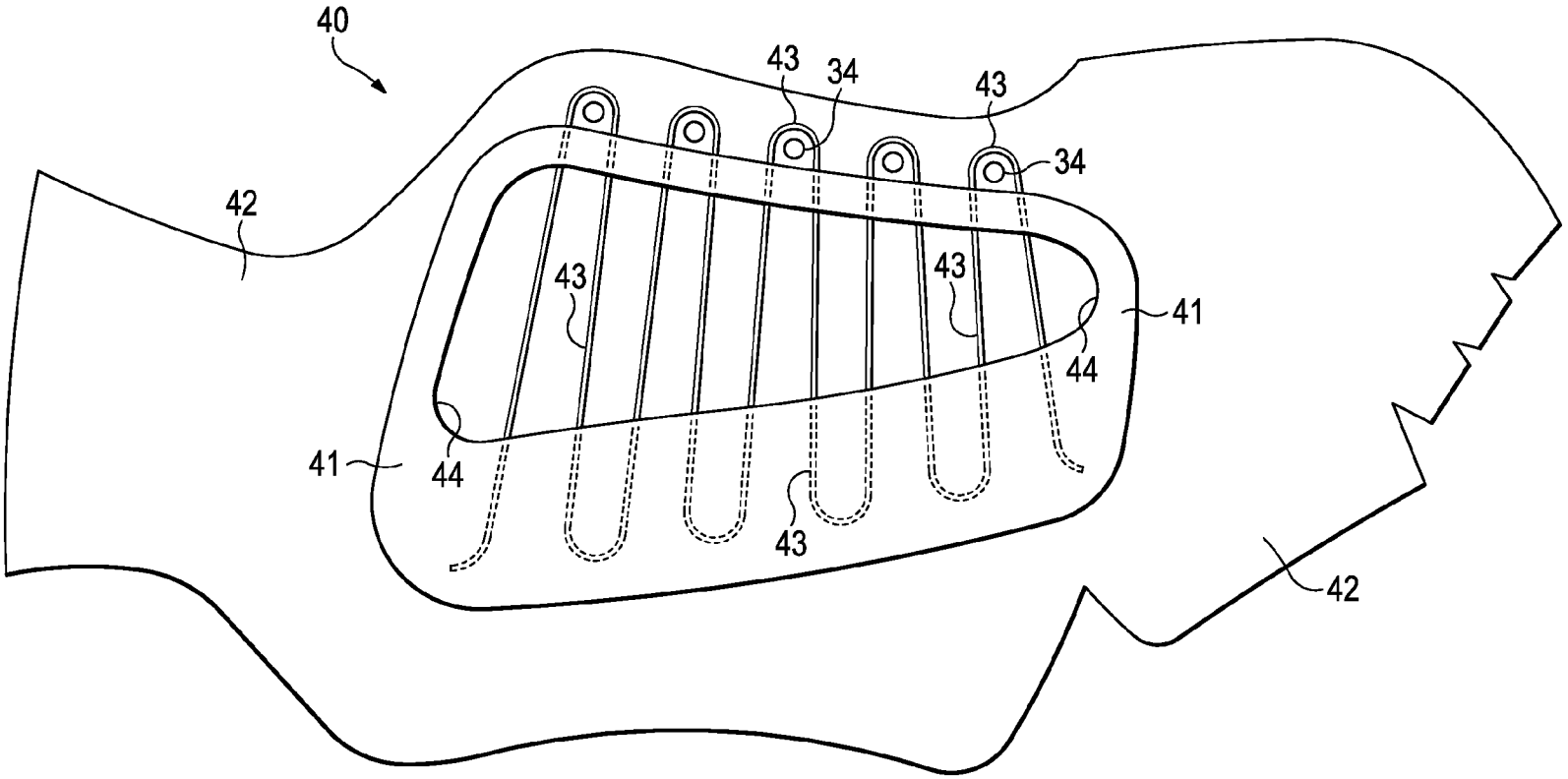

Aspects relating to tensile strand element 40 may also vary from the general configuration discussed above. Referring to FIG. 10A, for example, segments of strand 43 that extend around lace apertures 34 have a squared or otherwise angled aspect, rather than rounded. In the example of tensile strand element 40 in FIG. 4, material layers 41 and 42 are generally coextensive with each other. As such, the edges of exterior material layer 41 are aligned with the edges of interior material layer 42. Referring to FIG. 10B, however, exterior material layer 41 has a lesser area than interior material layer 42. As such, the edges of exterior material layer 41 are spaced inward from edges of interior material layer 42, with both of material layers 41 and 42 forming opening 44. Moreover, exterior material layer 41 covers portions of strand 43 in both of regions 36 and 37, but exposes portions of strand 43 that extend around lace apertures 34.

Figure 10C:
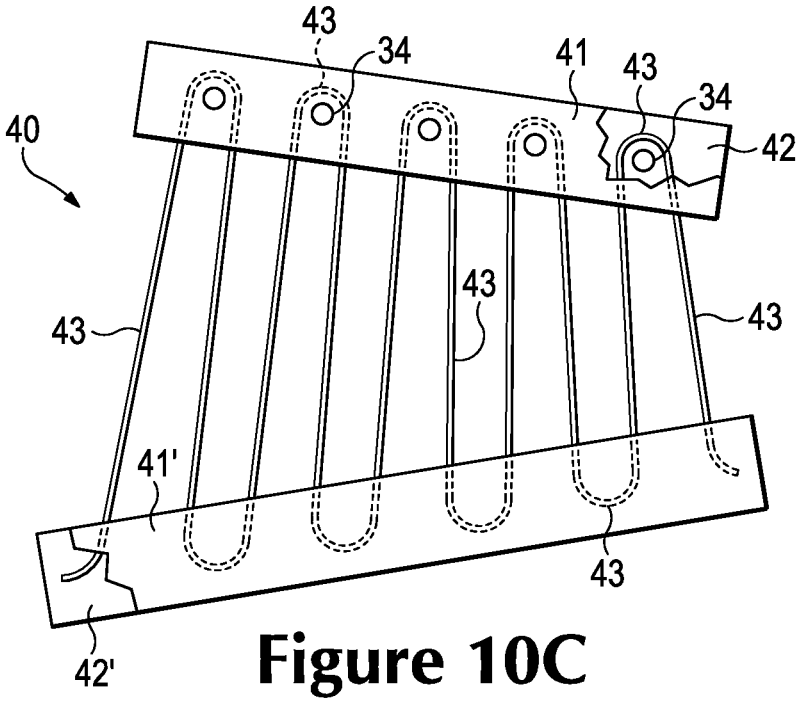

Another configuration of tensile strand element 40 is depicted in FIG. 10C. In addition to including material layers 41 and 42 and strand 43, this configuration includes two separate material layers 41' and 42' that are spaced from material layers 41 and 42. Moreover, separate portions of strand 43 and located between and secured to each of material layers 41 and 42 and material layers 41' and 42'. When incorporated into footwear 10, material layers 41 and 42 may be located in lace region 36, with segments of strand 43 being located and secured between material layers 41 and 42 in lace region 36. Additionally, material layers 41' and 42' may be located in lower region 37, with segments of strand 43 being located and secured between material layers 41' and 42' in lower region 37. In the prior configurations discussed above, each of material layers 41 and 42 extend from lace region 36 to lower region 37. In this configuration, however, separate material elements or layers (e.g., material layers 41' and 42') may be located in lower region 37 to secure strand 43. Accordingly, strand 43 may be located between or secured to numerous material elements located in various areas of upper 30.

Figure 10D:
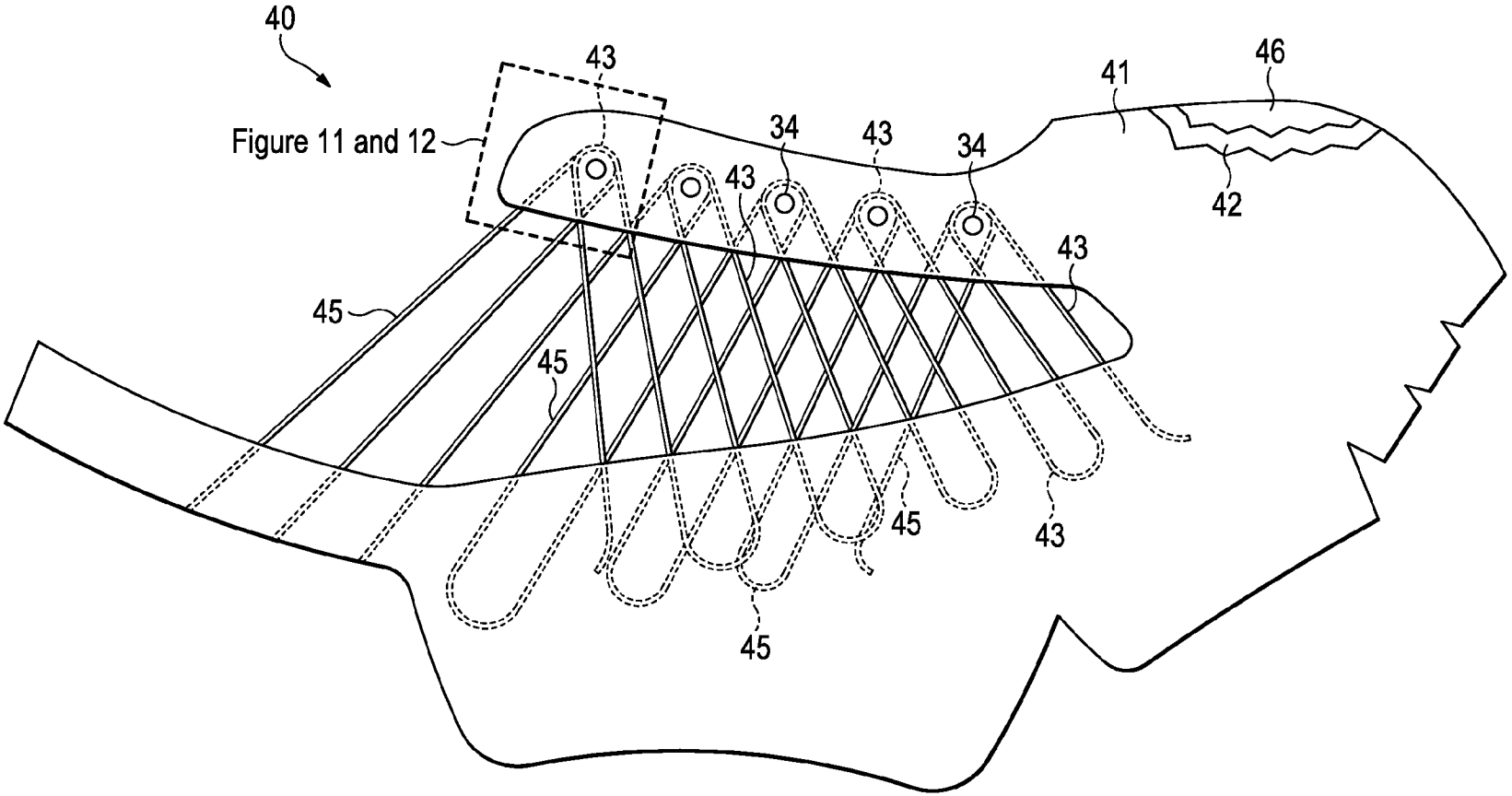
Figure 11:
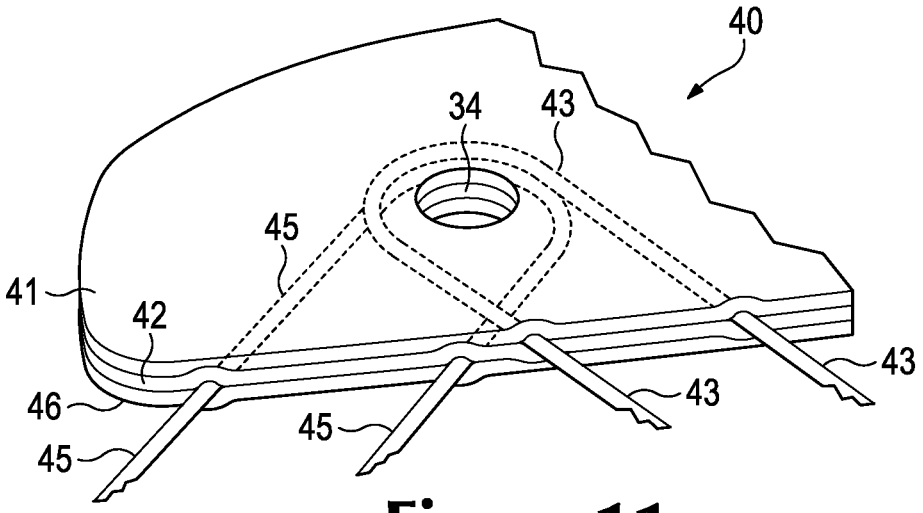
FIG. 11 is a perspective view of a portion of the tensile strand element, as defined in FIG. 10D.
Figure 12:
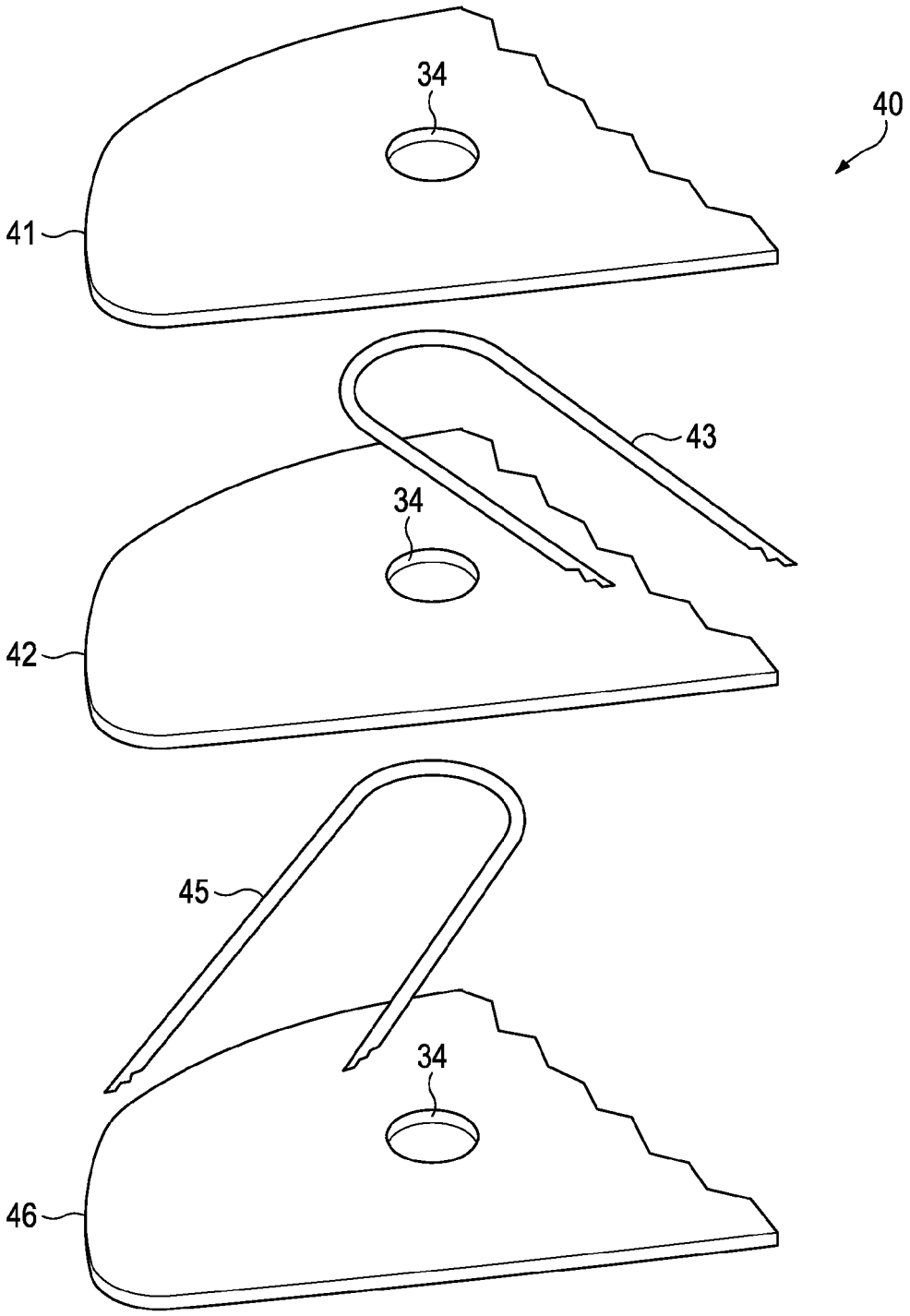
FIG. 12 is an exploded perspective view of the portion of the tensile strand element, as defined in FIG. 10D.

FIG. 10D depicts a configuration of tensile strand element 40 that may be utilized in the configuration of footwear 10 depicted in FIG. 9E. As such, tensile strand element 40 includes strands 43 and 45. As incorporated into tensile strand element 40, both of strands 43 and 45 may be located and secured between material layers 41 and 42. Referring to FIGS. 11 and 12, however, an enlarged and more detailed area of tensile strand element 40 is depicted. Whereas strand 43 is located and secured between material layers 41 and 42, strand 45 is located between interior material layer 42 and a backing material layer 46. As such, strands 43 and 45 are located adjacent to opposite surfaces of interior material layer 42, and each of strands 43 and 45 form loops that extend at least partially around an individual lace aperture 34. A segment of strand 43, therefore, (a) is located adjacent to a first surface of interior material layer 42, (b) is positioned and secured between material layers 41 and 42, and (c) forms a loop that extends at least partially around various aligned apertures in material layers 41, 42, and 46 that combine to form one of lace apertures 34. Similarly, a segment of strand 45 (a) is located adjacent to a second surface of interior material layer 42 that is opposite the first surface, (b) is positioned and secured between material layers 42 and 46, and (c) forms a loop that extends at least partially around the various aligned apertures in material layers 41, 42, and 46 that combine to form one of lace apertures 34.

Figure 13A:
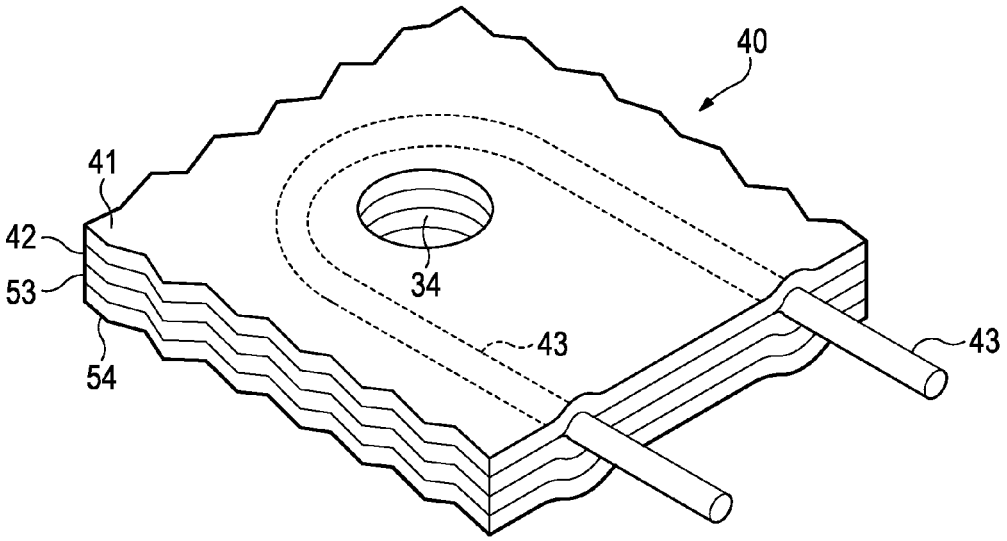
FIGS. 13A and 13B are perspective views corresponding with FIG. 5A and depicting further configurations of the tensile strand element.

Referring to FIG. 13A, a portion of tensile strand element 40 is depicted as including two additional material layers 53 and 54. Material layer 53 is secured and located adjacent to interior material layer 42, and material layer 54 is secured and located adjacent to material layer 53. As an example, material layer 53 may be formed from a polymer foam material, and material layer 54 may be formed from a textile material. As noted above, a polymer foam layer (i.e., material layer 53) may be secured to interior material layer 42 to enhance the comfort of footwear 10, and a textile layer (i.e., material layer 54) may be secured to the polymer foam layer to form a portion of the interior surface of upper 30, enhance comfort, and wick moisture (e.g., from perspiration) away from the foot.

Figure 13B:
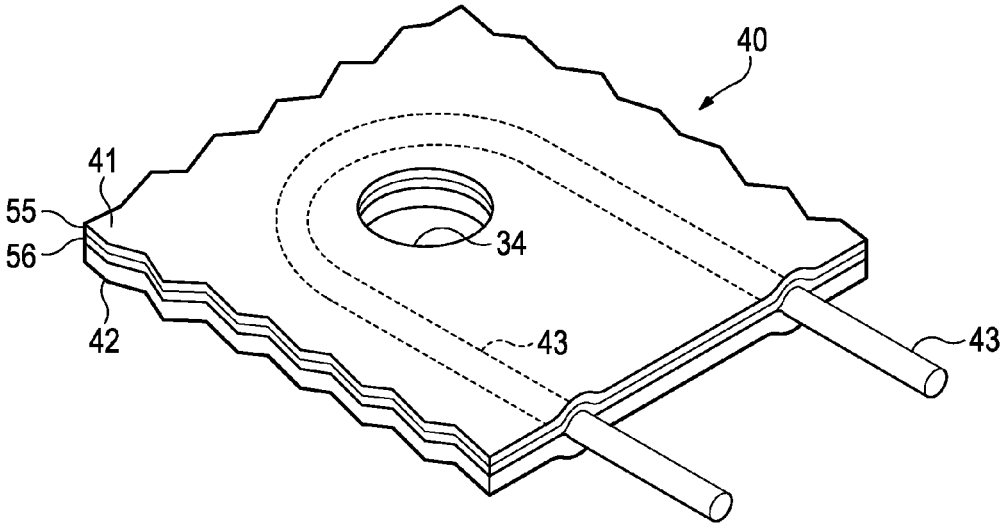

Although material layers 41 and 42 may be formed from a single material, each of material layers 41 and 42 may also be formed from multiple materials. Referring to FIG. 13B, for example, exterior material layer 41 is depicted as being formed from an outer stratum 55 and an inner stratum 56 that are formed from different materials. As an example, outer stratum 55 may be formed from a thermoset polymer material and inner stratum 56 may be formed from a thermoplastic polymer material. As another example, outer stratum 55 may be formed from a thermoplastic polymer material and inner stratum 56 may be formed from a different thermoplastic polymer material with a lower glass transition or melting temperature. In either example, inner stratum 56 is located adjacent to the a surface of interior material layer 42 and the thermoplastic polymer material may be utilized to secure material layers 41 and 42 to each other. Moreover, an advantage of forming outer stratum 55 from the materials noted above is that outer stratum 55 may remain solid during the bonding of material layers 41 and 42 to each other, thereby ensuring that a texture or smooth (e.g., glossy) aspect of outer stratum 55 remains intact during bonding. It should also be noted that forming exterior material layer 41 to include strata 55 and 56 may also be utilized with other configurations of tensile strand element 40, including the configuration of FIG. 10D, for example.

Manufacturing Processes

Tensile strand element 40 may be manufactured through various processes. The following discussion details four example manufacturing processes that may be utilized to attain various features discussed in connection with the above configurations. Although the processes discussed below display a range of techniques for manufacturing tensile strand element 40, variations upon these processes, combinations of these processes, or additional processes may also fall within the scope of the present discussion.

In the discussion below, four example manufacturing processes are presented. In general, three of the example manufacturing processes may be utilized to form tensile strand element 40 with the general configuration depicted in FIGS. 4-7C. Moreover, substantially similar manufacturing processes may be utilized to form the configurations of tensile strand element 40 that are depicted in FIGS. 9A-9D and 10A-10C. One of the example manufacturing processes may also be utilized to form the configuration of tensile strand element 40 depicted in FIGS. 9E and 10D-12.

Each of the example manufacturing processes utilize precursor elements (i.e., precursor elements 61 and 65) that become one of material layers 41 or 42 at later stages of the processes. One of the processes additionally utilizes a precursor element (i.e., a precursor element 73) that becomes backing material layer 46 at a later stage of the process. Although terminology may vary, either exterior material layer 41 or the precursor element forming exterior material element 41 may be referred to as a "cover material layer" given that exterior material layer 41 may be considered to cover interior material layer 42 and strand 43 during the manufacturing processes or when incorporated into footwear 10. Similarly, either interior material layer 42 or the precursor element forming interior material element 42 may be referred to as a "base material layer" given that interior material layer 42 may be considered to form a base to which other elements (e.g., exterior material layer 41 and strand 43) are secured during the manufacturing processes or when incorporated into footwear 10. Additionally, either backing material layer 46 or the precursor element forming backing material element 46 may be referred to as a "backing material layer" given that backing material layer 46 may be considered to form a support or lining element during the manufacturing processes or when incorporated into footwear 10.

First Example Manufacturing Process

Figure 14A:
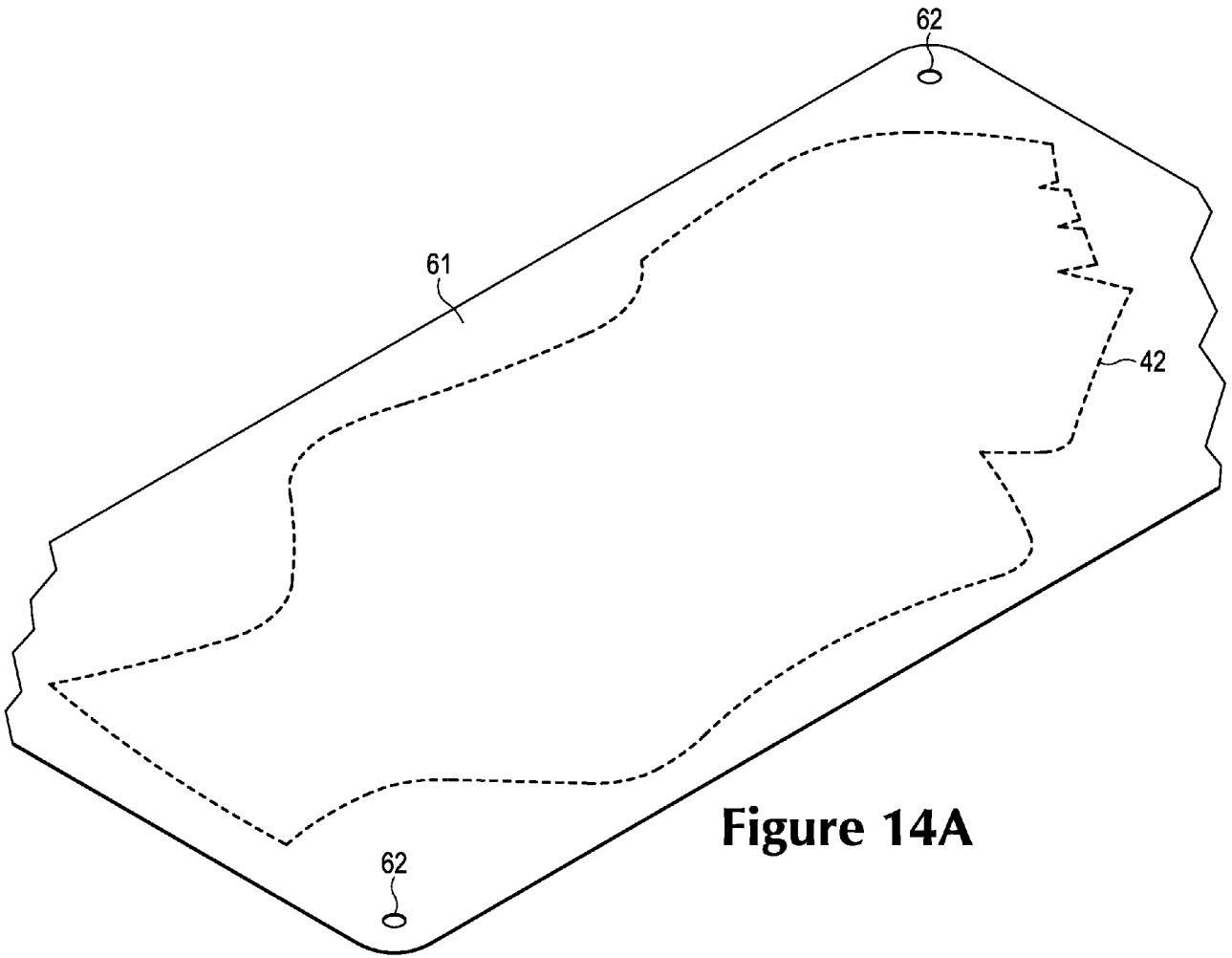

A first example manufacturing process will now be discussed. Referring to FIG. 14A, a precursor element 61 that becomes interior material layer 42 is depicted. For purposes of reference during the following discussion, a dashed outline of interior material layer 42, which is also an outline of tensile strand element 40, is depicted upon precursor element 61. Although other registration systems may be utilized, a pair of registration holes 62 are formed through precursor element 61 to ensure that interior material layer 42 remains properly positioned during subsequent operations.

Figure 14B:
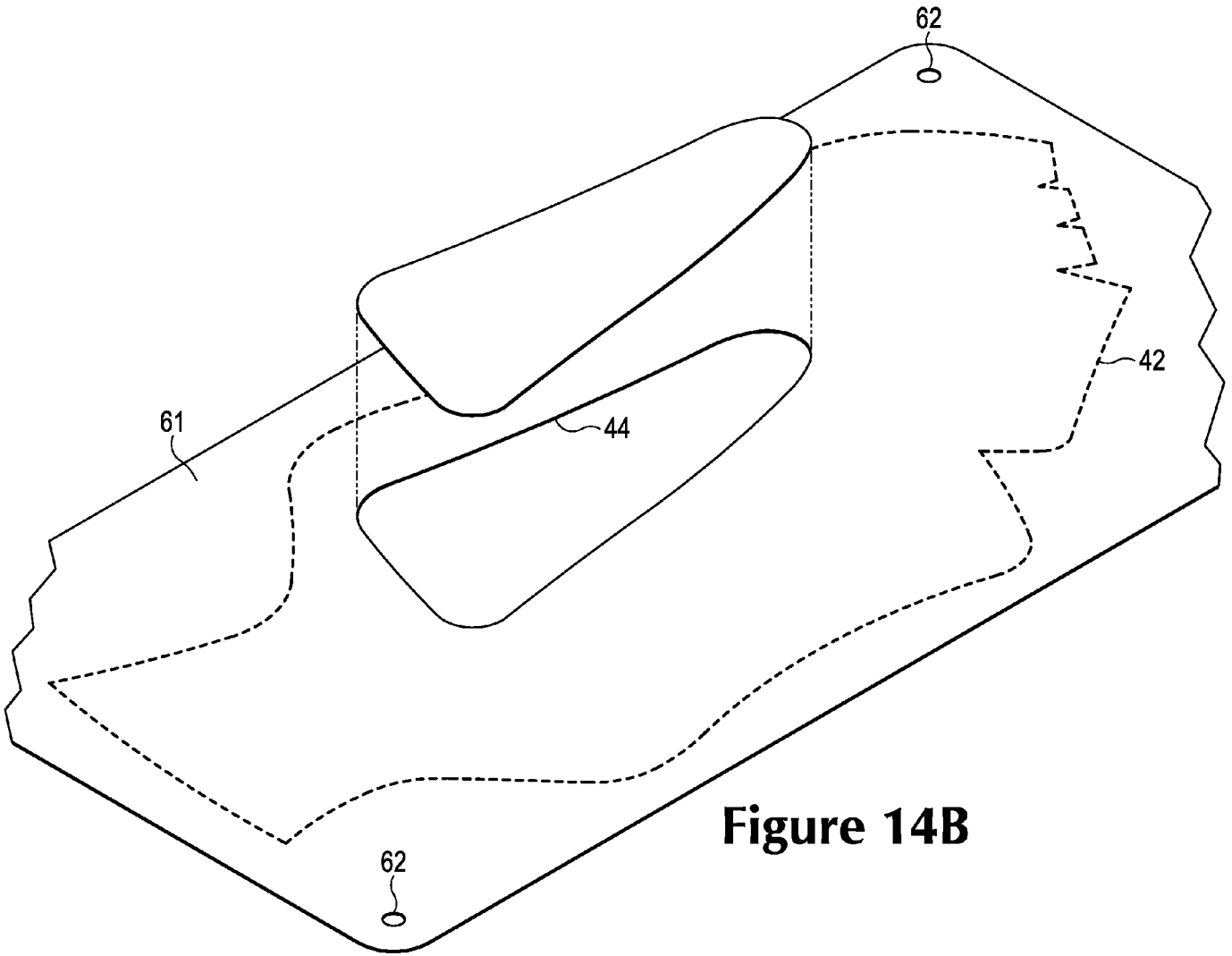

Although the order of steps may vary in this manufacturing process, as well as other manufacturing processes, FIG. 14B depicts a portion of opening 44 (i.e., the portion of opening 44 defined by interior material layer 42) as being formed through interior material layer 42. In addition to die cutting, opening 44 may be formed through laser cutting or manual cutting (i.e., manually forming opening 44 with scissors or a blade), for example.

Figure 14C:
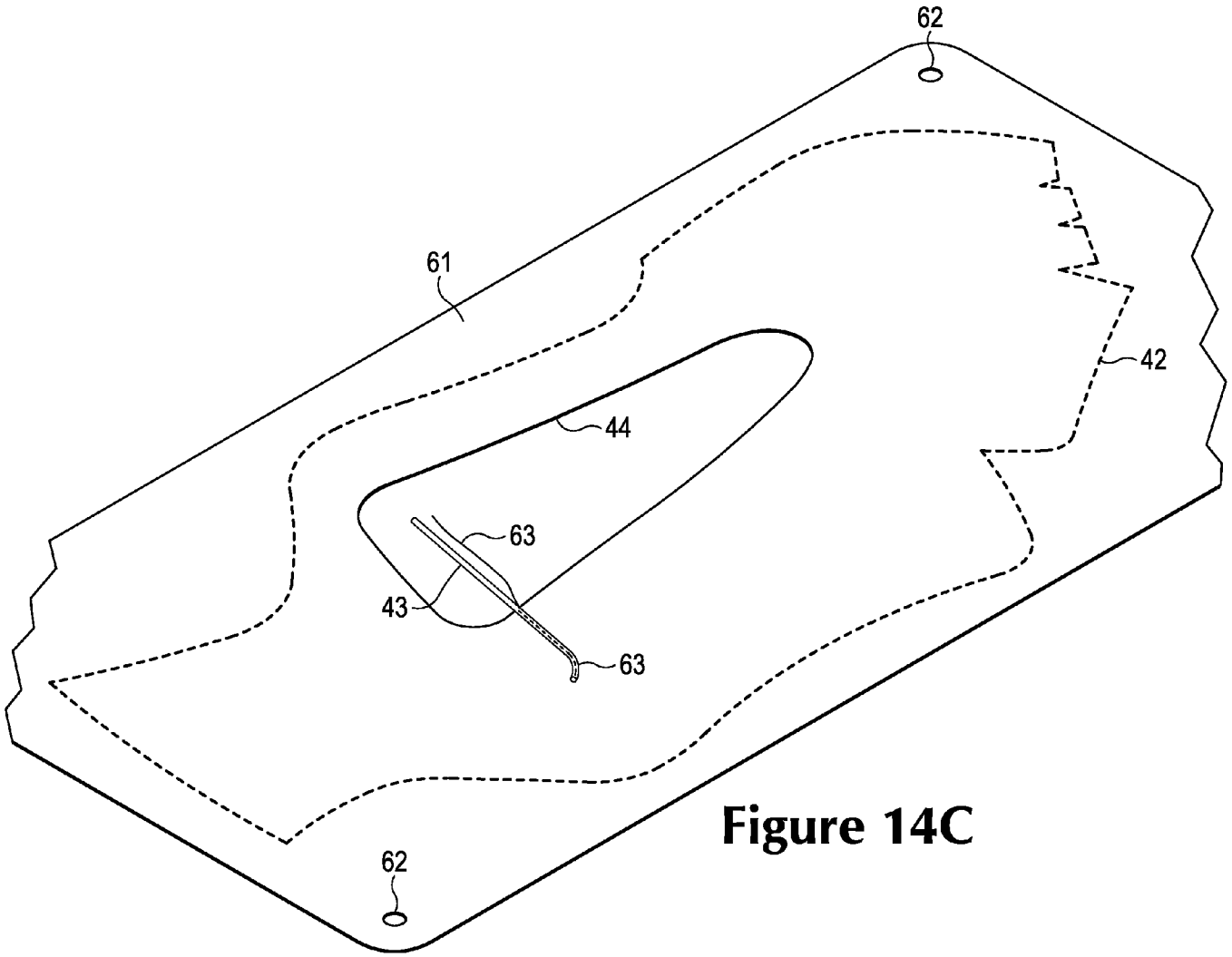

Once opening 44 is formed, a first portion of strand 43 may be stitched to interior material layer 42 with a thread 63, as depicted in FIG. 14C. Although other methods may be utilized, a cording machine may be employed to simultaneously locate strand 43 on interior material element 42 and secure strand 43 to interior material element 42 by extending thread 63 through strand 43. That is, the cording machine may include elements that (a) lay strand 43 according to a predetermined pattern upon interior material element 42 and (b) stitch strand 43 to interior material element 42 in predetermined locations. In other processes, separate machines or manual procedures may lay strand 43 and stitch strand 43 to interior material element 42.

Figure 14D:
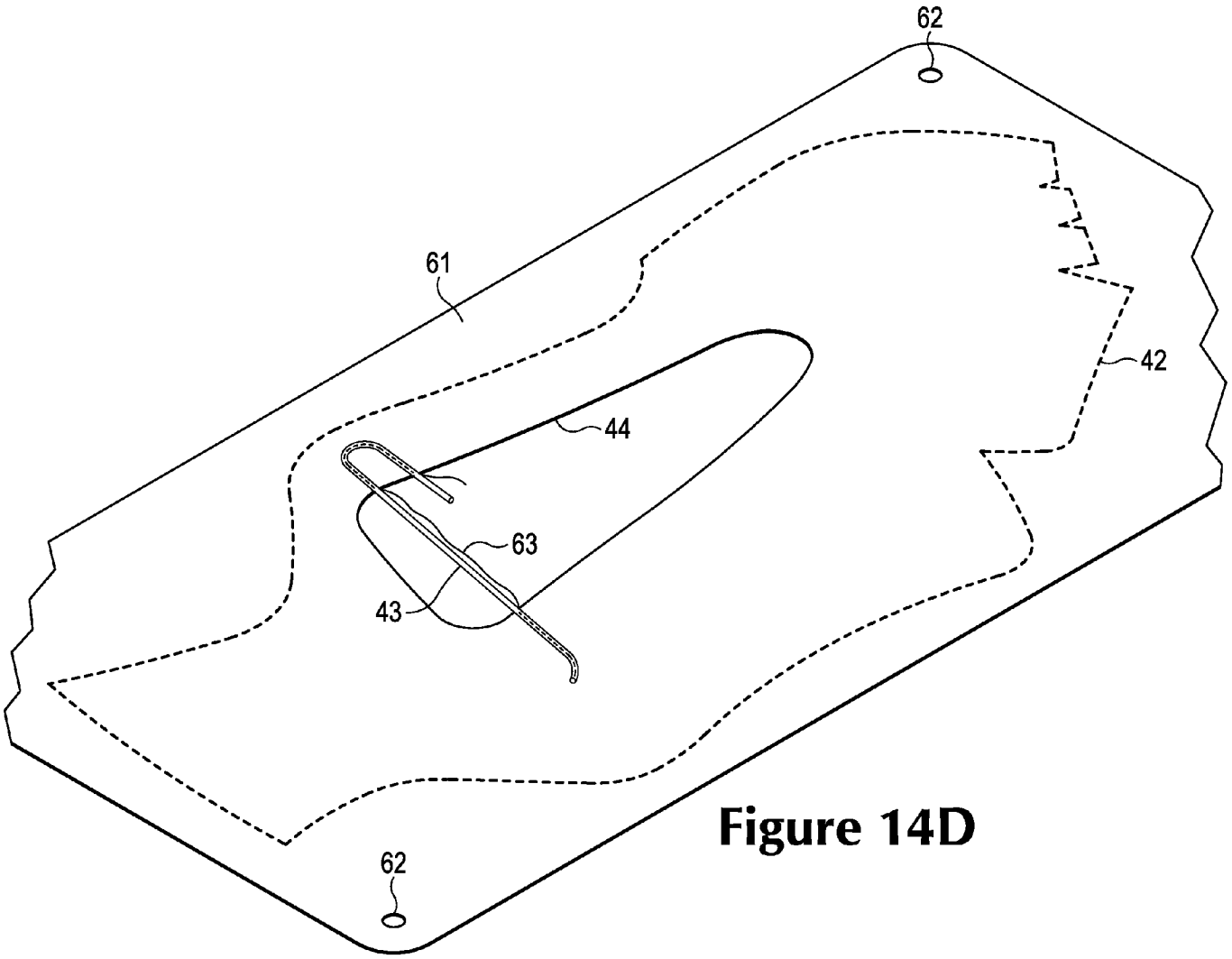

At this stage of the process, strand 43 is stitched to interior material element 42 with thread 63 at a location that generally corresponds with lower region 37. Continuing with the manufacturing process, the cording machine extends strand 43 across opening 44 and stitches strand 43 to interior material element 42 on an opposite side of opening 44, as depicted in FIG. 14D. More particularly, strand 43 is stitched to interior material element 42 with thread 63 at a location that generally corresponds with lace region 36, and strand 43 is laid in a manner that forms a loop. Although not shown as being formed at this stage of the process, the loop formed by strand 43 is positioned to correspond with the position of one of lace apertures 34. In extending strand 43 across opening 44, the cording machine may also extend thread 63 across opening 44.

Figure 14E:
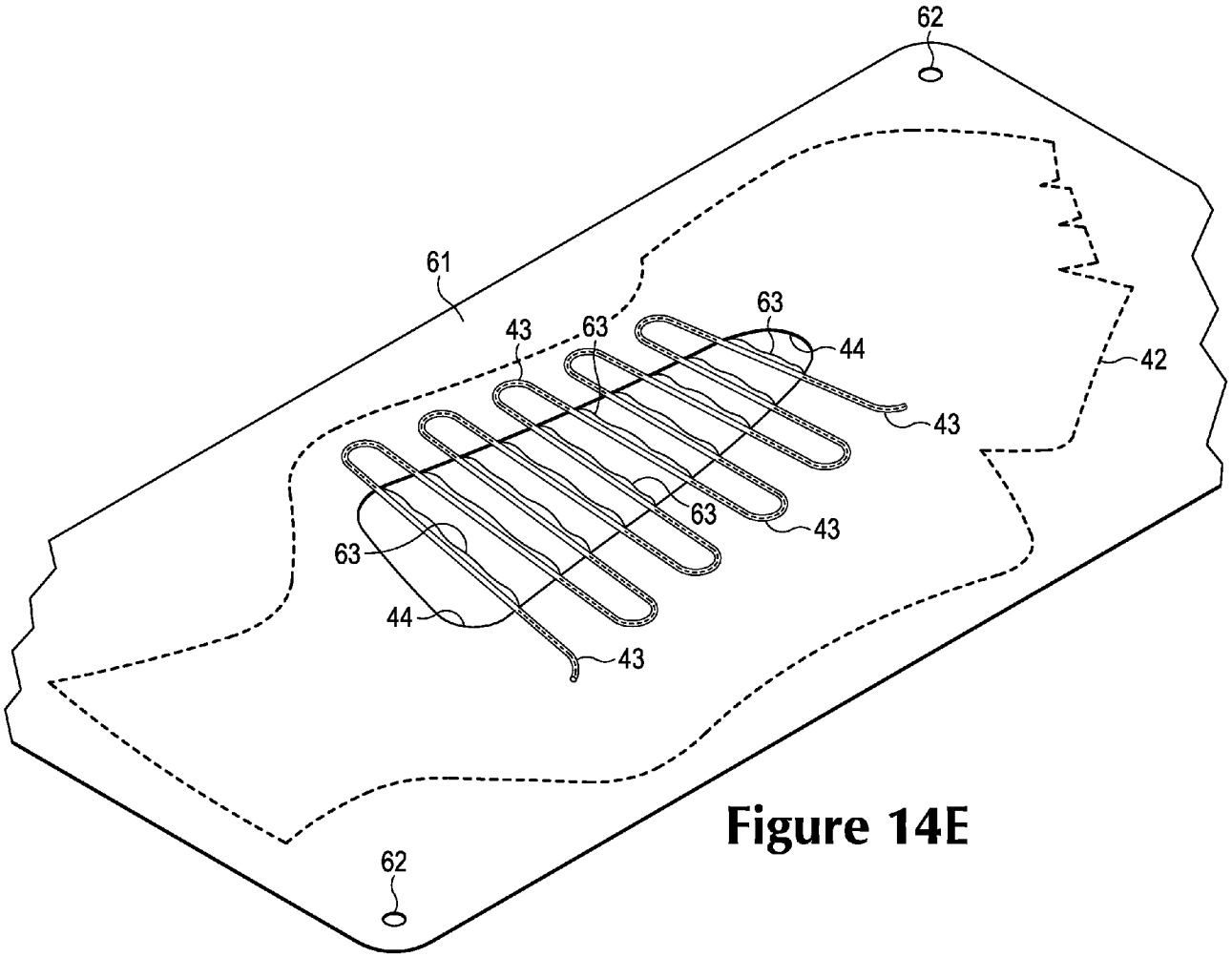

The general process discussed relative to FIGS. 14C and 14D is performed multiple times, as depicted in FIG. 14E, to repeatedly (a) extend strand 43 across opening 44, (b) stitch strand 43 to interior material layer 42 in locations that generally corresponds with each of regions 36 and 37, and (c) form loops from strand 43 in lace region 36. Additionally, the cording machine repeatedly extends thread 63 across opening 44.

Figure 14G:
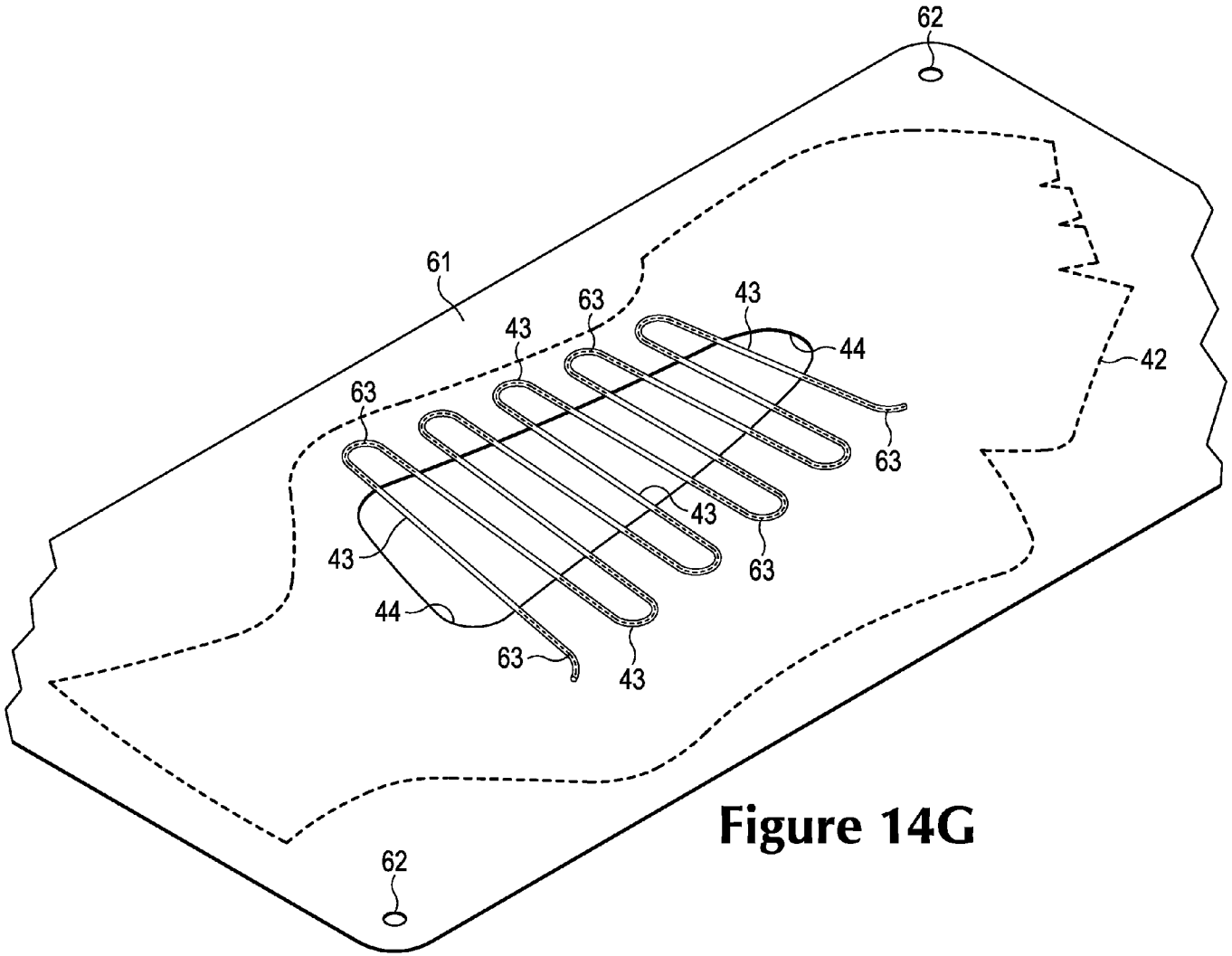

Although strand 43 is intended to extend over opening 44, thread 63 may remain limited to the areas where strand 43 is secured to interior material element 42. Aesthetic considerations may make it undesirable to have thread 63 extend across opening 44. Moreover, thread 63 may snag or otherwise catch upon other objects and break. As such, a cutting device 64 may be utilized to cut thread 63, as depicted in FIG. 14F, thereby removing thread 63 from areas corresponding with opening 44, as depicted in FIG. 14G.

Although cutting device 64 may be scissors, a variety of other methods may be utilized to cut thread 63, including a cutting device that is incorporated into the cording machine. In some manufacturing processes, thread 63 may also be cut during the process of repeatedly extending strand 43 across opening 44. That is, strand 43 may be stitched to interior material layer 42 with thread 63 in one location, and thread 63 may be cut prior to stitching strand 43 to interior material layer 42 in a subsequent location.

Figure 14H:
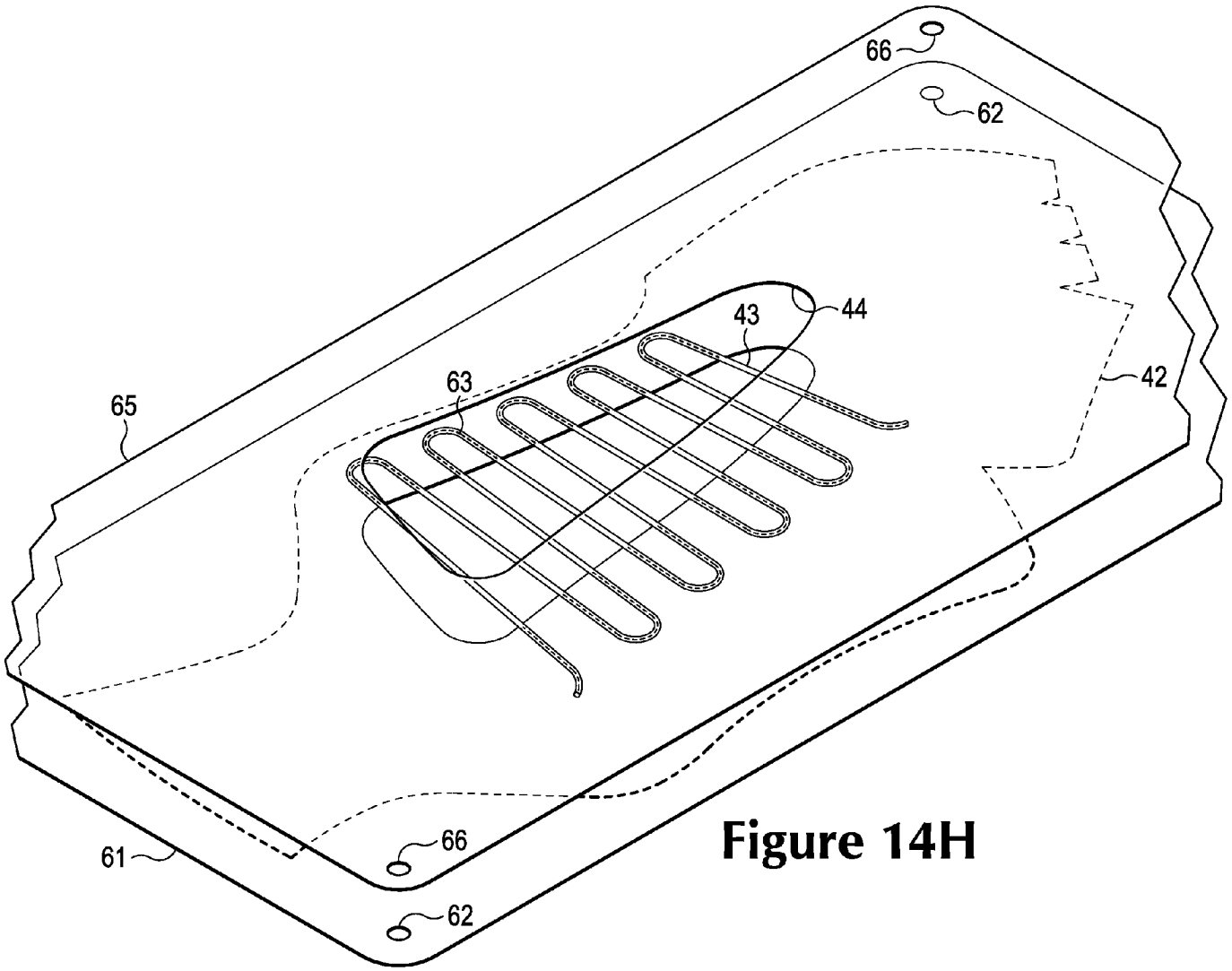

Once thread 63 is removed from opening 44, a precursor element 65 that becomes exterior material layer 41 may be positioned adjacent to precursor element 61, as depicted in FIG. 14H. In positioning precursor elements 61 and 65, strand 43 is generally located between the portions of precursor elements 61 and 65 that form material layers 41 and 42 at a later stage of the process. Die cutting or other operations may also be utilized to define another portion of opening 44 (i.e., the portion of opening 44 defined by exterior material layer 41) through precursor element 65. Additionally, precursor element 65 may include registration holes 66 to assist with aligning the portions of opening 44 formed by each of material layers 41 and 42.

Figure 14I:
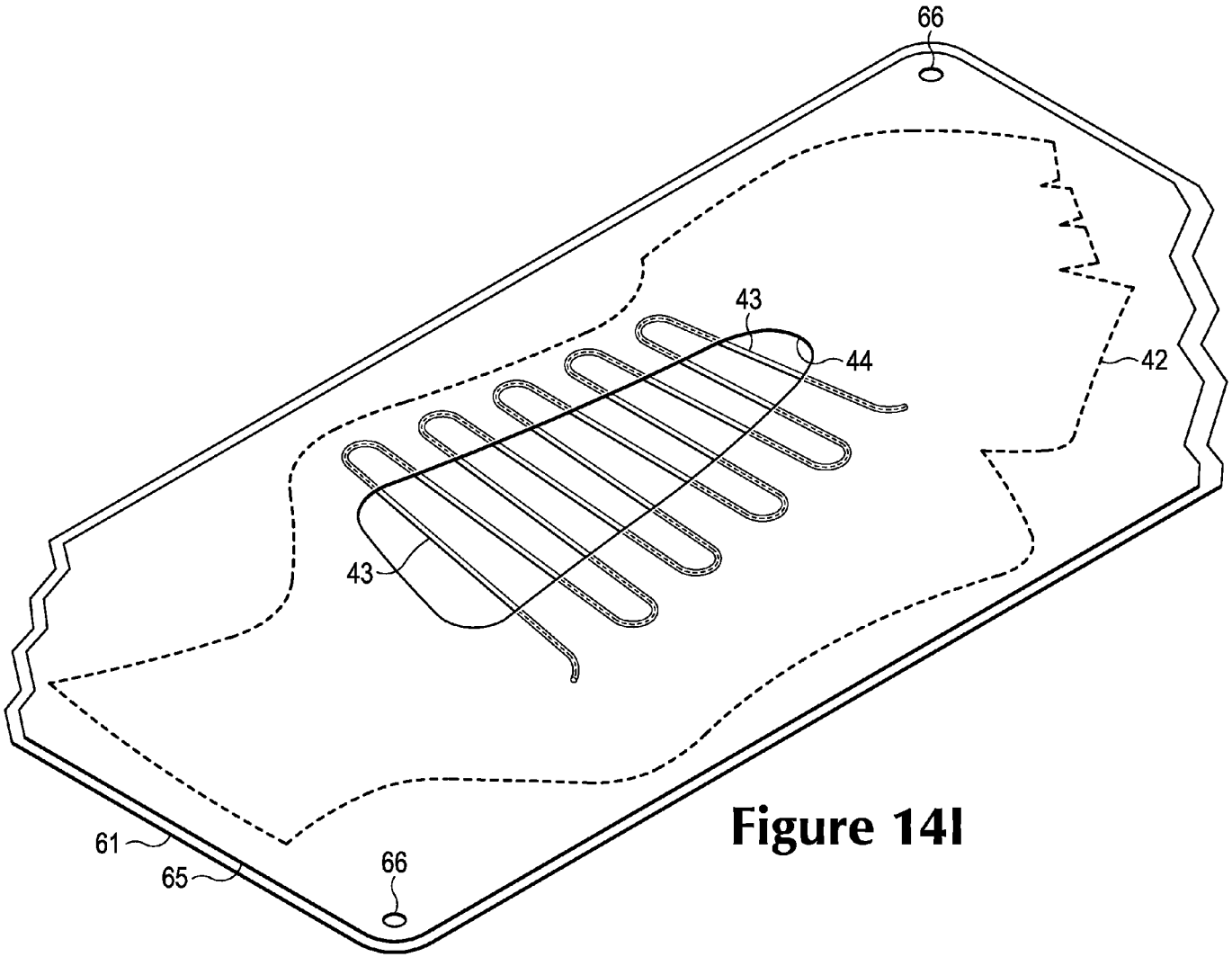

Precursor elements 61 and 65 are now bonded together, as depicted in FIG. 14I. As an example, the assembled elements (i.e., strand 43, thread 63, and precursor elements 61 and 65) may be located within a heat press that simultaneously heats and compresses the elements. Thermoplastic polymer materials in one or both of precursor elements 61 and 65 may bond with the other of precursor elements 61 and 65 to effectively join the elements. The thermoplastic polymer material may also bond with strand 43 to further secure strand 43. As other examples, adhesives or further stitching may be utilized to join the assembled elements or supplement the bond formed by the thermoplastic polymer materials. It should also be noted that other elements or material layers may be bonded or otherwise secured during this stage of the process.

Figure 14J:
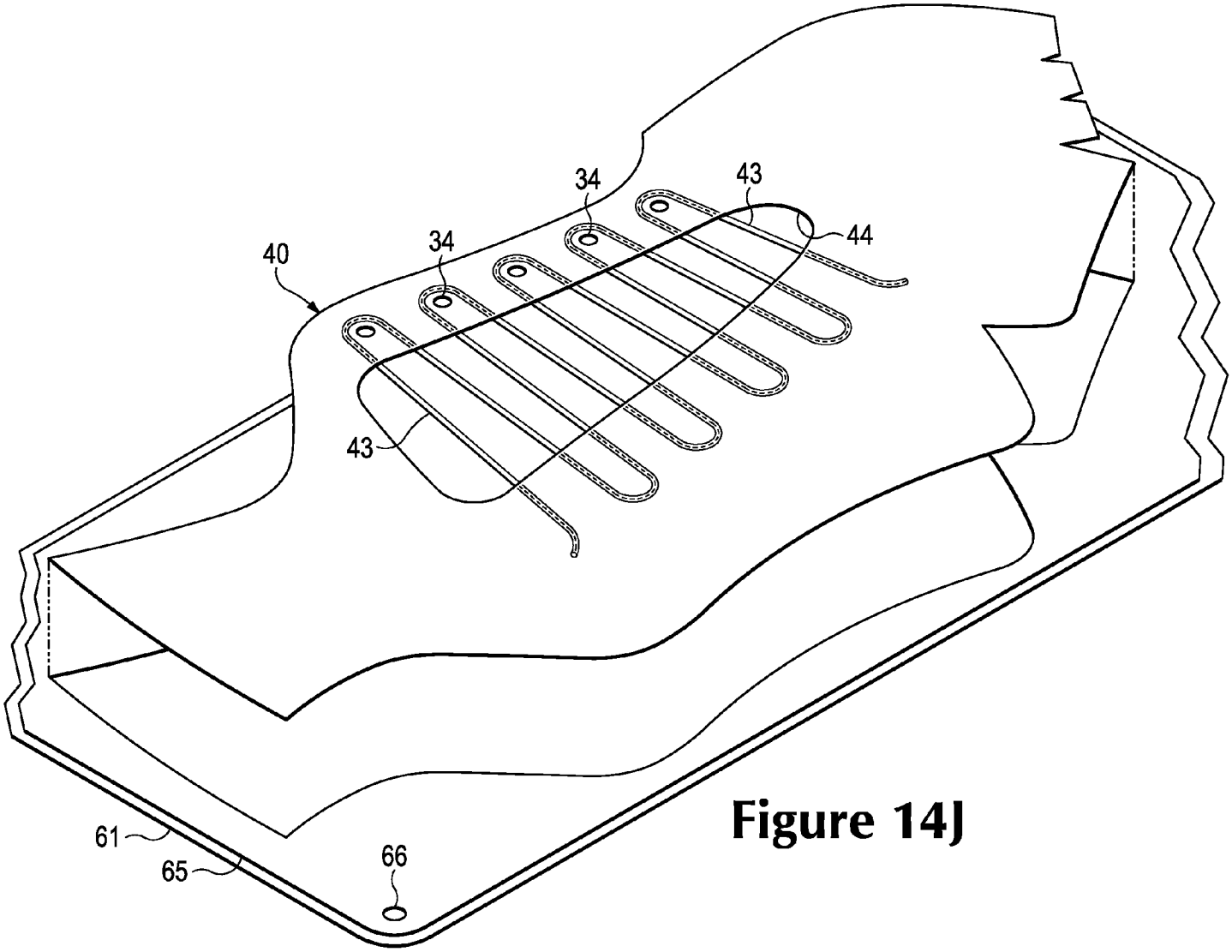

A substantially completed tensile strand element 40 may be removed from excess portions of precursor elements 61 and 65, as depicted in FIG. 14J, with die cutting, laser cutting, or manual cutting, for example. If not formed during a previous operation, lace apertures 34 may be formed within the loops formed by strand 43 and through material layers 41 and 42. The assembled elements forming tensile strand element 40 are then incorporated into footwear 10 such that (a) lace apertures 34 and the loops formed by strand 43 are located in lace region 36 and (b) areas across opening 44 are located in lower region 37. Lace 33 is also threaded through the various lace apertures 34.

Second Example Manufacturing Process

Figure 15A:
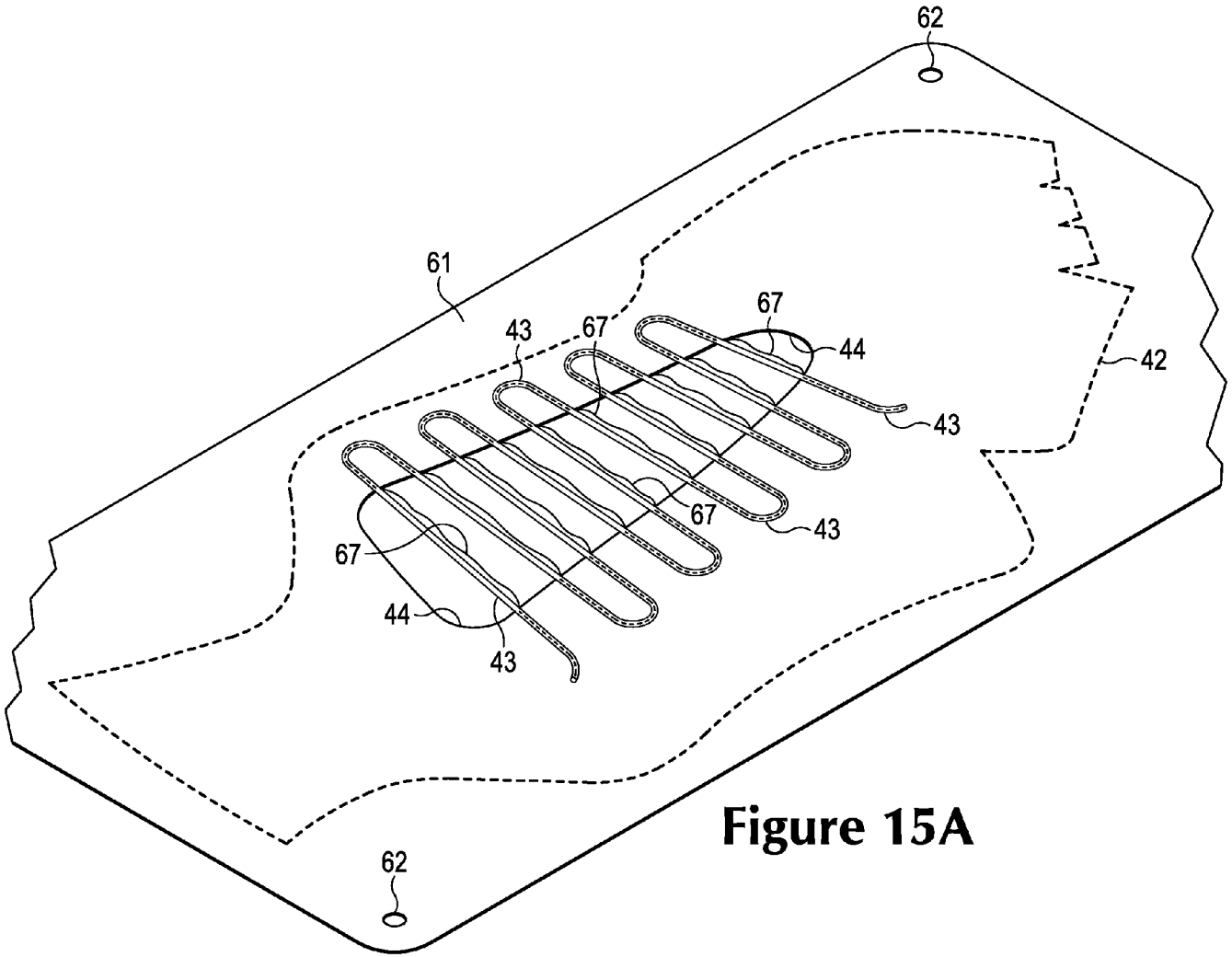
FIGS. 15A-15H are schematic perspective views depicting a second example process for manufacturing a tensile strand element.

Although the first example manufacturing process discussed above provides a suitable process for forming for tensile strand element 40, a second example manufacturing process will now be discussed. Referring to FIG. 15A, the general configuration from FIG. 14E is depicted. As such, the various steps discussed relative to FIGS. 14A-14E may be performed to repeatedly (a) extend strand 43 across opening 44, (b) stitch strand 43 to interior material layer 42 in locations that generally corresponds with each of regions 36 and 37, and (c) form loops from strand 43 in lace region 36. In contrast with FIG. 14E, however, strand 43 is stitched to interior material layer 42 with a soluble thread 67. As such, the cording machine repeatedly extends soluble thread 67 across opening 44 during initial portions of the process.

Figure 15B:
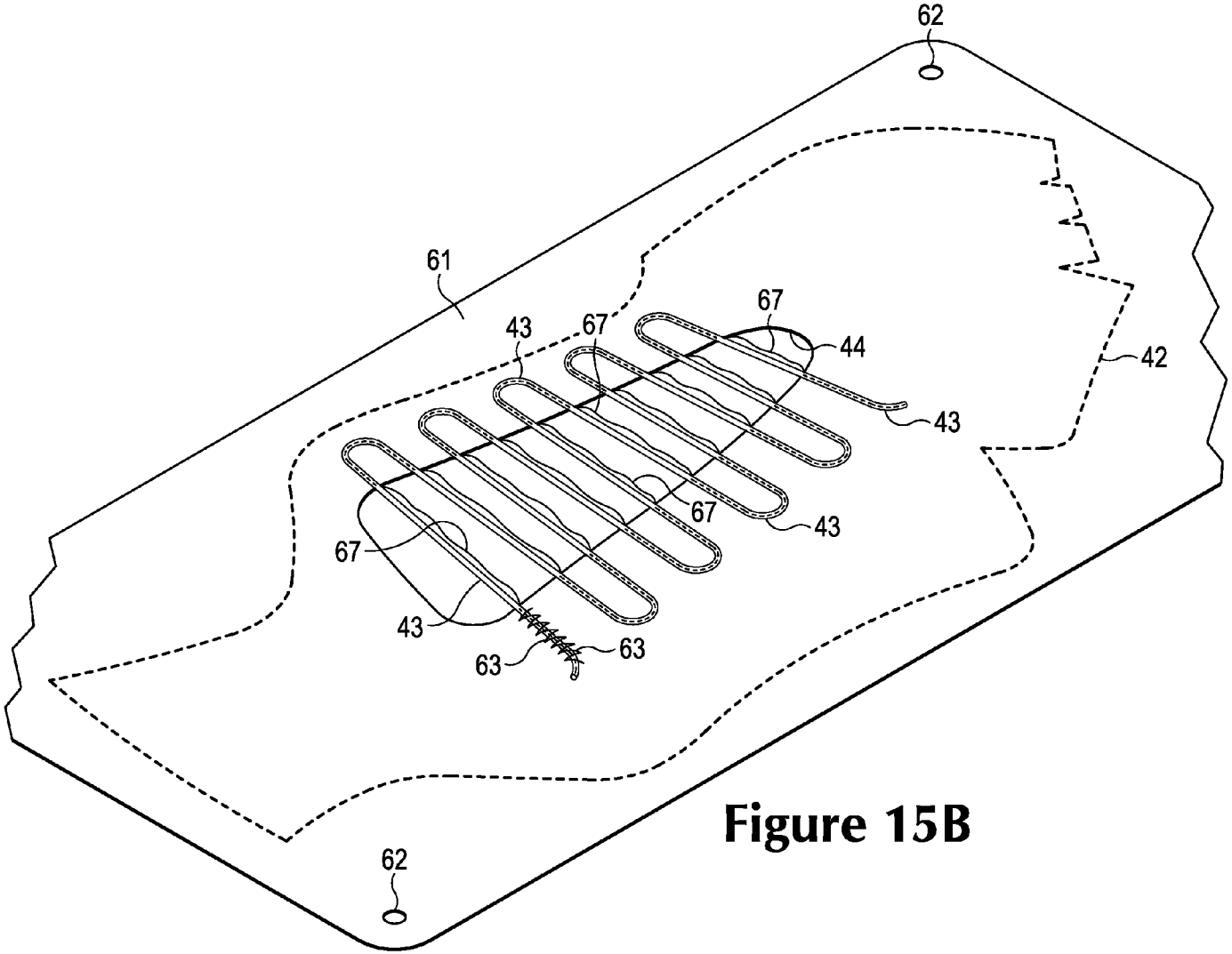
Figure 15C:
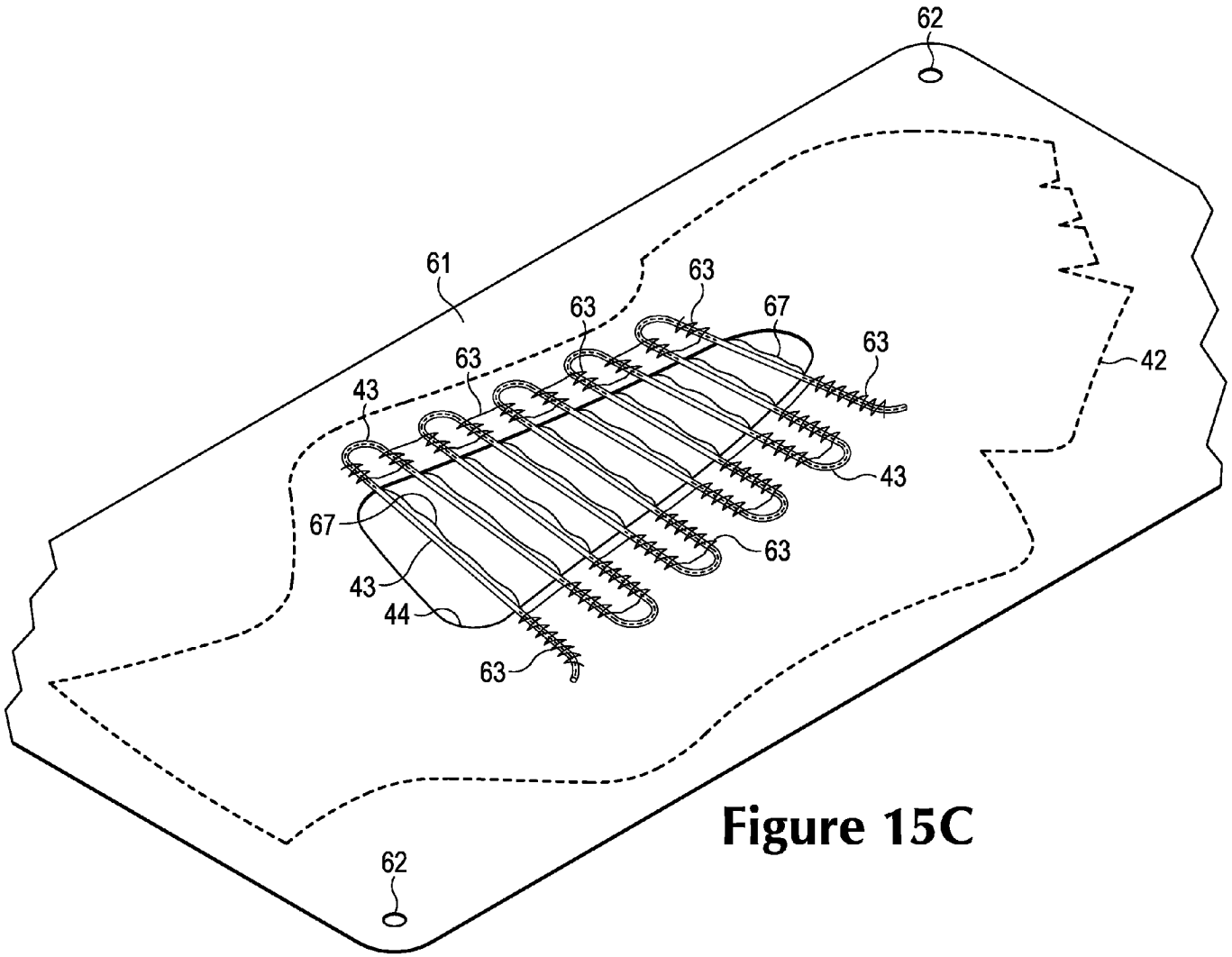

Continuing with the manufacturing process, the cording machine or another stitching machine stitches a portion of strand 43 to interior material layer 42 with thread 63, as depicted in FIG. 15B. Although various types of stitches may be utilized, thread 63 is shown as forming a zigzag stitch that repeatedly crosses over strand 43. Moreover, as depicted in FIG. 15C, the cording machine or another stitching machine continues stitching thread 63 to various portions of strand 43 located in areas corresponding with regions 36 and 37.

Figure 15D:
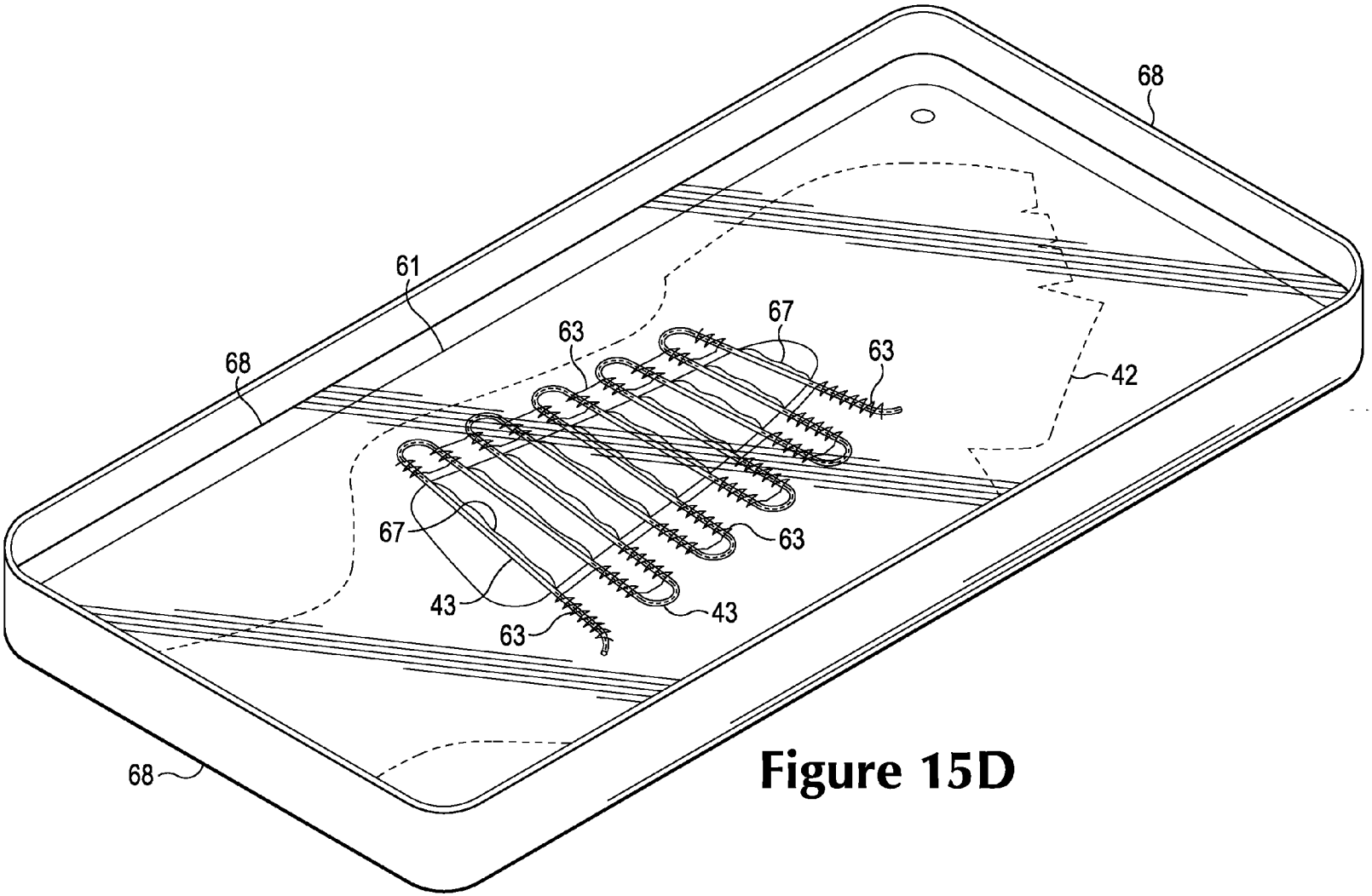
Figure 15E:
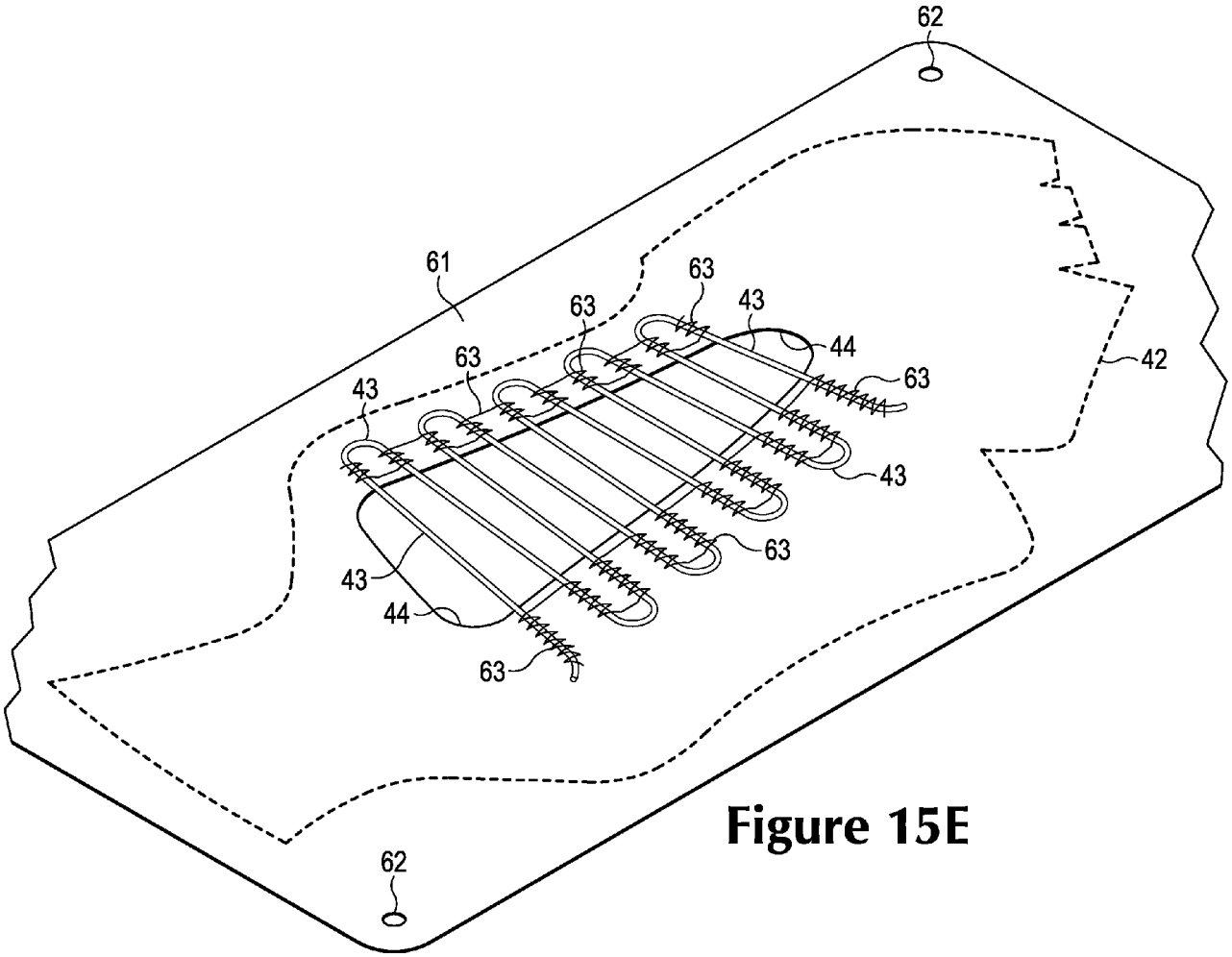

At this stage of the process, strand 43 is effectively secured to interior material layer 42 by both thread 63 and soluble thread 67. Additionally, soluble thread 67 extends across opening 44 in various locations, which may be undesirable for aesthetic considerations and ability to snag and break. Whereas thread 63 is insoluble in water, soluble thread 67 may be soluble in water. In order to remove soluble thread 67, precursor element 61, strand 43, and both of threads 63 and 67 may be located within a water bath 68, as depicted in FIG. 15D. After soluble thread 67 dissolves, the combination of precursor element 61, strand 43, and thread 63 may be removed from water bath 68, as depicted in FIG. 15E. Although soluble thread 67 may be soluble in water, other types of soluble threads may be utilized, such as thread that is soluble in alcohol or other chemical solutions.

In the first example manufacturing process, cutting device 64 removed portions of thread 63 extending across opening 44. When the cutting operations are performed by the cording machine, the cutting operations may consume time that could otherwise be utilized to lay strand 43 or perform other aspects of the process. That is, the time necessary (a) to lay strand 43 upon interior material layer 42, (b) stitch strand 43 to interior material layer 42, and (c) cut excess portions of thread 63 is greater than the time necessary to only (a) to lay strand 43 upon interior material layer 42 and (b) stitch strand 43 to interior material layer 42. As such, when cutting operations are performed by the cording machine, fewer total tensile strand elements 40 may be produced by that cording machine in a given amount of time. Moreover, manual cutting operations may require additional personnel. Accordingly, the use of soluble thread 67 may permit the cording machine to produce a greater number of elements or otherwise enhance manufacturing efficiency.

Figure 15F:
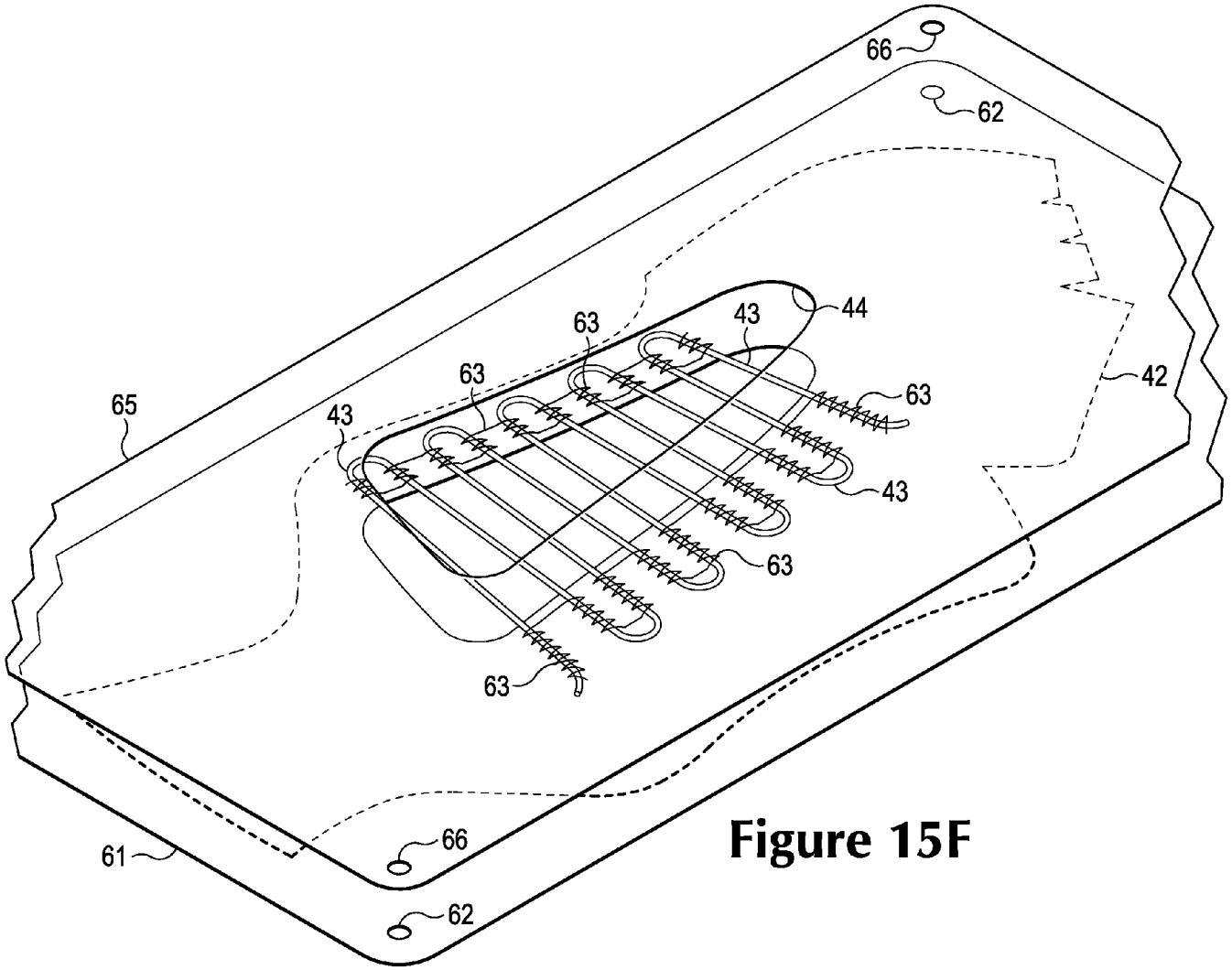
Figure 15G:
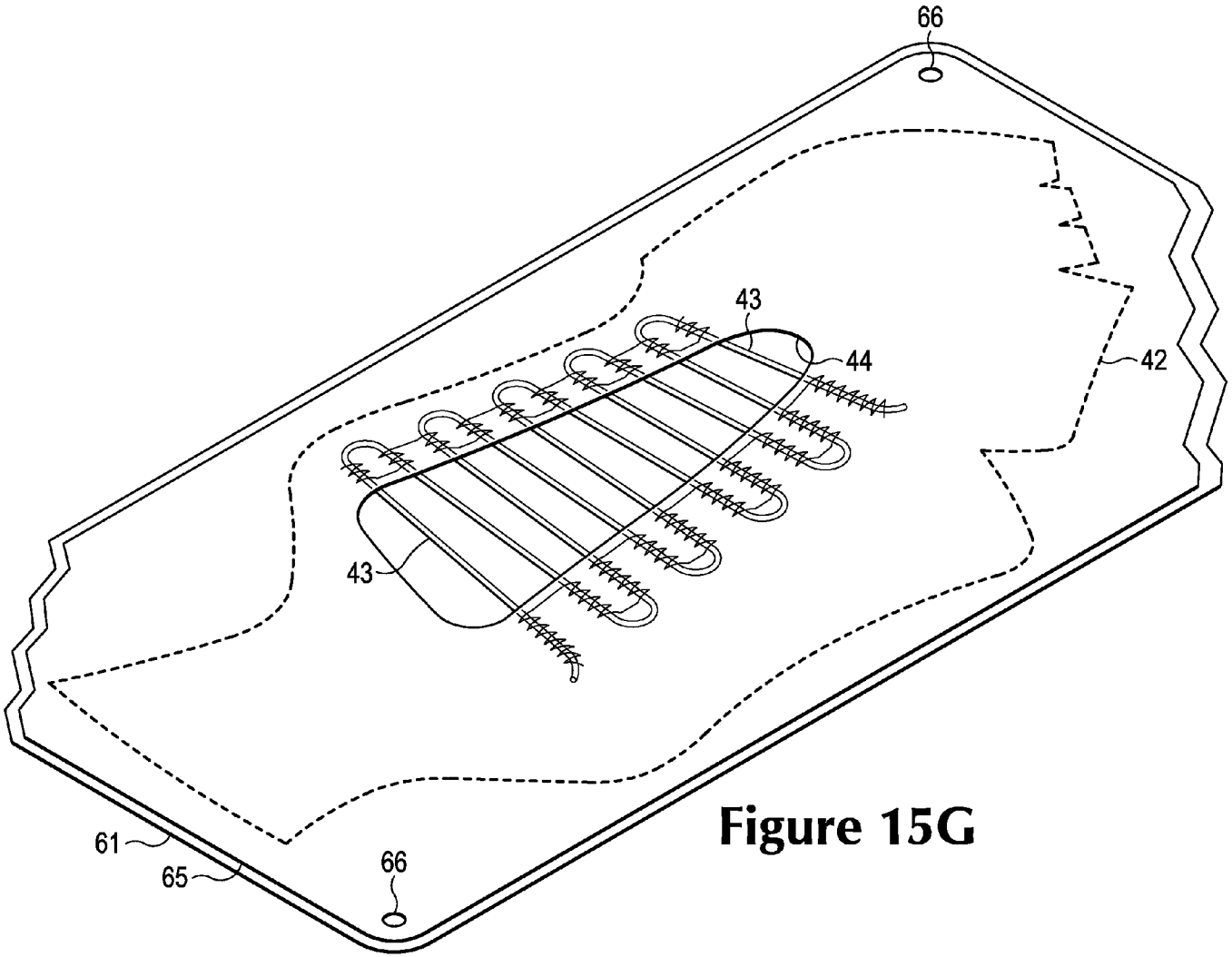
Figure 15H:
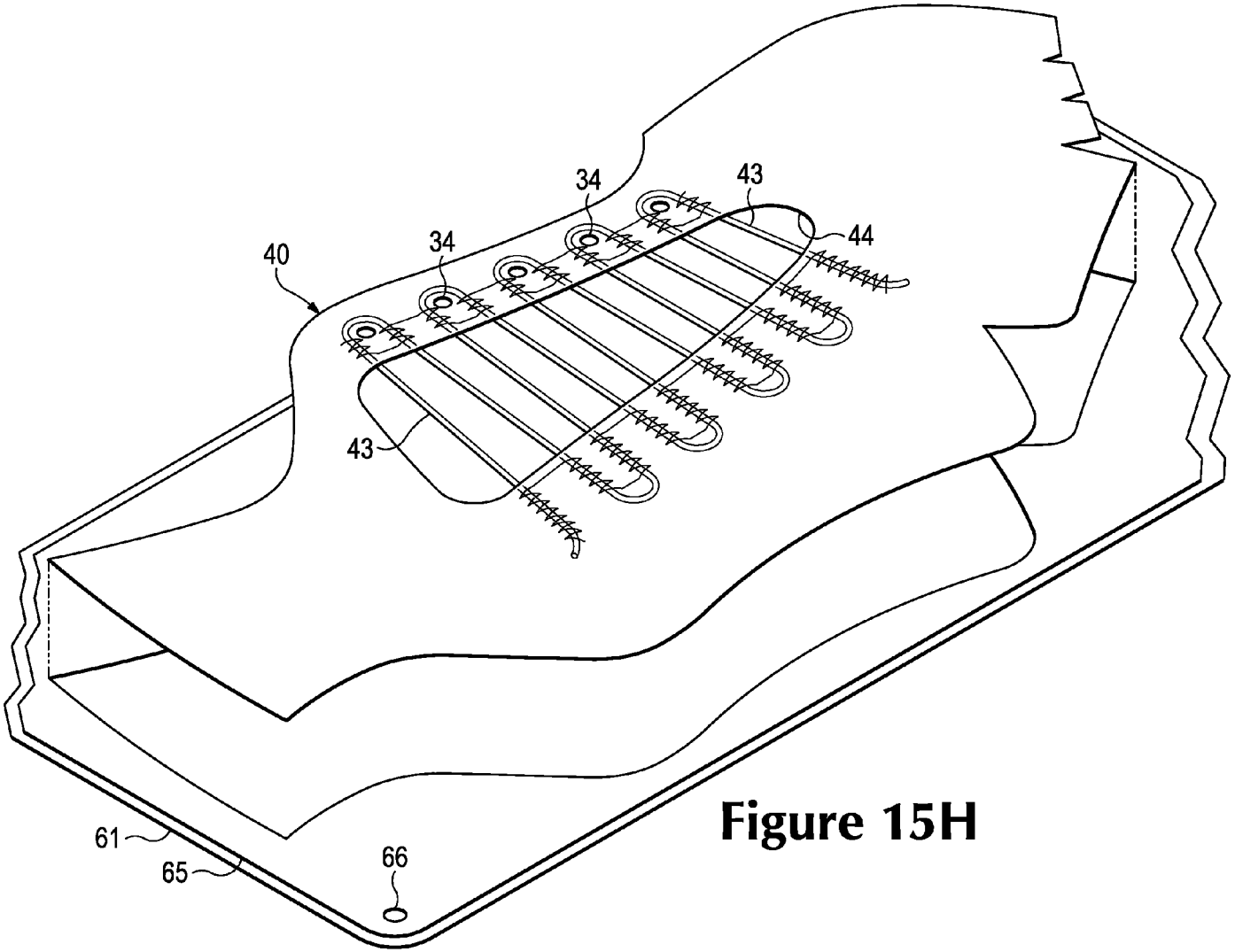

Once soluble thread 67 is removed, the various steps discussed in relation to FIGS. 14H-14J may be performed. More particularly, precursor element 65, which becomes exterior material layer 41, may be positioned adjacent to precursor element 61, as depicted in FIG. 15F. Precursor elements 61 and 65 are then bonded together, as depicted in FIG. 15G. A substantially completed tensile strand element 40 may then be removed from excess portions of precursor elements 61 and 65, as depicted in FIG. 15H, with die cutting, laser cutting, or manual cutting, for example. If not formed during a previous operation, lace apertures 34 may be formed within the loops formed by strand 43 and through material layers 41 and 42. The assembled elements forming tensile strand element 40 are then incorporated into footwear 10 such that (a) lace apertures 34 and the loops formed by strand 43 are located in lace region 36 and (b) areas across opening 44 are located in lower region 37. Lace 33 is also threaded through the various lace apertures 34.

Third Example Manufacturing Process

Figure 16A:
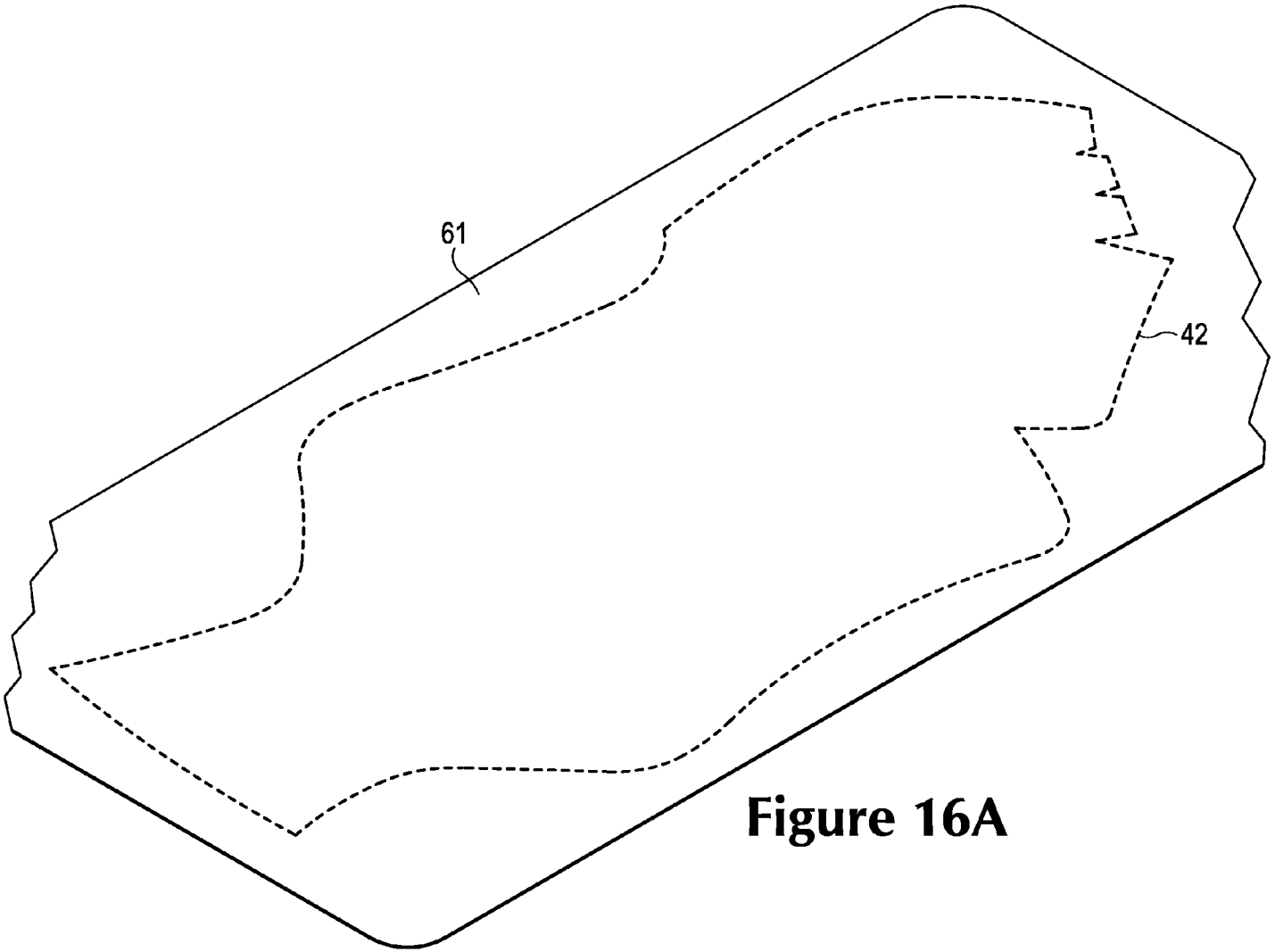
FIGS. 16A-16K are schematic perspective views depicting a third example process for manufacturing a tensile strand element.
Figure 16B:
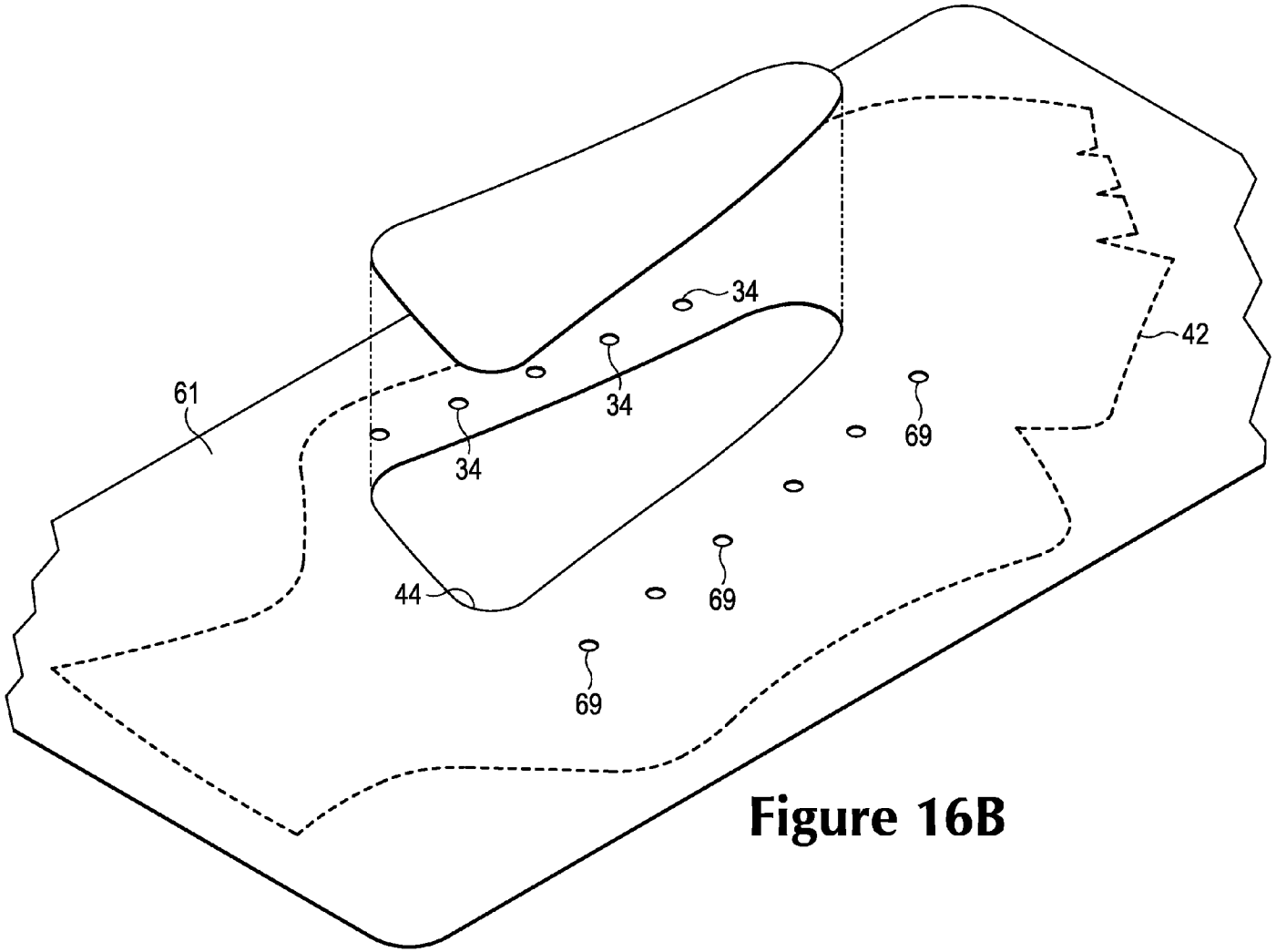

In addition to the manufacturing processes discussed above, a third example manufacturing process may be utilized to produce tensile strand element 40. Referring to FIG. 16A, a precursor element 61 that becomes interior material layer 42 is depicted. For purposes of reference during the following discussion, a dashed outline of interior material layer 42, which is also an outline of tensile strand element 40, is depicted upon precursor element 61. Portions of lace apertures 34 and opening 44 defined by interior material layer 42 are formed through precursor element 61, as depicted in FIG. 16B. Moreover, various apertures 69 are formed in an area corresponding with lower region 37. In addition to die cutting, lace apertures 34, opening 44, and apertures 69 may be formed through laser cutting or manual cutting, for example.

Figure 16C:
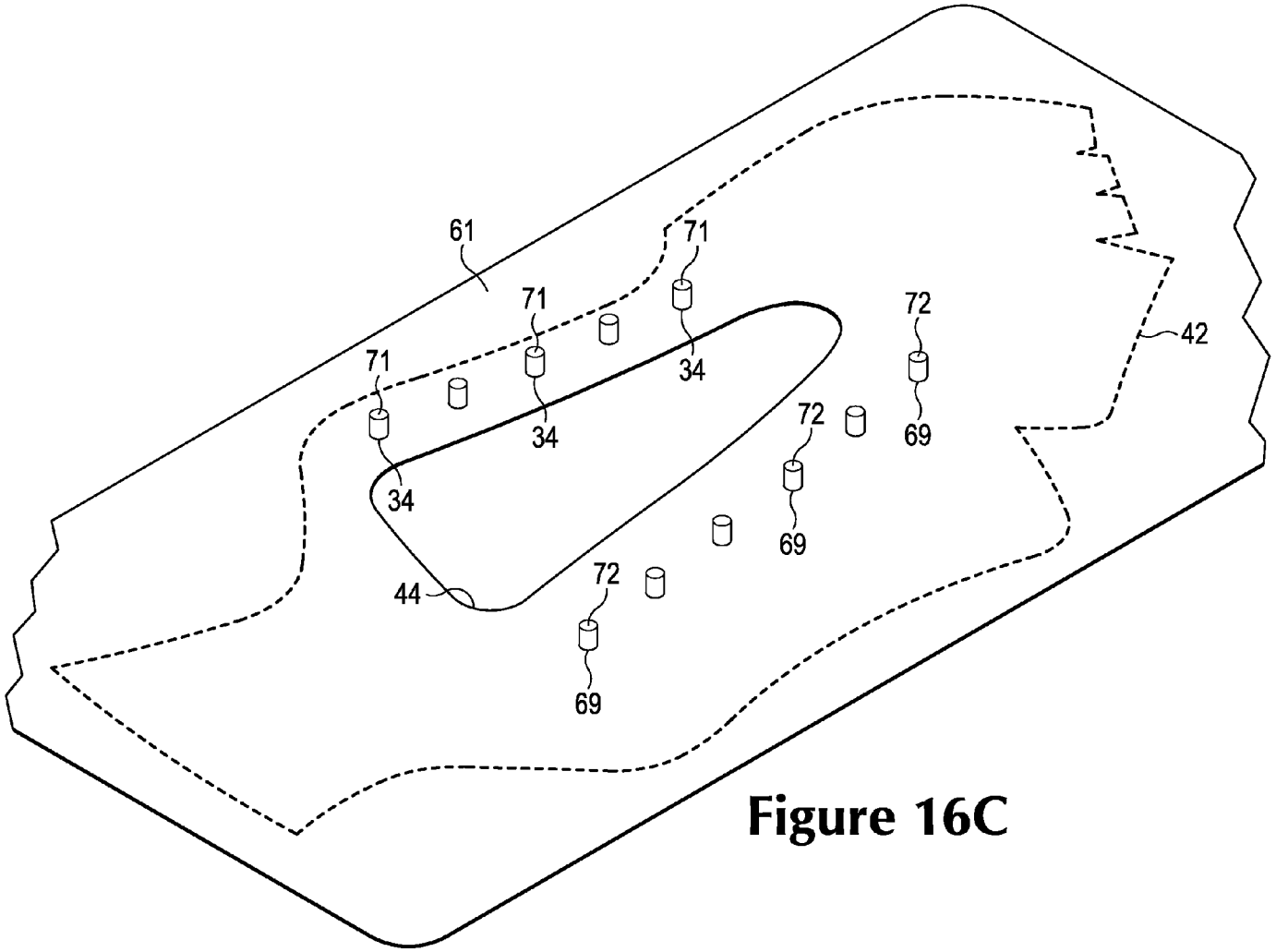

At this stage of the process, precursor element 61 is placed upon a jig or other assembly apparatus that includes various lace pegs 71 and lower pegs 72, as depicted in FIG. 16C. More particularly, lace pegs 71 are positioned to protrude through lace apertures 34 and are located in an area corresponding with lace region 36, and lower pegs 72 are positioned to protrude through apertures 69 and are located in an area corresponding with lower region 37. In general, therefore, pegs 71 and 71 are located in different areas of interior material layer 42 and are spaced from each other across opening 44. Although pegs 71 and 72 are depicted as having a cylindrical shape, pegs 71 and 72 may be other structures that perform in the manner discussed below.

Figure 16D:
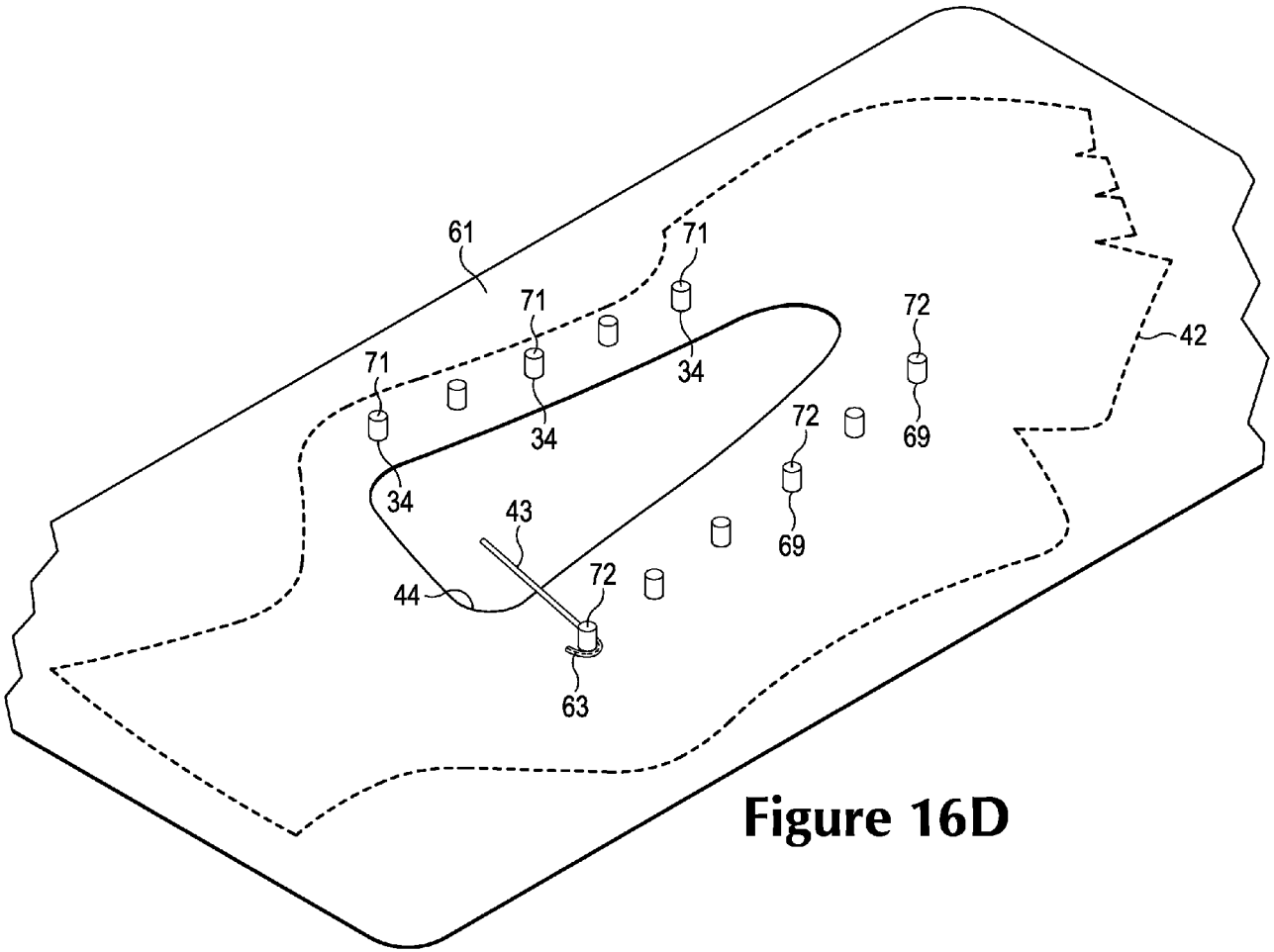

Once pegs 71 and 72 are positioned to extend through lace apertures 34 and apertures 69, a first portion of strand 43 may be stitched to interior material layer 42 with thread 63, as depicted in FIG. 16D. Although the specific position where strand 43 is first secured may vary, strand 43 is depicted as being stitched to interior material layer 42 around one of lower pegs 72. In addition to other methods, a cording machine may be employed to simultaneously locate strand 43 on interior material element 42 and secure strand 43 to interior material element 42 by extending thread 63 through strand 43. That is, the cording machine may include elements that (a) lay strand 43 according to a predetermined pattern upon interior material element 42 and (b) stitch strand 43 to interior material element 42 in predetermined locations. In other processes, separate machines may lay strand 43 and stitch strand 43 to interior material element 42.

Figure 16E:
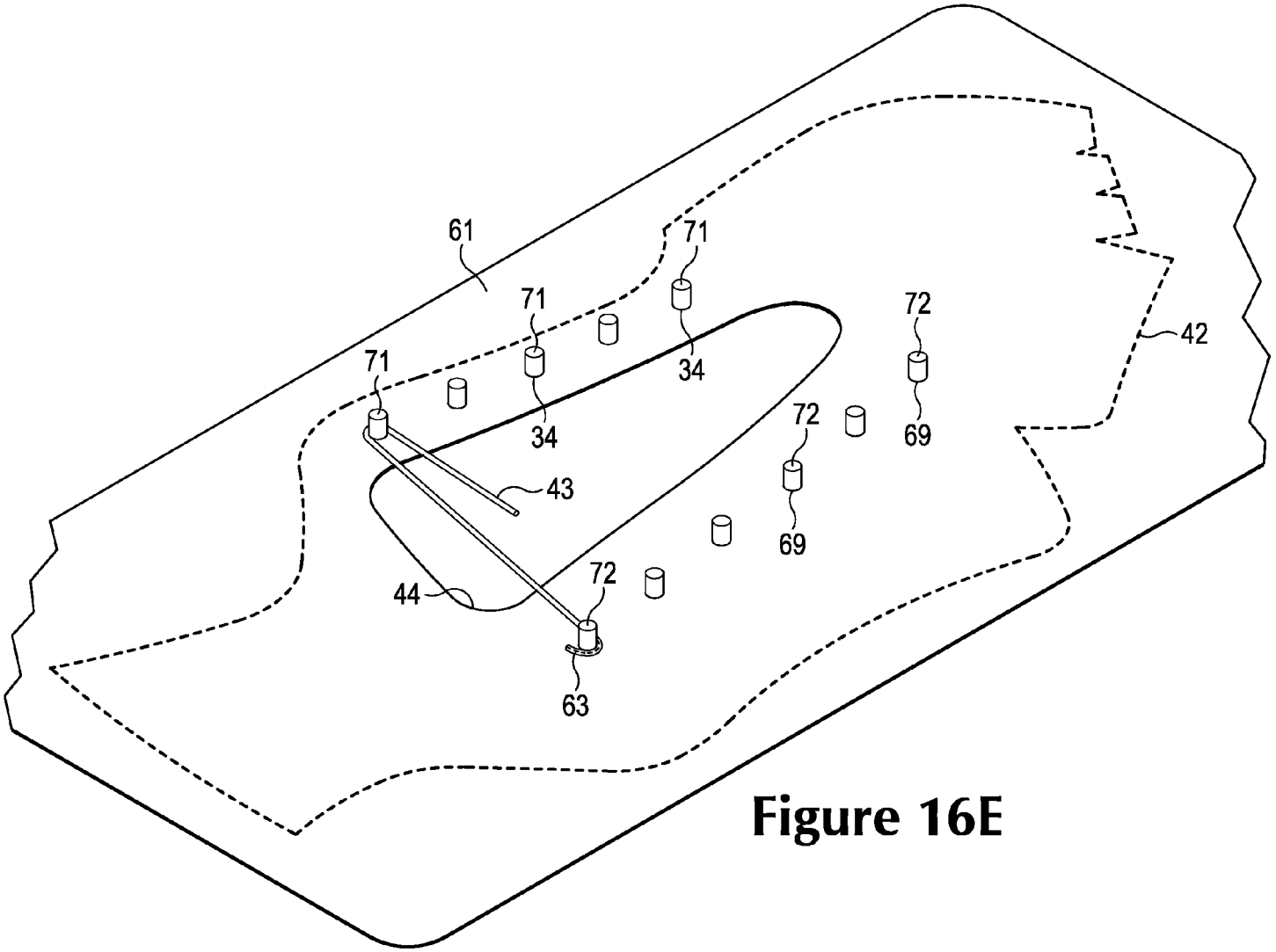

At this stage of the process, strand 43 is stitched to interior material element 42 with thread 63 at a location that generally corresponds with lower region 37. Continuing with the manufacturing process, the cording machine extends strand 43 across opening 44 and to a location that generally corresponds with lace region 36. Additionally, strand 43 passes around (or at least partially around) one of lace pegs 71, as depicted in FIG. 16E, thereby forming a loop from strand 43 in lace region 36 and around one of lace apertures 34. Although strand 43 may be stitched to interior material layer 42, lace peg 71 is generally sufficient to retain the position of strand 43. Moreover, refraining from stitching strand 43 to interior material layer 42 may enhance the speed and efficiency of the manufacturing process.

Figure 16F:
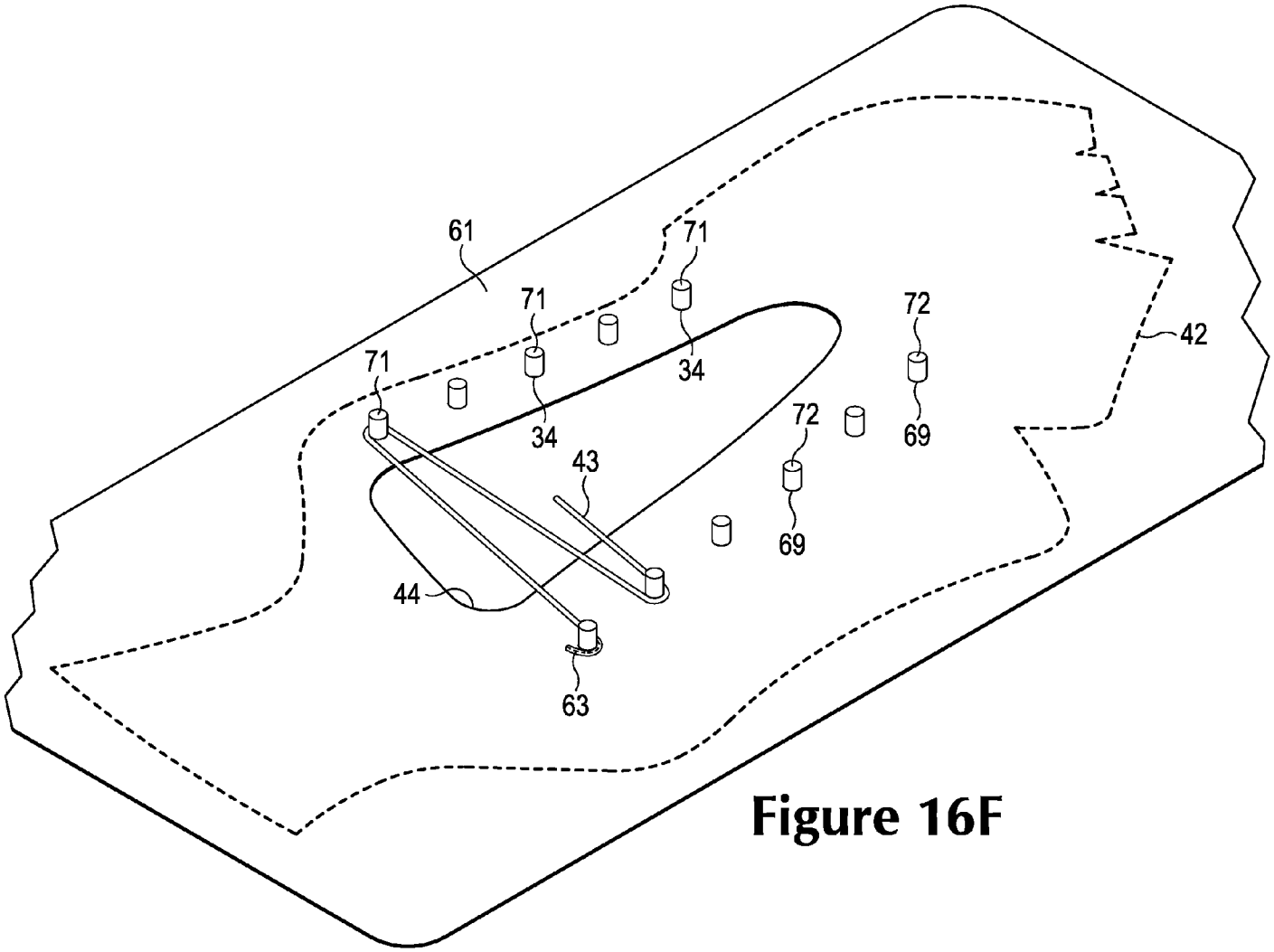
Figure 16G:
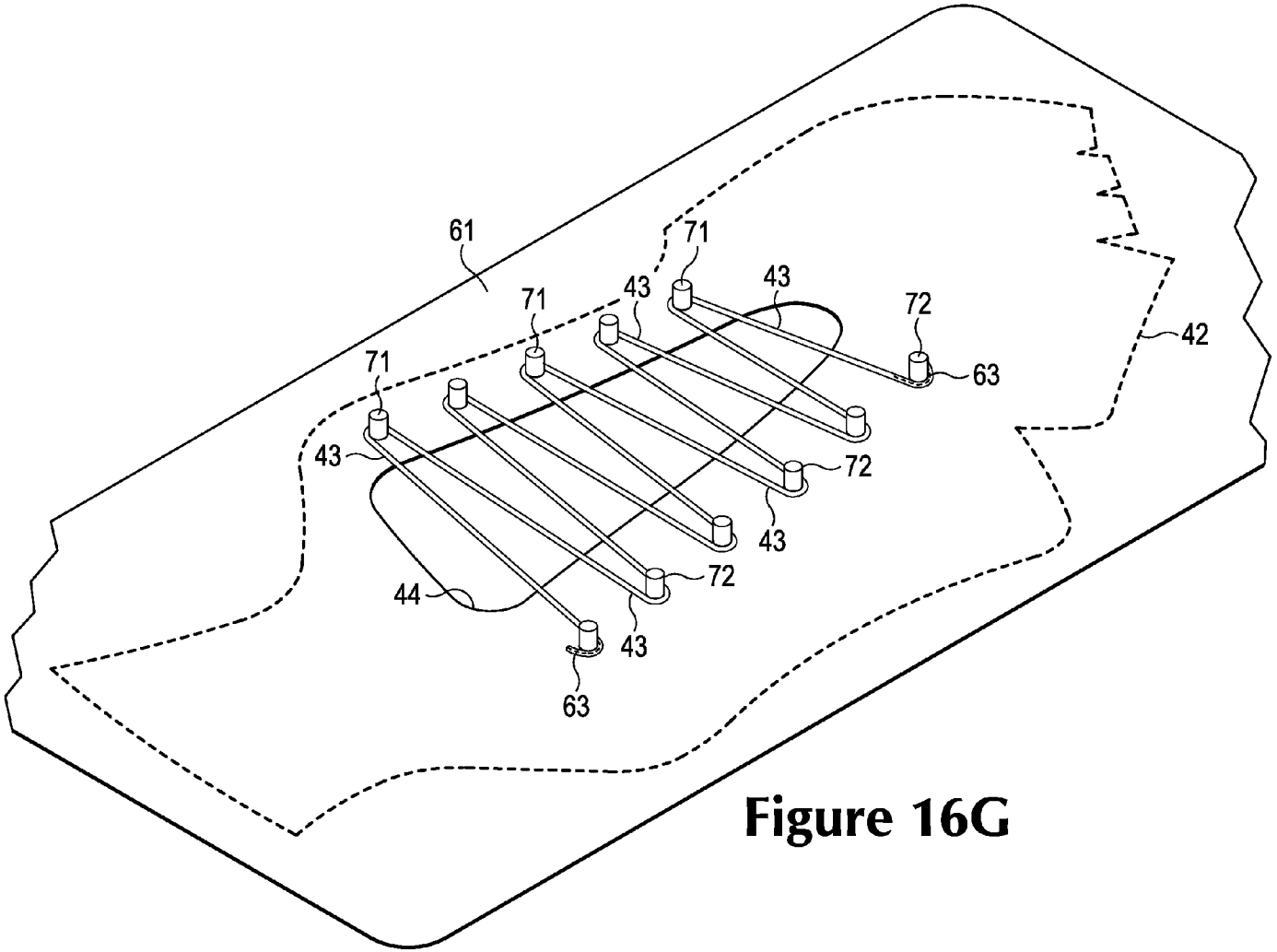

The cording machine then extends strand 43 across opening 44 once again and around one of lower pegs 72, as depicted in FIG. 16F. The general process discussed relative to FIGS. 16E and 16F is now performed multiple times, as depicted in FIG. 16G, to (a) repeatedly extend segments of strand 43 across opening 44 and between regions 36 and 37, (b) alternately extend strand 43 around one of lace pegs 71 and lower pegs 72, and (c) form loops from strand 43 in lace region 36 and around lace apertures 34. In addition, a portion of strand 43 may be stitched to interior material layer 42. Although the specific position where strand 43 is now secured may vary, strand 43 is depicted as being stitched to interior material layer 42 around one of lower pegs 72.

Figure 16H:
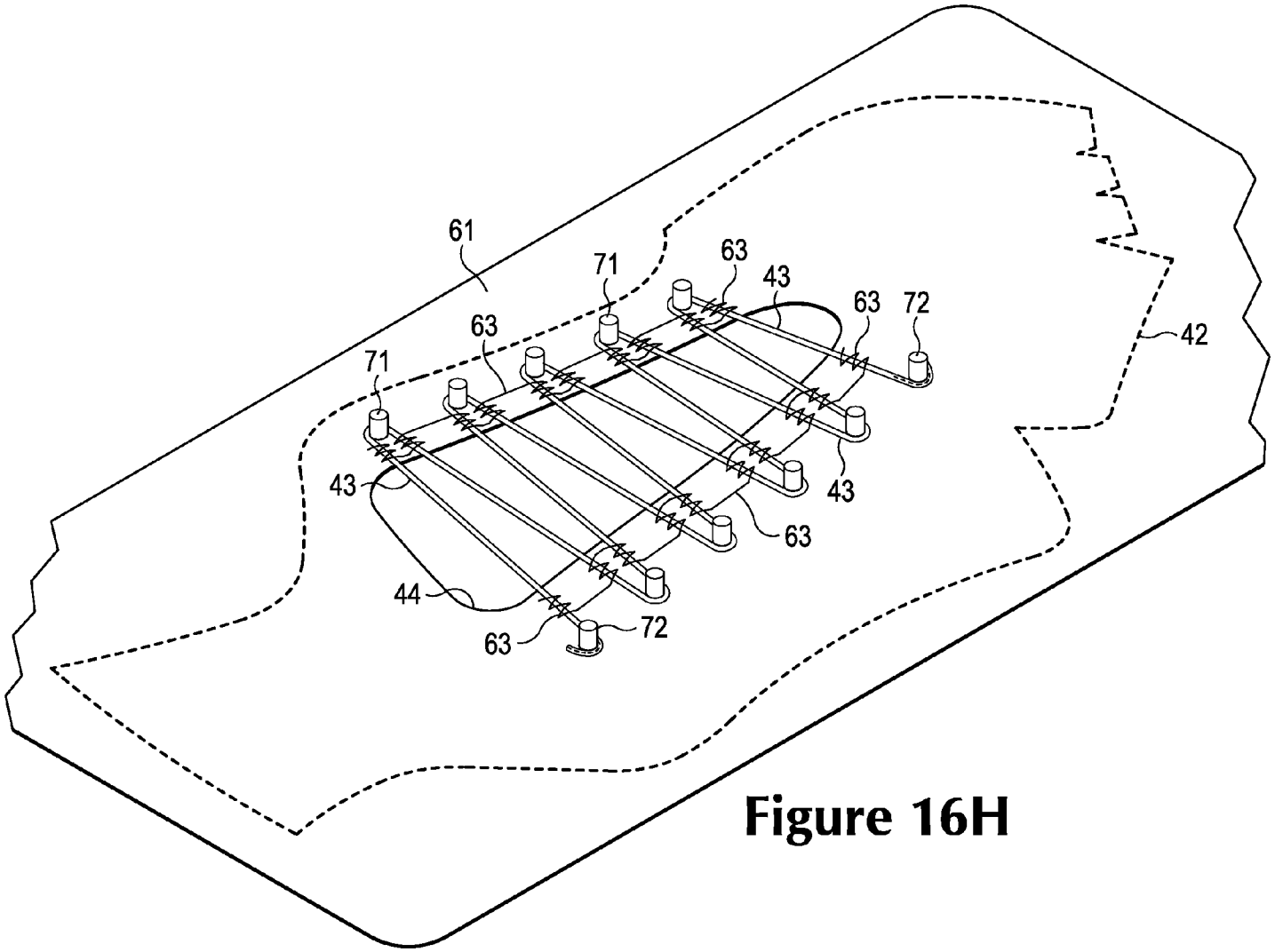

With strand 43 still extending around pegs 71 and 72, the cording machine or another stitching machine stitches portions of strand 43 to interior material layer 42 with thread 63 or another thread, as depicted in FIG. 16H. Although various types of stitches may be utilized, thread 63 is shown as forming a zigzag stitch that repeatedly crosses over strand 43 in each of regions 36 and 37.

Figure 16I:
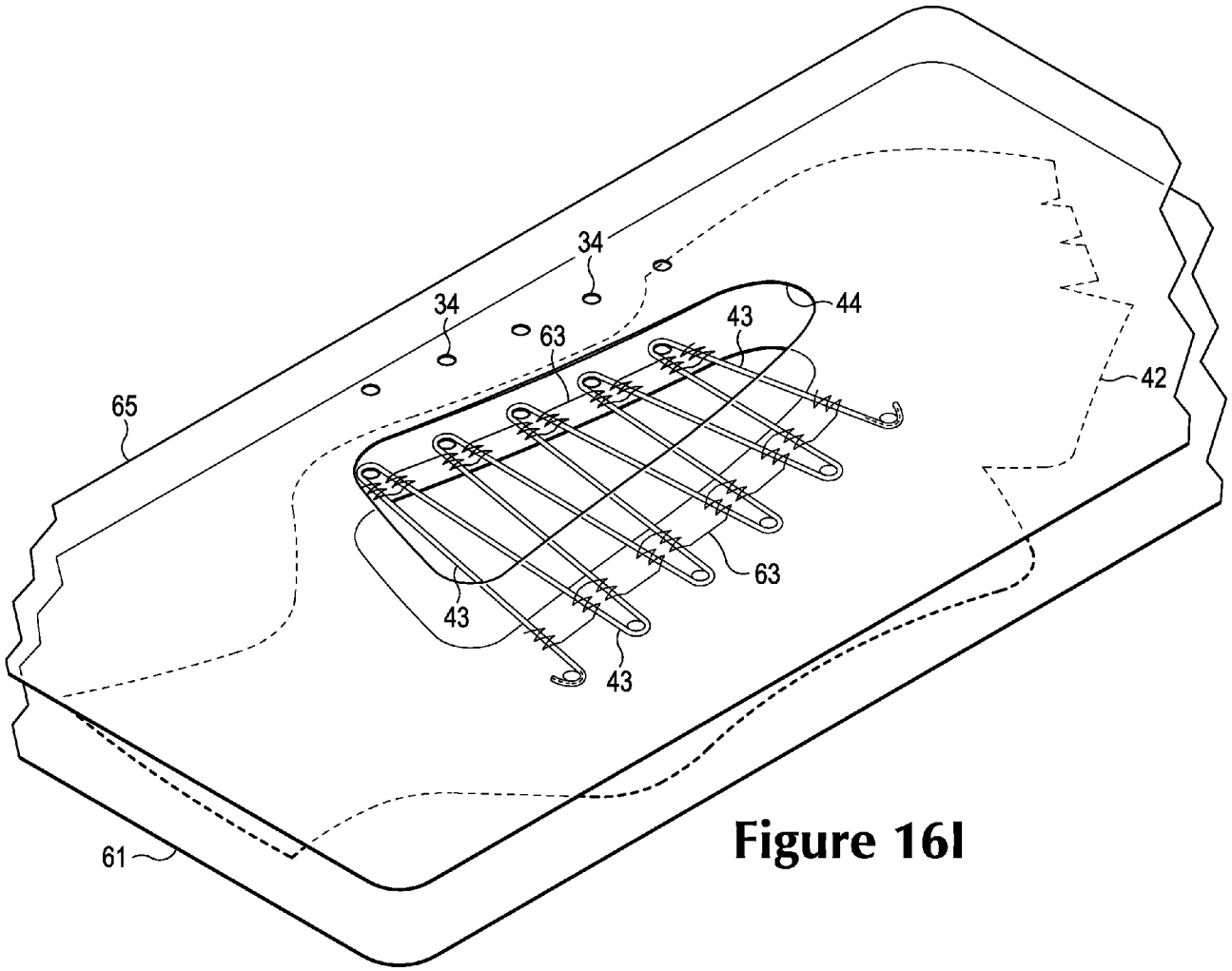
Figure 16J:
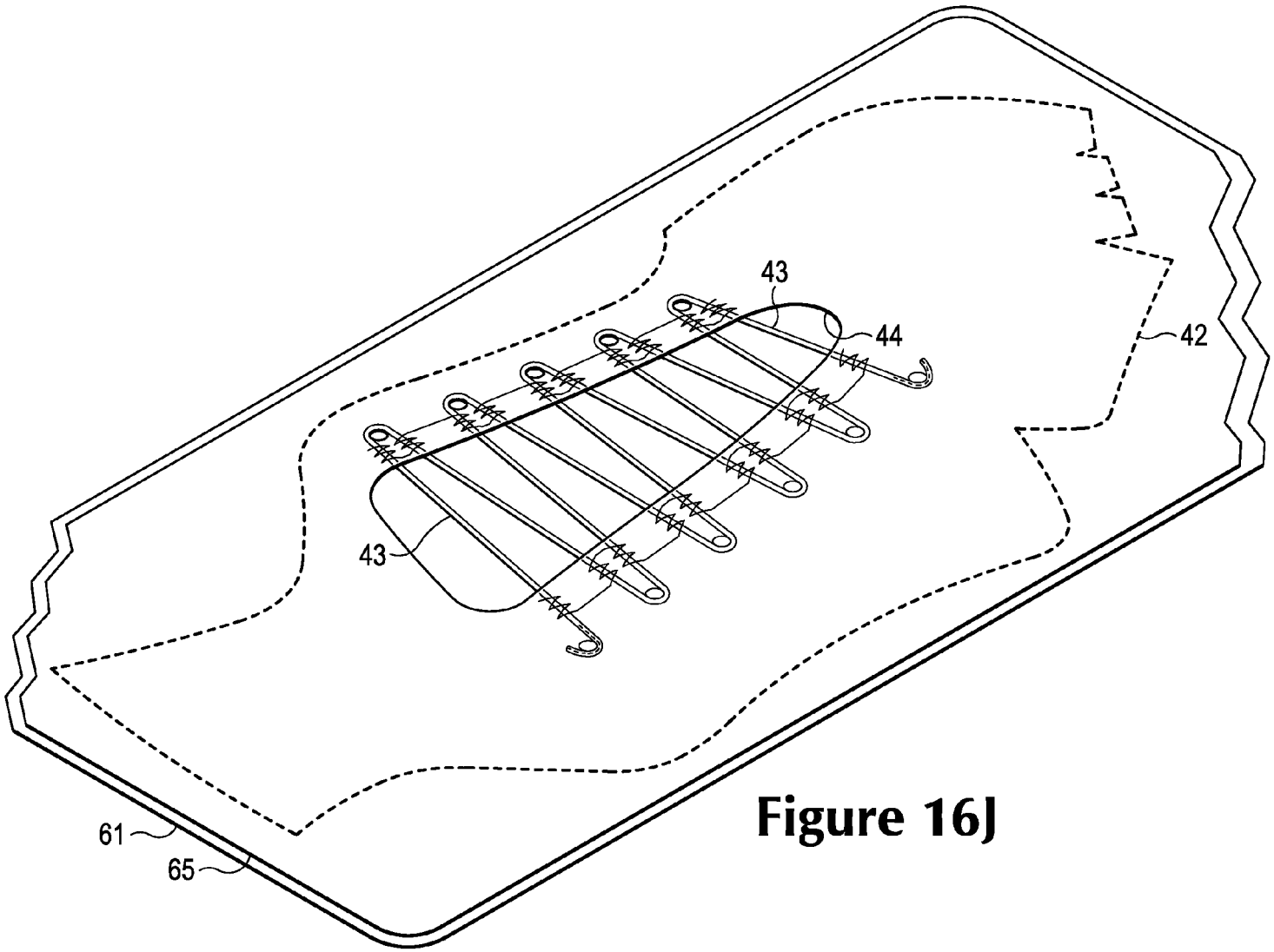

Given that strand 43 is effectively secured to interior material layer 42 with thread 63, pegs 71 and 72 are withdrawn from lace apertures 34 and apertures 69. Additionally, precursor element 65, which becomes exterior material layer 41, may be positioned adjacent to precursor element 61, as depicted in FIG. 16I. In positioning precursor elements 61 and 65, strand 43 is generally located between the portions of precursor elements 61 and 65 that form material layers 41 and 42 at a later stage of the process. Die cutting or other operations may also be utilized to form other portions of lace apertures 34 and opening 44 defined by exterior material layer 41 through precursor element 61, Precursor elements 61 and 65 are now bonded together, as depicted in FIG. 16J. As an example, the assembled elements (i.e., strand 43, thread 63, and precursor elements 61 and 65) may be located within a heat press that simultaneously heats and compresses the elements. Thermoplastic polymer materials in one or both of precursor elements 61 and 65 may bond with the other of precursor elements 61 and 65 to effectively join the elements. The thermoplastic polymer material may also bond with strand 43 to further secure strand 43. As other examples, adhesives or further stitching may be utilized to join the assembled elements or supplement the bond formed by the thermoplastic polymer materials. It should also be noted that other elements or material layers may be bonded or otherwise secured during this stage of the process.

Figure 16K:
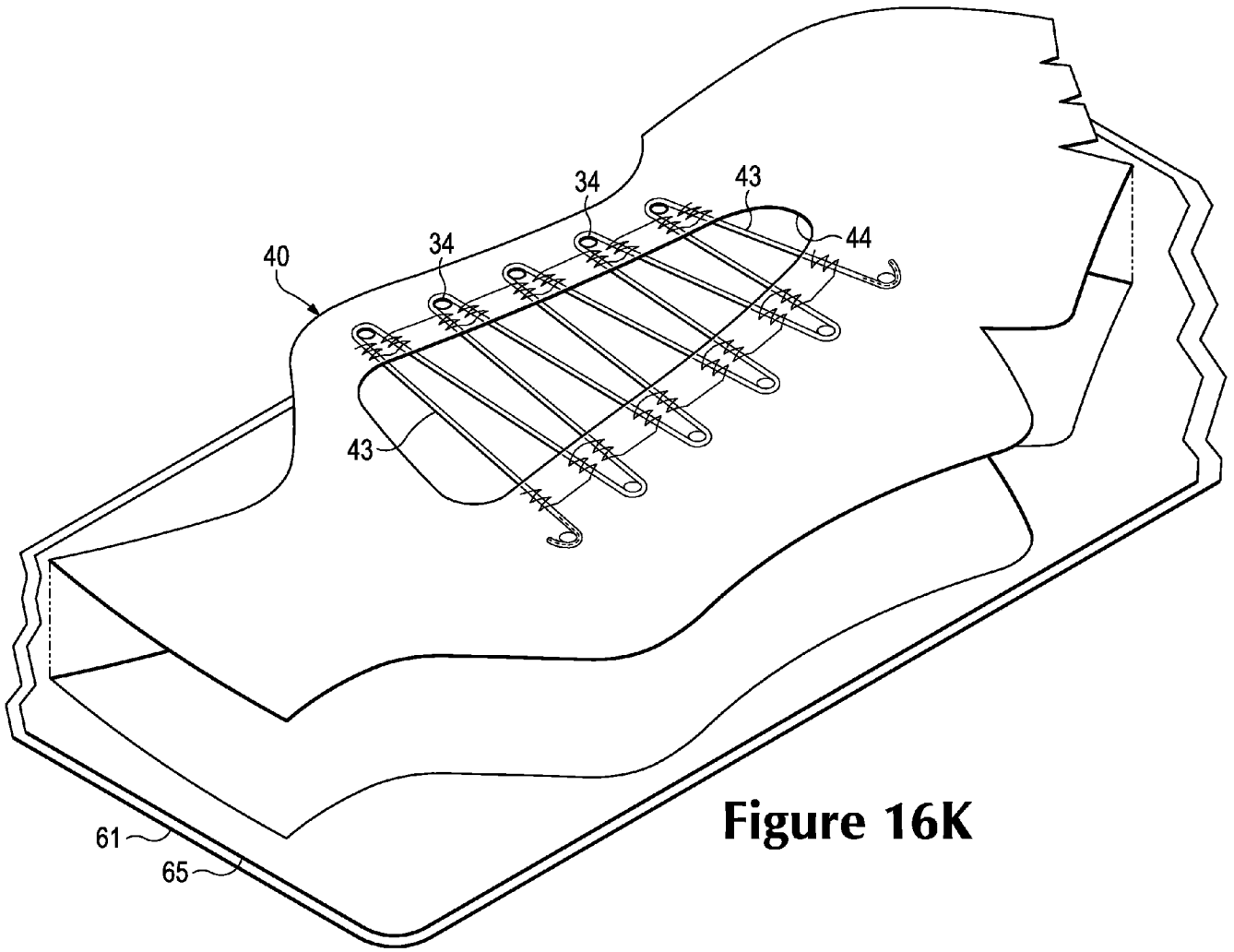

A substantially completed tensile strand element 40 may be removed from excess portions of precursor elements 61 and 65, as depicted in FIG. 16K, with die cutting, laser cutting, or manual cutting, for example. The assembled elements forming tensile strand element 40 are then incorporated into footwear 10 such that (a) lace apertures 34 and the loops formed by strand 43 are located in lace region 36 and (b) areas across opening 44 are located in lower region 37. Lace 33 is also threaded through the various lace apertures 34.

Figure 17:
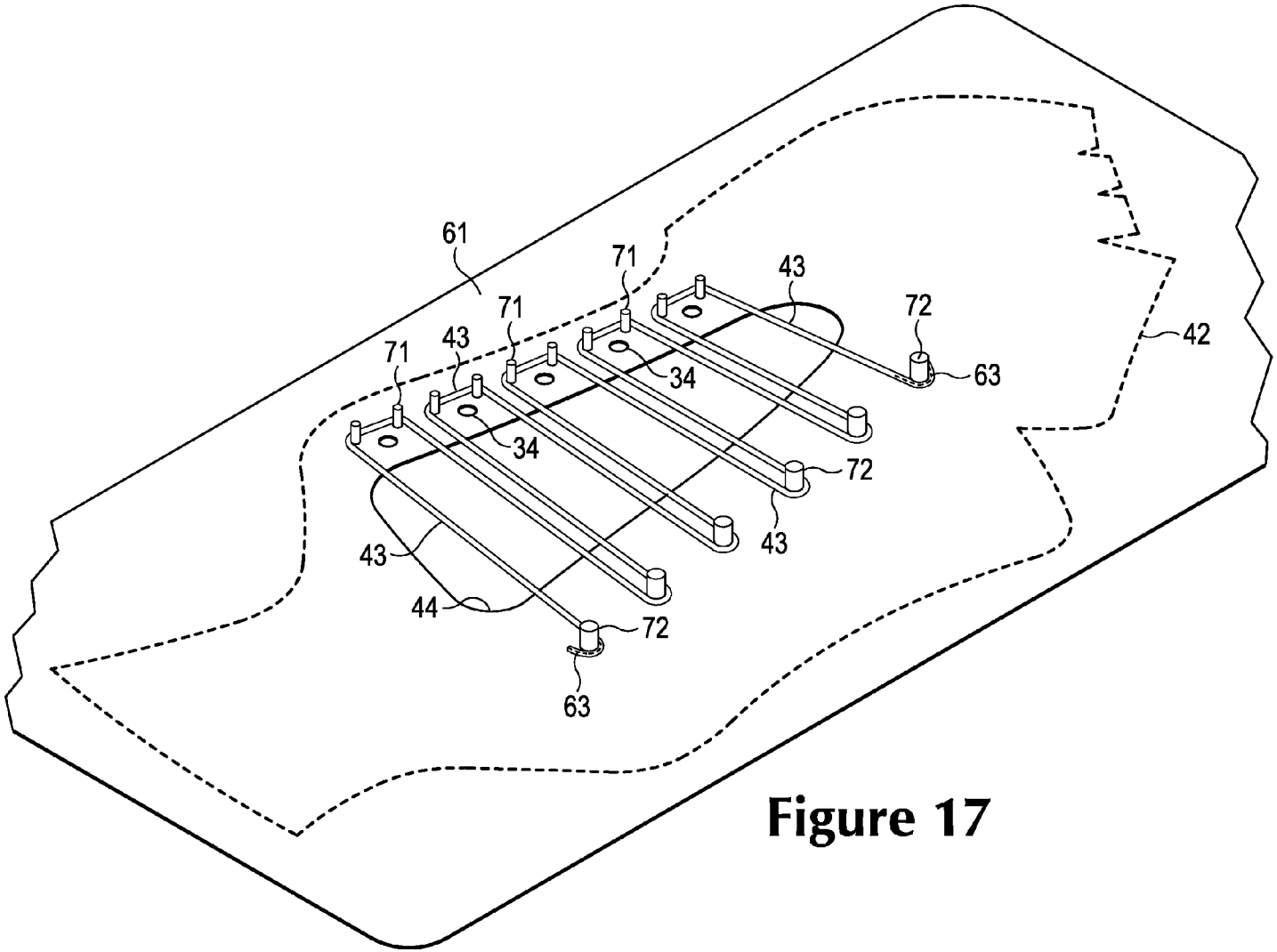
FIG. 17 is a schematic perspective view corresponding with FIG. 16G and depicting a variation of the third example process for manufacturing a tensile strand element.

As an additional matter, FIG. 17 depicts an alternative manner in which the third example manufacturing process may be performed. Whereas lace pegs 71 extended through lace apertures 34 in the example discussed above, two lace pegs 71 extend through interior material layer 42 in areas that are adjacent to each of lace apertures 34. This structure for lace pegs 71 may, for example, be utilized to form the general configuration of tensile strand element 40 depicted in FIG. 10A.

Fourth Example Manufacturing Process

Each of the example manufacturing processes discussed above may be utilized to form the configurations of tensile strand element 40 in FIGS. 9A-9D and 10A-10C. A fourth example manufacturing process that may be utilized to form the configuration of tensile strand element 40 depicted in FIGS. 9E and 10D-12 will now be discussed.

Figure 18A:
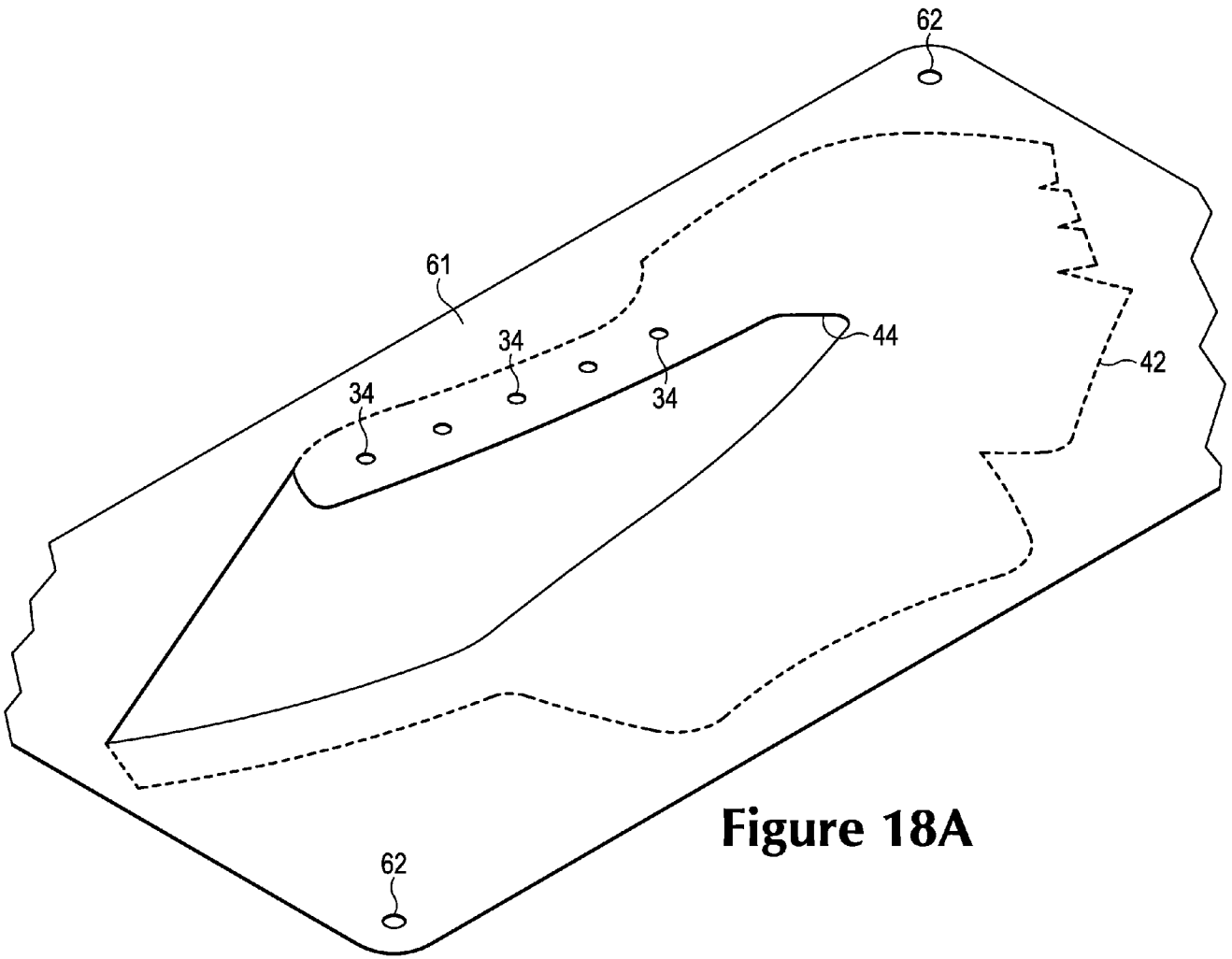
FIGS. 18A-18G are schematic perspective views depicting a fourth example process for manufacturing a tensile strand element.

With reference to FIG. 18A, a precursor element 61 that becomes interior material layer 42 is depicted. For purposes of reference during the following discussion, a dashed outline of interior material layer 42, which is also an outline of tensile strand element 40, is depicted upon precursor element 61. Portions of lace apertures 34 and opening 44 defined by interior material layer 42 area also formed through precursor element 61. Although other registration systems may be utilized, a pair of registration holes 62 are formed through precursor element 61 to ensure that interior material layer 42 remains properly positioned during subsequent operations.

Figure 18B:
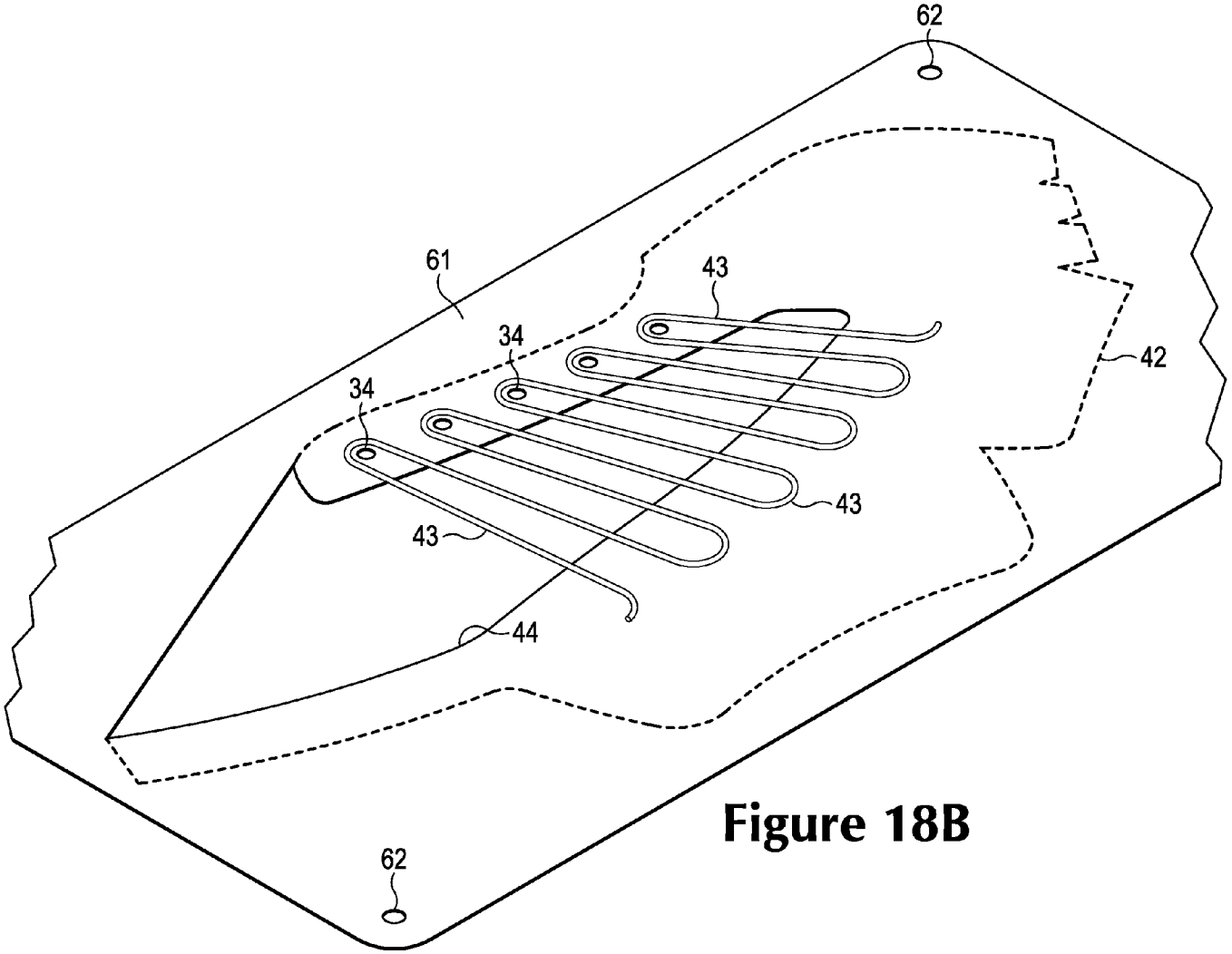
Figure 18C:
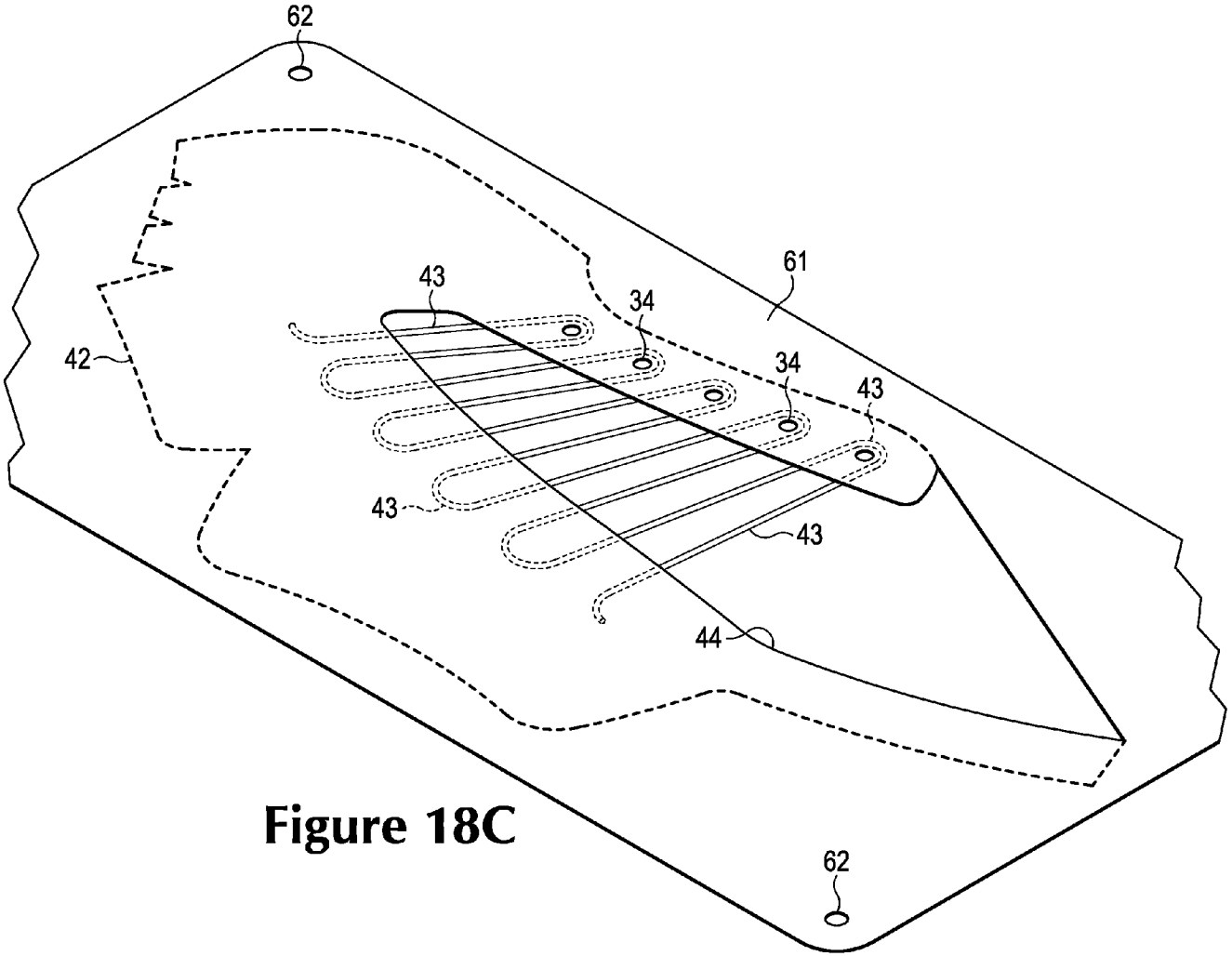
Figure 18D:
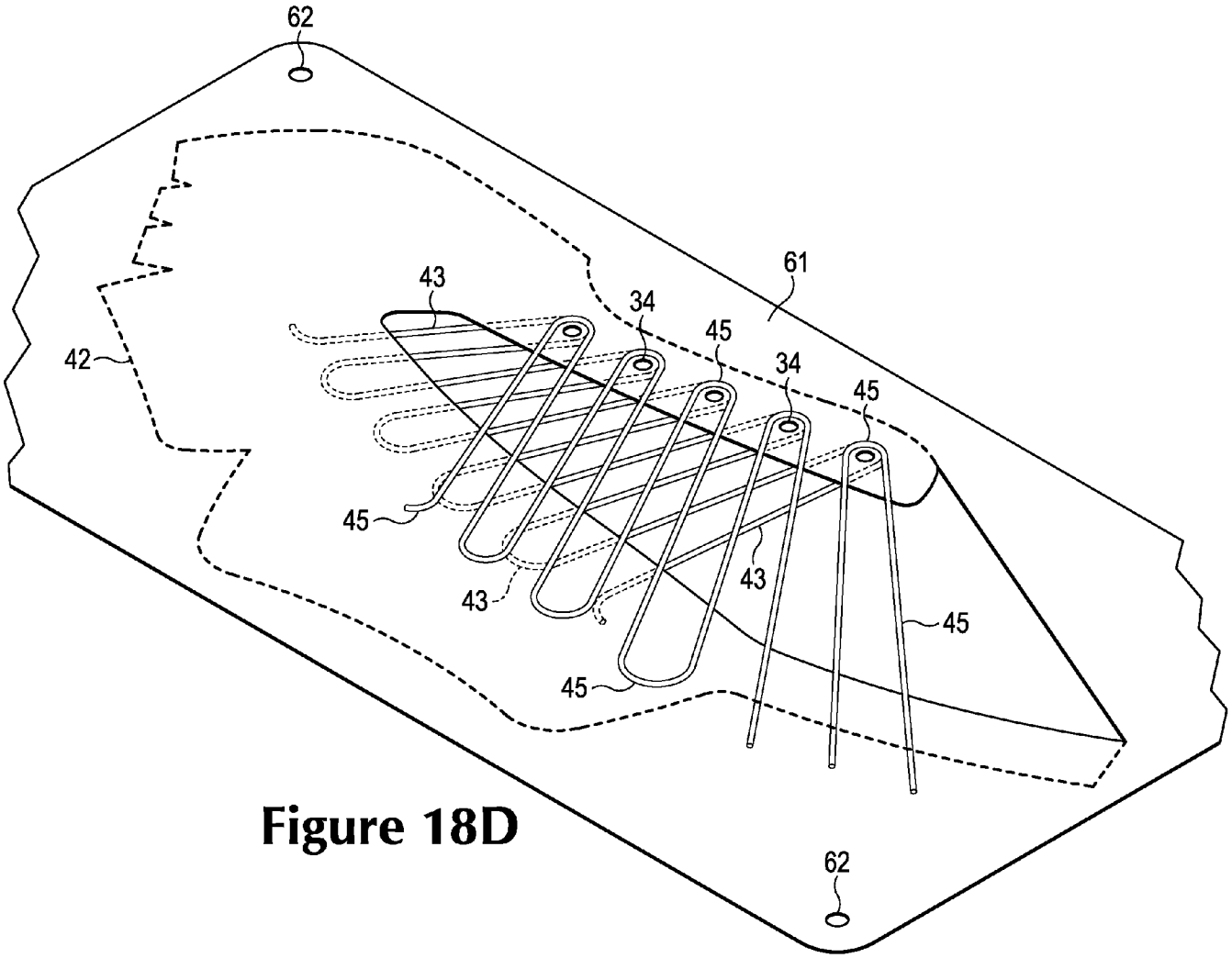

Strand 43 is now laid upon a first surface of interior material layer 42, as depicted in FIG. 18B, utilizing any of the techniques discussed above in the first, second, and third example manufacturing processes, for example. Moreover, strand 43 is secured to the first surface of interior material layer 42, possibly with thread 63. The combination of precursor element 61 and strand 43 is now turned over or otherwise reversed, as depicted in FIG. 18C. Strand 45 is also laid upon a second or opposite surface of interior material layer 42, as depicted in FIG. 18D, utilizing any of the techniques discussed above, for example. Moreover, strand 45 is secured to the second surface of interior material layer 42, possibly with thread 63. Although other methods may be utilized, a cording machine may be employed to locate and secure strands 43 and 45 on the opposite surfaces of interior material element 42. In other processes, separate machines or manual procedures may lay and secure strands 43 and 45.

Figure 18E:
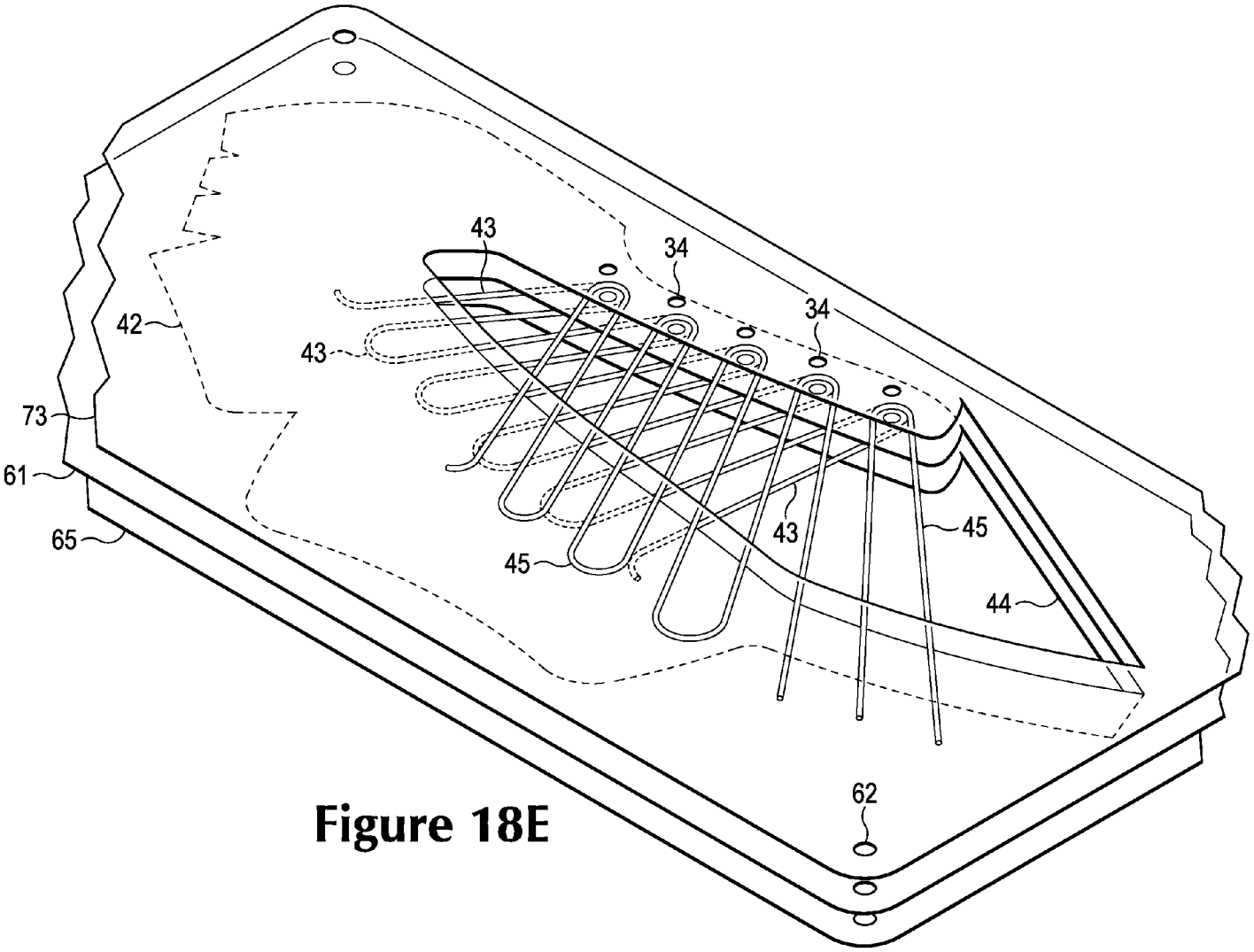

As this stage of the process, each of strands 43 and 45 (a) repeatedly extend across opening 44 and between locations that generally corresponds with each of regions 36 and 37, (b) are stitched or otherwise secured to opposite surfaces of interior material layer 42, and (c) form loops that extend around the portions of lace apertures 34 defined by interior material layer 42. A precursor element 73 that becomes backing material layer 46 may be positioned adjacent to precursor element 61, as depicted in FIG. 18E, such that strand 45 is located between precursor elements 61 and 73. Similarly, precursor element 65, which becomes exterior material layer 41, may be positioned adjacent to precursor element 61 such that strand 43 is located between precursor elements 61 and 65. Die cutting or other operations may also be utilized to define further portions of opening 44 (i.e., the portions of opening 44 defined by material layers 41 and 46) through precursor elements 65 and 73. Additionally, precursor elements 65 and 73 may include registration holes 66 to assist with aligning the portions of opening 44 formed by each of material layers 41 and 46.

Figure 18F:
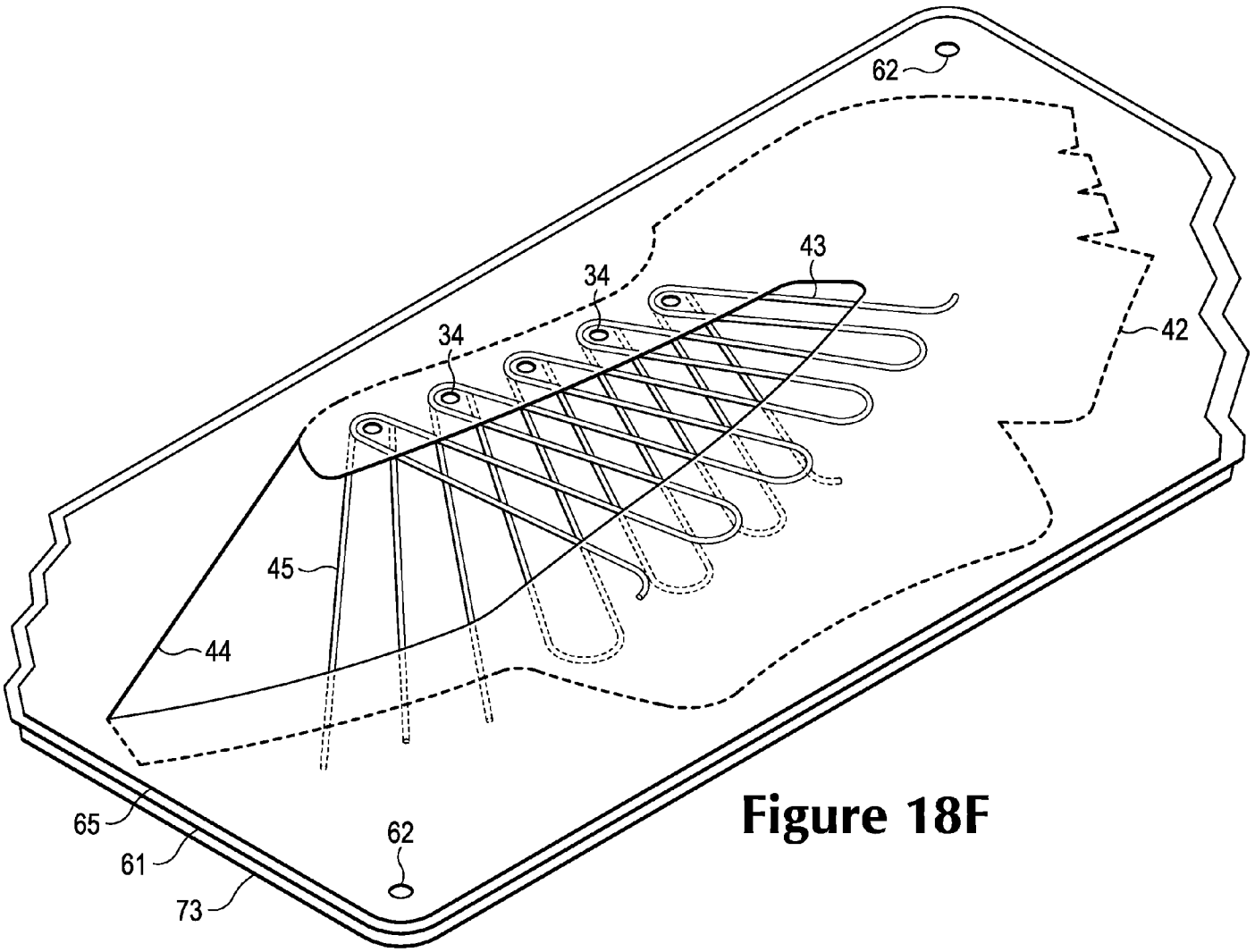

Precursor elements 61, 65, and 73 are now bonded together, as depicted in FIG. 18F. As an example, the assembled elements (i.e., strands 43 and 45, precursor elements 61, 65, and 73) may be located within a heat press that simultaneously heats and compresses the elements. Thermoplastic polymer materials in any of precursor elements 61, 65, and 73 may bond with the other of precursor elements 61, 65, and 73 to effectively join the elements. The thermoplastic polymer material may also bond with strands 43 and 45. As other examples, adhesives or further stitching may be utilized to join the assembled elements or supplement the bond formed by the thermoplastic polymer materials. It should also be noted that other elements or material layers may be bonded or otherwise secured during this stage of the process. If not formed during a previous operation, lace apertures 34 may be formed within the loops formed by strands 43 and 45 through material layers 41, 42, and 46.

Figure 18G:
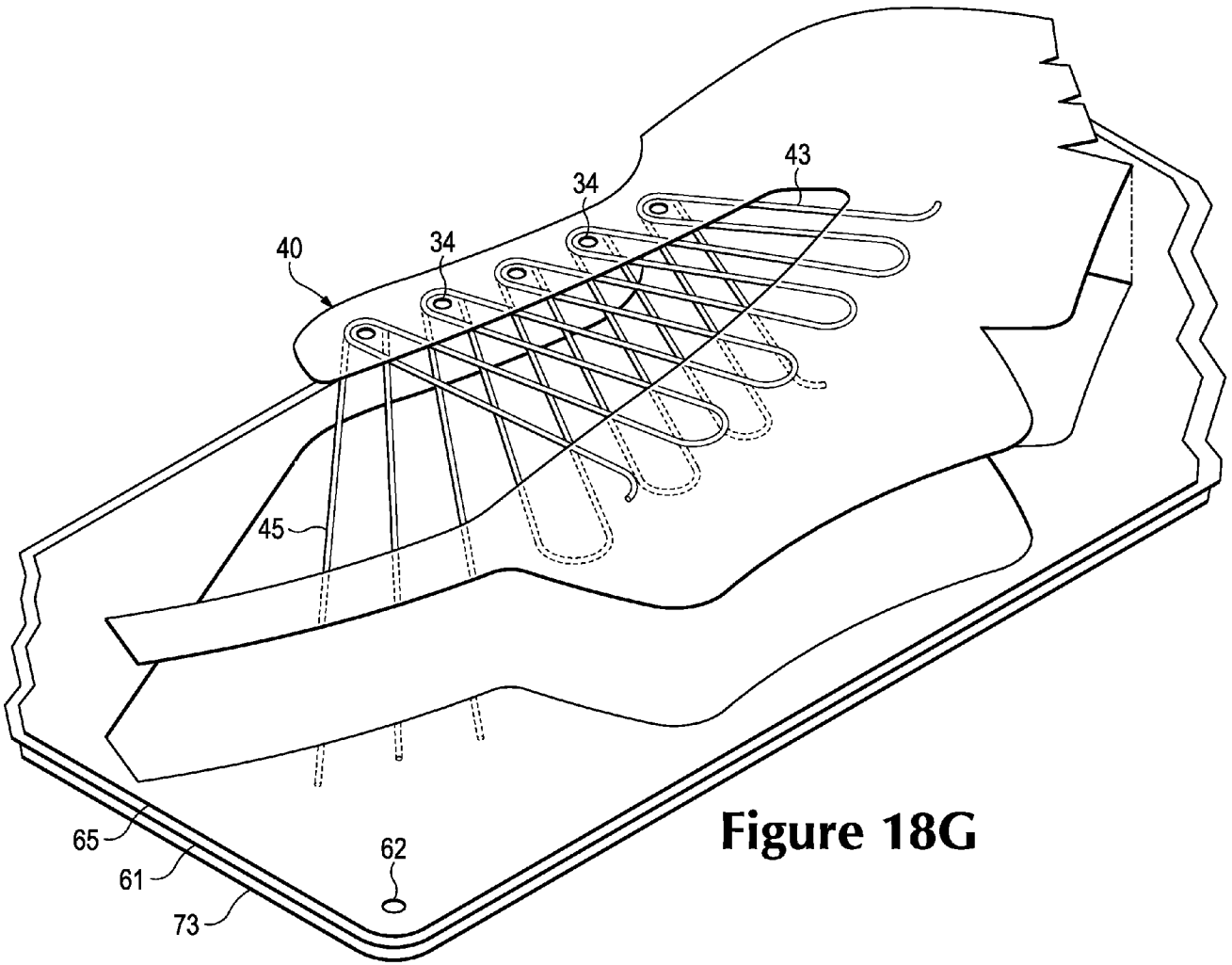

A substantially completed tensile strand element 40 may be removed from excess portions of precursor elements 61, 65, and 73, as depicted in FIG. 18G, with die cutting, laser cutting, or manual cutting, for example. The assembled elements forming tensile strand element 40 are then incorporated into footwear 10 such that (a) lace apertures 34 and the loops formed by strands 43 and 45 are located in lace region 36 and (b) areas across opening 44 are located in lower region 37. Lace 33 is also threaded through the various lace apertures 34.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. An article of footwear having an upper and a sole structure secured together, the upper comprising:

a plurality of material layers located in at least (a) a lace region that is spaced from the sole structure and (b) a lower region that is proximal to an area where the sole structure is secured to the upper;

the plurality of material layers forming an opening located in an area between the lace region and the lower region;

at least one strand that extends repeatedly between the lace region and the lower region to form a plurality of loops in the lace region, the at least one strand being secured to the material layers in the lace region and the lower region, and multiple segments of the at least one strand being unsecured to the material layers for a distance of at least four centimeters across the opening in the area between the lace region and the lower region.

2. The article of footwear recited in claim 1, wherein the opening extends from an ankle opening in a heel region of the upper to at least a midfoot region of the upper.

3. The article of footwear recited in claim 2, wherein the opening extends to at least a portion of a forefoot region of the upper.

4. The article of footwear recited in claim 2, wherein the plurality of material layers located in the lace region adjacent to the ankle opening include an edge spaced apart from a portion of the upper disposed in the heel region.

5. The article of footwear recited in claim 4, further comprising another strand extending between the lace region and the lower region of the portion of the upper disposed in the heel region.

6. The article of footwear recited in claim 1, wherein the plurality of material elements define a void within the upper and between a lateral side and a medial side for receiving at least a foot; and a bootie element disposed within the void.

7. The article of footwear recited in claim 6, wherein the at least one strand is configured to lay against a portion of the bootie element when the bootie element is covering a foot disposed within the article of footwear.

8. The article of footwear recited in claim 1, wherein the plurality of loops in the lace region have a squared aspect.

9. The article of footwear recited in claim 1, wherein the plurality of material layers comprises an exterior material layer and an interior material layer; and wherein the at least one strand is secured between the exterior material layer and the interior material layer.

10. The article of footwear recited in claim 9, wherein the opening located in the area between the lace region and the lower region is disposed through the exterior material layer and the interior material layer; and wherein edges of the exterior material layer defining the opening are disposed inward of edges of the interior material layer defining the opening.

11. An article of footwear having an upper and a sole structure secured together, the upper comprising:

a plurality of material elements joined together to define (a) a lateral side of the upper, (b) a medial side of the upper located opposite the lateral side, and (c) a void within the upper and between the lateral side and the medial side for receiving at least a foot, the material elements also defining a lace region and a lower region, the material elements including a base material layer located in at least the lace region, the base material layer having a first surface and an opposite second surface, and the base material layer defining a plurality of apertures for lace-receiving elements that extend from the first surface to the second surface in the lace region, the lower region being spaced from the lace region and located proximal to an area where the sole structure is secured to the upper, and the material elements forming an opening in an area between the lace region and the lower region, the opening extending from an exterior surface of the upper to the void, and the opening extending from an ankle opening in a heel region of the upper to at least a midfoot region of the upper; and a plurality of strand segments extending from the lace region to the lower region and across the opening, the strand segments including a first strand segment and a second strand segment, the first strand segment being located adjacent to the first surface of the base material layer and forming a loop extending at least partially around a first aperture of the plurality of apertures, and the first strand segment having a substantially vertical orientation in the area between the lace region and the lower region, the second strand segment being located adjacent to the first surface of the base material layer and forming a loop extending at least partially around a second aperture, and the second strand segment extending toward the heel region of upper in the area between the lace region and the lower region.

12. The article of footwear recited in claim 11, wherein the base material layer located in the lace region adjacent to the ankle opening includes an edge spaced apart from an upper area of the upper disposed in the heel region.

13. The article of footwear recited in claim 12, wherein the second strand segment extends from the lace region to the upper area.

14. The article of footwear recited in claim 13, wherein the second strand segment has a generally horizontal orientation in the area between the lace region and the upper area.

15. The article of footwear recited in claim 11, wherein the sole structure comprises a plurality of spikes configured to provide traction.

16. The article of footwear recited in claim 11, wherein the plurality of strand segments extending across the opening has varying orientations.

17. The article of footwear recited in claim 11, wherein the opening extends to at least a portion of a forefoot region of the upper.

* * * * *